US005173396A

United States Patent [19]

Nagasaki et al.

[11] Patent Number: 5,173,396

[45] Date of Patent: Dec. 22, 1992

[54] SILVER HALIDE PHOTOGRAPHIC LIGHT-SENSITIVE MATERIAL

[75] Inventors: Satoru Nagasaki; Haruhiko Sakuma; Hiroyuki Hashimoto; Kazuya Tsukada, all of Hino, Japan

[73] Assignee: Konica Corporation, Tokyo, Japan

[21] Appl. No.: 814,314

[22] Filed: Dec. 23, 1991

Related U.S. Application Data

[63] Continuation of Ser. No. 596,991, Oct. 11, 1990, abandoned.

[30] Foreign Application Priority Data

| | | | |
|---|---|---|---|
| Oct. 14, 1989 | [JP] | Japan | 1-267188 |
| Nov. 15, 1989 | [JP] | Japan | 1-296446 |
| Dec. 12, 1989 | [JP] | Japan | 1-321876 |

[51] Int. Cl.[5] ..... G03C 1/85

[52] U.S. Cl. ..... 430/529; 430/527; 430/531; 430/536

[58] Field of Search ..... 430/529, 527, 531, 536

[56] References Cited

U.S. PATENT DOCUMENTS

| | | | |
|---|---|---|---|
| 4,147,550 | 4/1979 | Campbell et al. | 430/529 |
| 4,225,665 | 9/1980 | Schadi | 430/529 |
| 4,233,074 | 11/1980 | Dodwell et al. | 430/529 |
| 4,245,036 | 1/1986 | De Winter et al. | 430/529 |
| 4,308,332 | 12/1981 | Upson et al. | 430/529 |
| 4,388,472 | 6/1983 | Mukunoki et al. | 430/529 |
| 4,677,050 | 6/1987 | Yokoyama et al. | 430/529 |
| 4,701,403 | 10/1987 | Miller | 430/529 |
| 4,895,791 | 1/1990 | Mukunoki et al. | 430/529 |

*Primary Examiner*—Jack P. Brammer
*Attorney, Agent, or Firm*—Jordan B. Bierman

[57] ABSTRACT

A light-sensitive silver halide photographic material is disclosed. The photographic material comprises an antistatic layer comprising a water-soluble electric conductive polymer, hydrophobic polymer particles and a hardener; and a hydrophilic colloidal layer containing a polyhydric alcohol. The photographic material may further comprises an electric conductive layer at the outer than a silver halide emulsion layer from the support, and the hydrophobic polymer particle may contain a dye. The photographic material is suitable for the use of an X-ray recording film.

14 Claims, No Drawings

SILVER HALIDE PHOTOGRAPHIC LIGHT-SENSITIVE MATERIAL

This application is a continuation of application Ser. No. 07/596,991, filed Oct. 11, 1990, now abandoned.

FIELD OF THE INVENTION

The present invention relates to a silver halide photographic light-sensitive material having an antistatic property.

BACKGROUND OF THE INVENTION

Generally, a light-sensitive material comprising an electrically insulated support and photographic component layers is liable to accumulate static electricity thereon due to friction caused by contact with or stripping from the same or foreign materials.

In order to improve the conductivity of a support or photographic component layers, various methods have been proposed. These methods include the addition of various hygroscopic substances, water-soluble inorganic salts, a certain kind of surfactant or a polymer.

However, many of these antistatic agents lose their effects or cause adverse effects on the photographic properties of a light-sensitive material depending on the kind of support or photographic components. Some of them completely lose their antistatic effects after development. In recent years, to obtain an improved antistatic property, there have been developed methods of increasing the conductivity of a light-sensitive material (see Japanese Patent Publication Open to Public Inspection No. 84658/1980). These methods can improve the antistatic property of a light-sensitive material to some extent, but are accompanied by such a problem that emulsion layers tend to separate from a support or easily get scratches when a light-sensitive material is in a wet state (during development). With the recent trend of rapid conveyance or processing of a photofilm, the physical properties of layers have become a matter of crucial importance. Not only in a dry state but also in a wet state, the layers of a light-sensitive material are strongly required to be improved in resistance to peeling-off and scratches.

The applicant previously proposed in Japanese Patent Application Nos. 330860/1988 and 44106/1989 the use of a hardener, an electroconductive polymer and a hydrophobic polymer. The use of these compounds can improve the antistatic property of a light-sensitive material to some extent, but cannot avoid such problems as peeling-off and scratches of layers which may occur during rapid processing.

Diagnosis or examination with an X-ray photograph is usually made by direct observation of a silver image. In such case, the tone of a silver image is very important. Fading or generation of a stain not only hinders smooth observation but also may lead to wrong diagnosis or evaluation. Therefore, a light-sensitive material for X-ray photography is strongly required to form a clear silver image of pure black.

Conventionally, toning agents such as a mercapto compound have been employed to adjust the tone of a silver image.

However, use of such conventional toning agents in the highly-sensitive silver halide light-sensitive material of the present invention results in serious desensitization. Japanese Patent O.P.I. Publication Nos. 285445/1986 and 276539/1987 disclose the use of a specific dye as a toning agent in a silver halide emulsion with a prescribed covering power. These methods are defective in sensitivity and shelf life.

Under such circumstances, the applicant previously proposed in Japanese Patent Application No. 139607/1989 employment of a dispersion of a specific anthraquinone-based dye.

A light-sensitive material containing this dye can produce a silver image of pure black. Further, by changing the kind and amount of the dye, the tone of a silver image can be controlled arbitrarily.

For the antistatic purpose, the inventor tried to provide the preceding electroconductive layer disclosed in Japanese Patent O.P.I. Publication No. 84658/1980 in the anthraquinone dye-containing light-sensitive material. The provision of this layer favorably affected the tone of a silver image, but was unexpectedly accompanied by generation of a large amount of static marks due to insufficient lowering in surface specific resistance.

SUMMARY OF THE INVENTION

An object of the invention is to provide a silver halide photographic light-sensitive material imparted with an antistatic property having no adverse effects on photographic properties.

Another object of the invention is to provide a silver halide photographic light-sensitive material having an antistatic property having no adverse effects on the abrasion (scratches) resistance of a wet light-sensitive material during rapid processing.

Still another object of the invention is to provide a silver halide photographic light-sensitive material imparted with an antistatic property which is hardly impaired even after development.

A further object of the invention is to provide a silver halide photographic light-sensitive material imparted with an antistatic property with an antistatic agent causing no fogging even when a light-sensitive material is subjected to rapid drying in its production or is bent in its handling.

A still further object of the invention is to provide a silver halide photographic light-sensitive material capable of forming a silver image of pure black.

Other objects are evident from the following detailed description.

The silver halide photographic light-sensitive material of the invention has a support and a silver halide emulsion layer, which material comprises an antistatic layer containing (1) a water-soluble electroconductive polymer, (2) hydrophobic polymer particles, and (3) a hardener, and a hydrophilic colloid layer containing a polyhydric alcohol compound.

The invention will be described in more detail.

The hydrophilic coloidal layer containing the polyhydric alcohol compound is a silver halide emulsion layer or a layer adjacent layer to the silver halide emulsion layer, and preferably a silver halide emulsion layer.

The hydrophobic polymer particles may contain a dye having an absorption maximum wave length between 400 and 510 nm.

The light-sensitive silver halide photographic material may further comprises an electric conductive layer, which comprises a water-soluble electric conductive polymer, hydrophilic polymer particles and a hardener over a hydrophilic colloid layer nearest to the support. This layer may be provided on the silver halide emulsion layer or at the outermost.

The layers of a light-sensitive material hardly take scratches during rapid processing and hardly peel off even in the dry state, when the antistatic layer is provided on a between a hydrophilic colloid layer nearest to a support and a layer adjacent to said layer and/or at the outermost surface.

An explanation will be made on the water-soluble electroconductive polymer (1) of the invention.

The water-soluble electroconductive polymer (1) is a polymer containing at least one electric conductive group selected from a sulfonic acid group, a sulfuric ester group, a quaternary ammonium salt, a tertiary ammonium salt, a carboxyl group, a polyethylene oxide group. Of them, a sulfonic acid group, a sulfuric ester group and a quaternary ammonium salt are preferable. An electroconductive group is needed to be contained in a proportion of not less than 5 wt % per molecule of the polymer.

The examples of the water-soluble electroconductive polymer (1) will be given below.

P-1

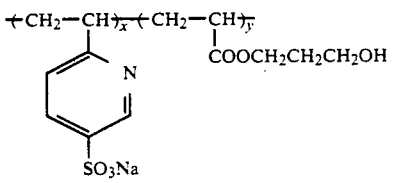

x:y = 70:30

$\overline{M} \approx 20{,}000$

P-2

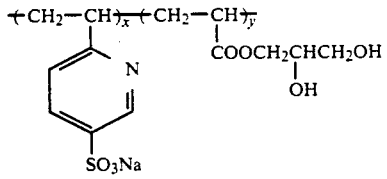

x:y = 70:30

$\overline{M} \approx 700{,}000$

P-3

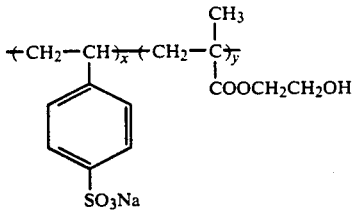

x:y = 70:30

$\overline{M} \approx 10{,}000$

P-4

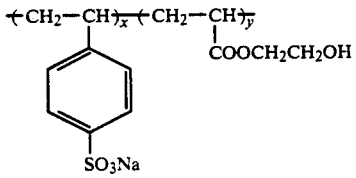

x:y = 70:30

$\overline{M} \approx 5000$

-continued

P-5

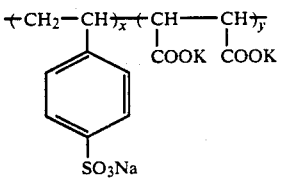

x:y = 50:50

$\overline{M} \approx 6000$

P-6

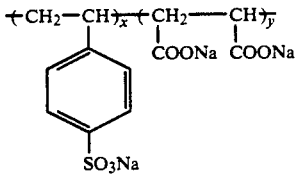

x:y = 65:35

$\overline{M} \approx 12{,}000$

P-7

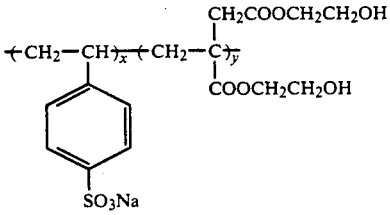

x:y = 98:2

$\overline{M} \approx 200{,}000$

P-8

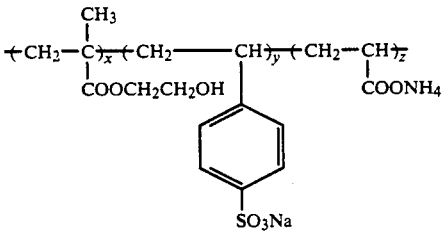

x:y:z = 40:30:1

$\overline{M} \approx 750{,}000$

P-9

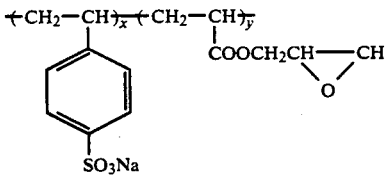

x:y = 70:30

$\overline{M} \approx 20{,}000$

P-10

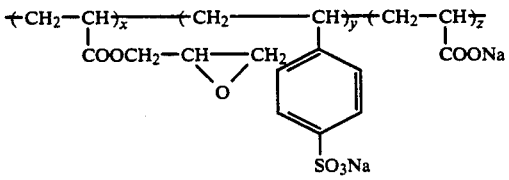

x:y:z = 85:13:2

$\overline{M} \approx 800{,}000$

-continued

P-11

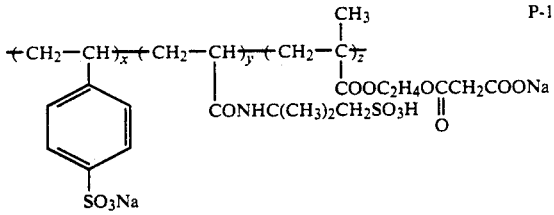

x:y:z = 88:19:3

$\overline{M} \approx 900{,}000$

P-12

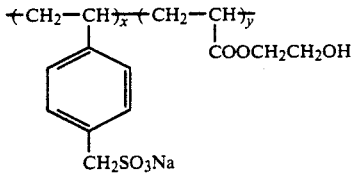

x:y = 80:20

$\overline{M} \approx 1{,}000{,}000$

P-13

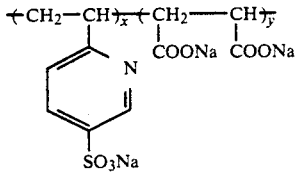

$\overline{M} \approx 10{,}000$ x:y = 80:20

P-14

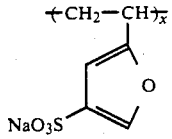

$\overline{M} \approx 200{,}000$

P-15

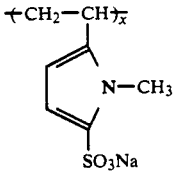

$\overline{M} \approx 200{,}000$

P-16

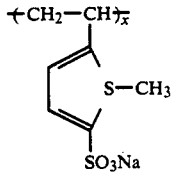

$\overline{M} \approx 150{,}000$

P-17

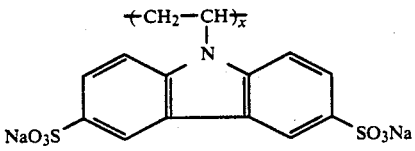

-continued $\overline{M} \approx 300{,}000$

P-18

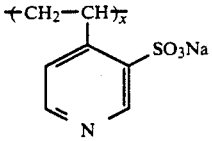

$\overline{M} \approx 280{,}000$

P-19

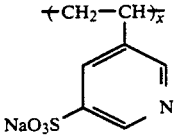

$\overline{M} \approx 450{,}000$

P-20

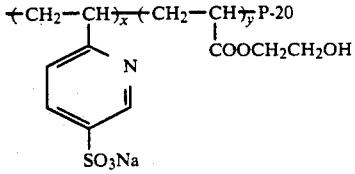

x:y = 60:40

$\overline{M} \approx 800{,}000$

P-21

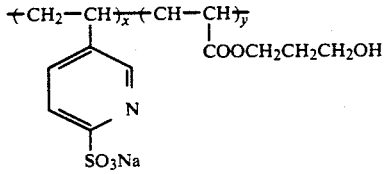

x:y = 70:

$\overline{M} \approx 650{,}000$

P-22

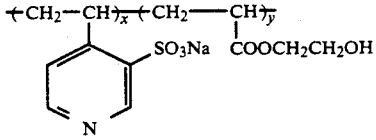

x:y = 80:20

$\overline{M} \approx 500{,}000$

P-23

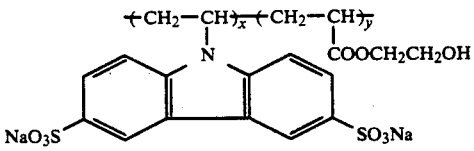

x:y = 75:25

$\overline{M} \approx 400{,}000$

P-24

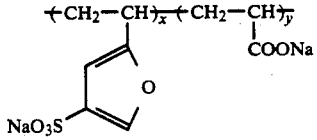

x:y = 80:20

$\overline{M} \approx 600{,}000$

-continued

P-25

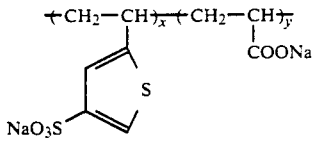

x:y = 90:10

$\overline{M} \approx 400{,}000$

P-26

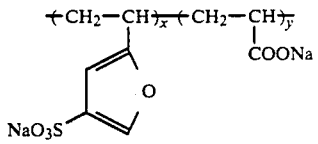

x:y = 55:45

$\overline{M} \approx 320{,}000$

P-27

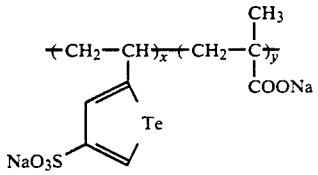

x:y = 90:10

$\overline{M} \approx 600{,}000$

P-28

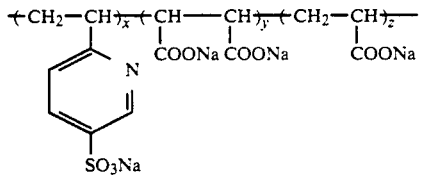

x:y:z = 80:10:10

$\overline{M} \approx 800{,}000$

P-29

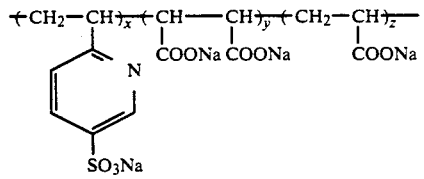

x:y = 70:30

$\overline{M} \approx 10{,}000$

P-30

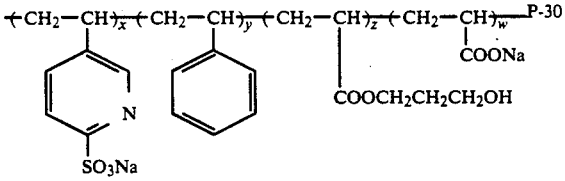

x:y:z:w = 60:30:8:2

$\overline{M} \approx 800{,}000$

P-31

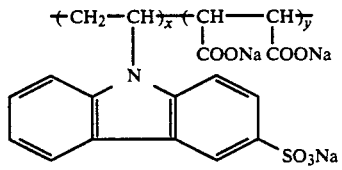

-continued x:y = 60:40

$\overline{M} \approx 30{,}000$

P-32

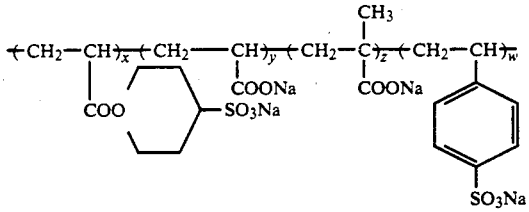

x:y:z:w = 40:30:20:10

$\overline{M} \approx 500{,}000$

P-33

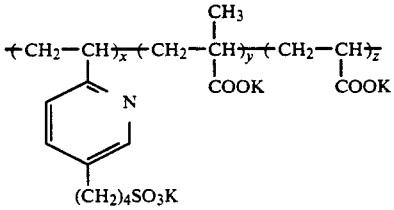

x:y:z = 60:30:10

$\overline{M} \approx 300{,}000$

P-34

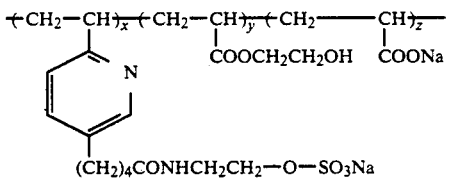

x:y:z = 40:30:30

$\overline{M} \approx 500{,}000$

P-35

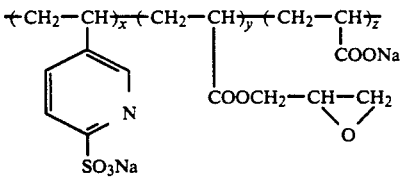

x:y:z = 55:35:10

$\overline{M} \approx 300{,}000$

P-36

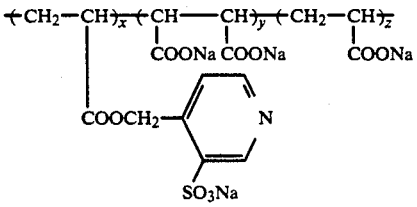

x:y:z = 50:30:20

$\overline{M} \approx 600{,}000$

-continued

P-37

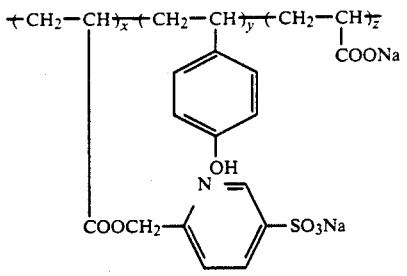

x:y:z = 60:30:10

$\overline{M} \approx 600,000$

In the preceding polymers P-1 to 37, x, y and z each represent the molar proportion (%) of the monomeric unit of each polymer, and $\overline{M}$ represents the number average molecular weight.

The most preferable polymer has a number average molecular weight of about 1,000 to 10,000,000.

The electroconductive polymer is contained in the antistatic layer or the electroconductive layer preferably in an amount of 0.001 to 10 g in terms of solid component, more preferably 0.05 to 5 g, per square meter of the light-sensitive material.

An explanation will be made on the hydrophobic polymer particles (2) of the invention.

The hydrophobic polymer particles are contained in the water-soluble electroconductive polymer layer in the form of a latex which is substantially insoluble in water. The hydrophobic polymer can be obtained by polymerization of monomers combinedly selected arbitrarily from styrene, a styrene derivative, alkyl acrylate, alkyl methacrylate, an olefin derivative, a halogenated ethylene derivative, an acrylamide derivative, a methacrylamide derivative, a vinyl ester derivative and acrylonitrile. The hydrophobic polymer preferably contain a styrene derivative, alkyl acrylate and alkyl methacrylate in an amount of at least 30 mol %, more preferably not less than 50 mol %.

A latex of the hydrophobic polymer can be obtained by subjecting monomers to emulsion polymerization or by a method in which the polymer in the solid state is dissolved in a low boiling point solvent to disperse it finely, followed by distillation off of the solvent. The former method is preferable since it can produce a latex consisting of smaller polymer particles of uniform size.

An anion or nonion surfactant is preferably employed in the emulsion polymerization. An excessive amount of a surfactant impairs the transparency of the electroconductive layer. The preferable amount is not more than 10 wt % relative to the weight of the monomers.

The average molecular weight of the hydrophobic polymer does not affect significantly the transparency of the electroconductive layer. A suitable number average molecular weight is not less than 3,000.

The examples of the hydrophobic polymer are given below:

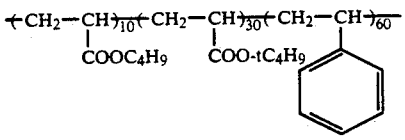

(L-1)

$\overline{M}$ = 100,000

-continued

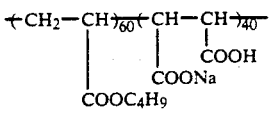

(L-2)

$\overline{M}$ = 200,000

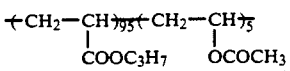

(L-3)

$\overline{M}$ = 300,000

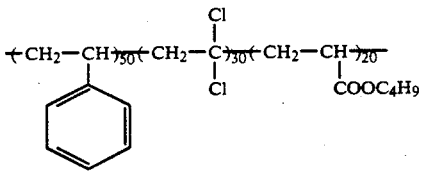

(L-4)

$\overline{M}$ = 200,000

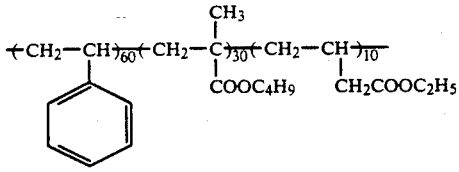

(L-5)

$\overline{M}$ = 300,000

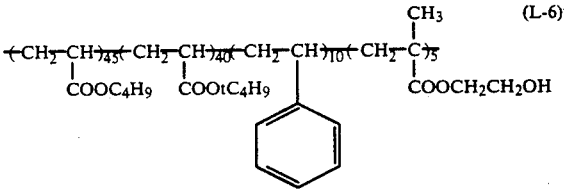

(L-6)

$\overline{M}$ = 500,000

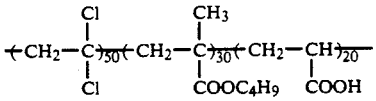

(L-7)

$\overline{M}$ = 200,000

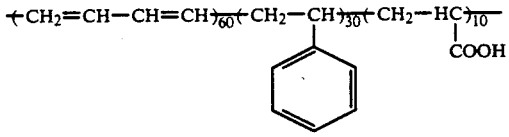

(L-8)

$\overline{M}$ = 600,000

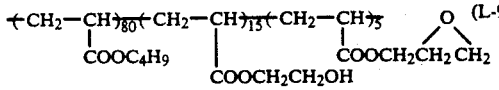

(L-9)

$\overline{M}$ = 150,000

This polymer can be obtained readily by polymerizing monomers which are commercially available or can be prepared by known methods.

The conductivity of the antistatic layer or the electroconductive layer as referred to herein means such a property as will make the specific resistance of the surface of the layer not more than $10^{10}\Omega/cm^2$ (23° C., 20% RH), provided that said layer is obtained by applying the polymer alone on a polyethylene terephthalate film in an amount of not less than 2 $g/m^2$.

It is preferred that the surface of the antistatic layer is activated by a corona discharge, a glow discharge, an UV light treatment or a flame treatment. Of these treatments, a corona discharge is most preferable. The energy intensity of a corona discharge is preferably 1 mw to 1 kw/m$^2$.min, more preferably 0.1 w to 1 w/m$^2$.min.

A coating liquid for the antistatic layer or the electroconductive layer, which is obtained by mixing the water soluble electroconductive polymer, the hydrophobic polymer particles and a hardener is applied on a subbed support or a hydrophilic layer. To increase the mechanical strength of the electroconductive layer, it is possible to set the cross-linking degree of these components to a certain level. To obtain the desired properties, care must be taken to the mixing ratio of the electroconductive polymer and the hydrophobic polymer particles, conditions under which the electroconductive layer is provided and dried, and the kind and amount of the hardener.

As the hardener which is employed for the electroconductive layer, use can be made of conventional hardeners for gelatin.

The examples of the hardener are given below.

EXAMPLE HARDENER

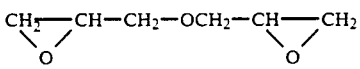
(A-1)

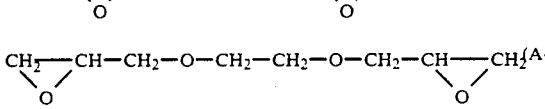
(A-2)

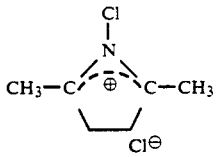
(A-3)

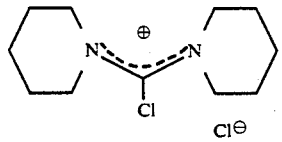
(A-4)

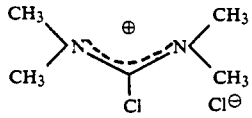
(A-5)

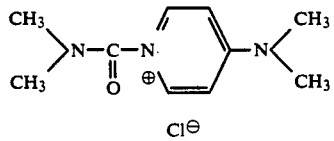
(A-6)

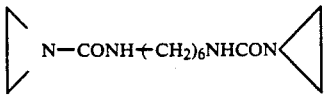
(A-7)

-continued

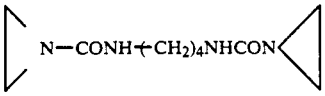
(A-8)

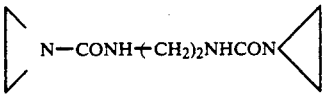
(A-9)

Aldehyde hardeners such as:

Formaldehyde (B-1)

Glyoxal (B-2)

Mucochloric acid (B-3)

$CH_2{=}CH{-}SO_2{-}CH_2{-}O{-}CH_2{-}SO_2{-}CH{=}CH_2$ (B-4)

$CH_2{=}CH{-}SO_2{-}CH_2CH_2CH_2SO_2{-}CH{=}CH_2$ (B-5)

$CH_2{=}CH{-}SO_2{-}CH_2CH(OH)CH_2{-}SO_2{-}CH{=}CH_2$ (B-6)

Silane coupling agents such as:

$H_2NCH_2CH_2NHCH_2CH_2CH_2Si(OCH_3)_3$ (C-1)

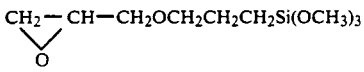
(C-2)

$CH_2{=}CH{-}Si(OCH_3)_3$ (C-3)

Other hardeners, (1) A block polymerized isocyanate type hardener
(2) A polyfunctional aziridine type hardener
(3) An α-cyanoacrylate type hardener
(4) An epoxy-type hardener containing triphenyl phosphine
(5) A bifunctional ethylene oxide type hardener. Hardening is done by irradiation with an electron beam or an X ray.
(6) An N-methylol type hardener
(7) A metal complex containing zinc or zirconium
(8) A silane coupling agent
(9) A carboxy-activated type hardener An explanation will be made on each of the preceding hardeners.

(1) As to the block polymerized isocyanate hardener 1, any type can be used as long as it releases isocyanate when heated. The preferable examples are given below:

1-1

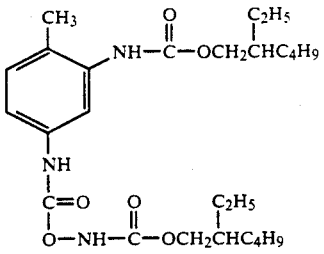

1-2

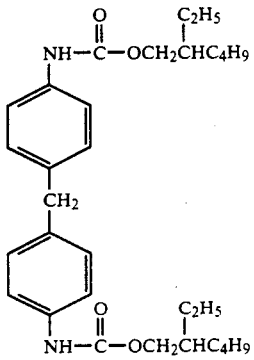

1-3

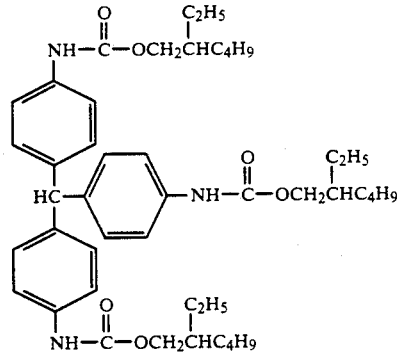

1-4

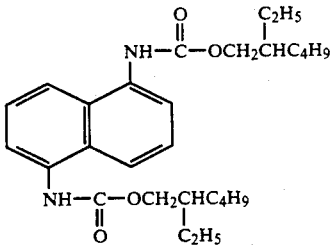

1-5

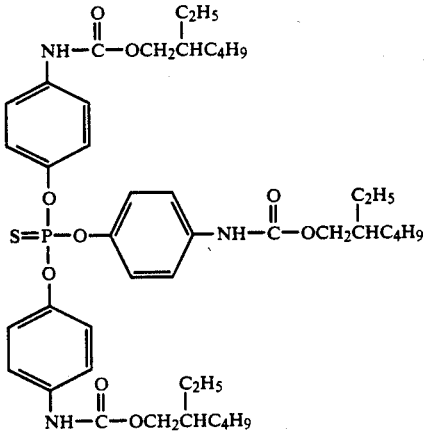

-continued 1-6

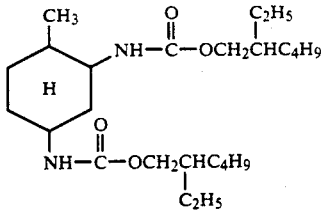

1-7

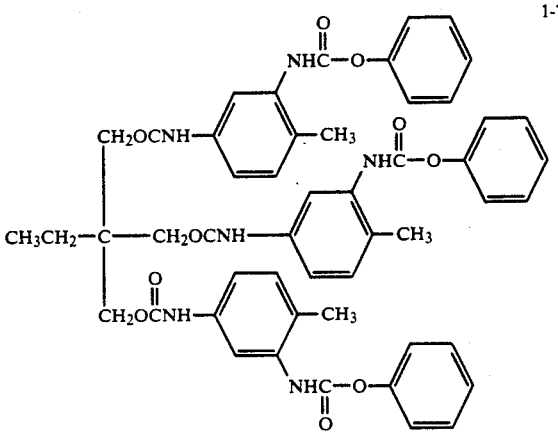

1-8

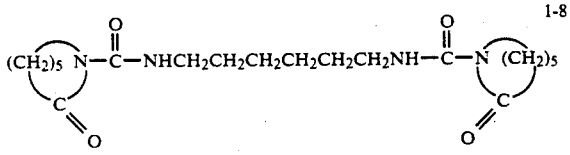

These compounds may be added in the form of a solution obtained by dissolving them in water or an organic solvent such as alcohol and acetone, or in the form of a dispersion obtained by dispersing them in the presence of a surfactant such as dodecylbenzene sulfonate and nonylphenoxyalkylene oxide. The preferable amount is 1 is 1000 mg/m$^2$.

(2) The polyfunctional aziridine hardener is represented by the following formula:

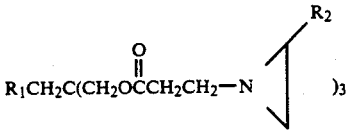

wherein $R_1$ represents a hydrogen atom, an alkyl or aryl group having 1 to 20 carbon atoms, a hydroxy group or a halogen atom; and $R_2$ represents a hydrogen atom, or an alkyl group having up to 10 carbon atoms.

The preferred examples are given below, though not limitative.

2-1

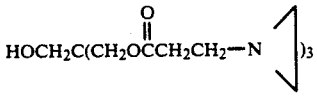

-continued 2-2

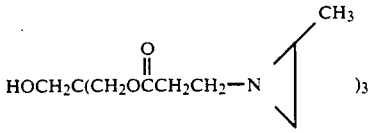

2-3

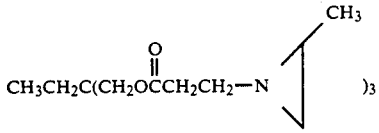

2-4

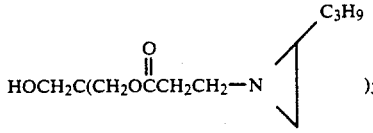

2-5

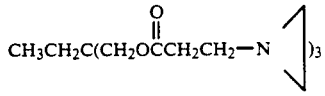

2-6

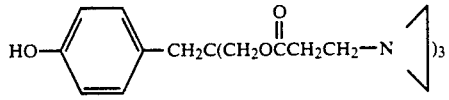

2-7

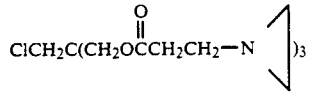

(3) An α-cyanoacrylate type compound is represented by the following formula:

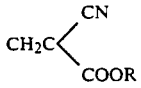

wherein R represents a substituted or unsubstituted alkyl group having 1 to 12 carbon atoms:

The preferred examples are given below, though not limitative.

3-1

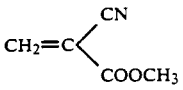

3-2

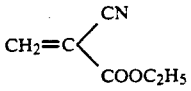

3-3

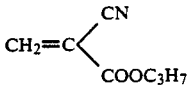

3-4

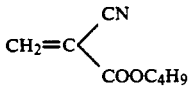

3-5

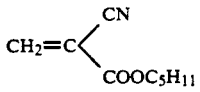

3-6

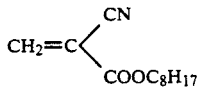

3-7

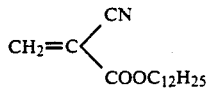

3-8

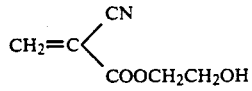

3-9

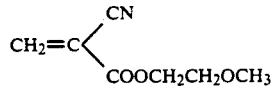

3-10

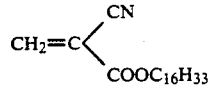

(4) The kind of a hardener of the invention containing an epoxy group is not limitative, but the preferred examples are as follows:

EXAMPLE COMPOUNDS 4-1

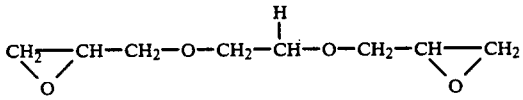

4-2

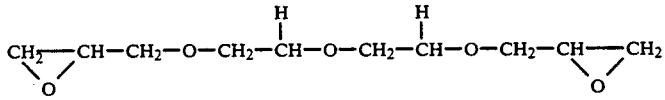

4-3

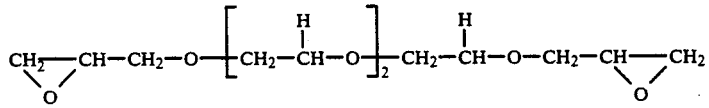

4-4

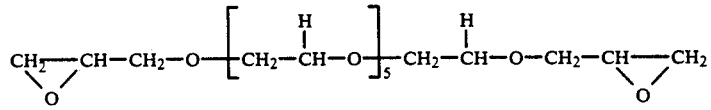

-continued
4-5
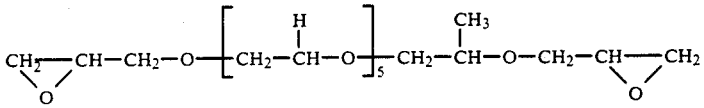
4-6
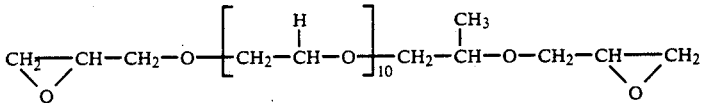
4-7
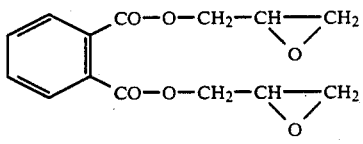
4-8
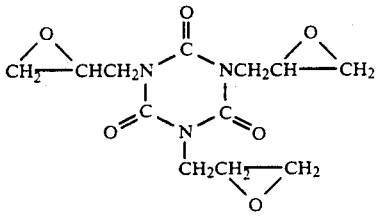
4-9
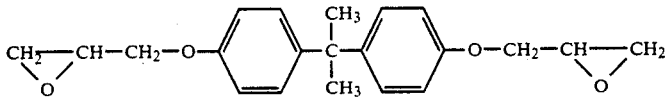
4-10
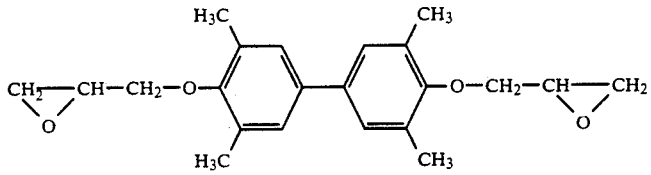
4-11
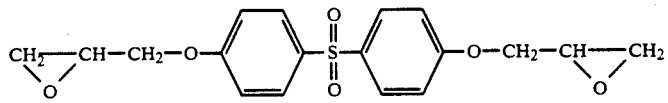
4-12
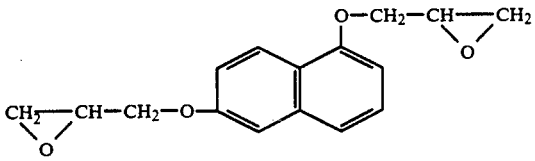
4-13
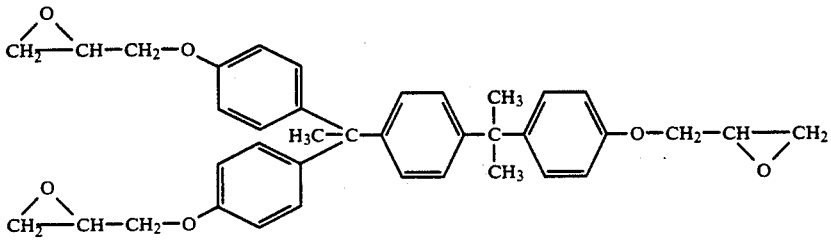

-continued 4-14

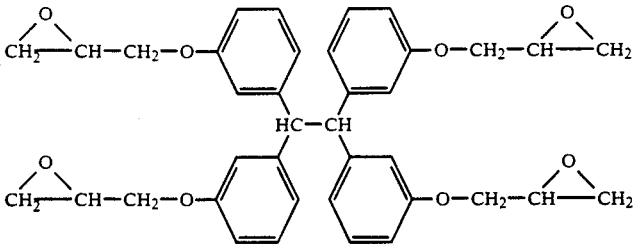

4-15

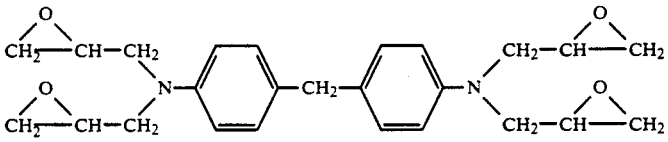

4-16

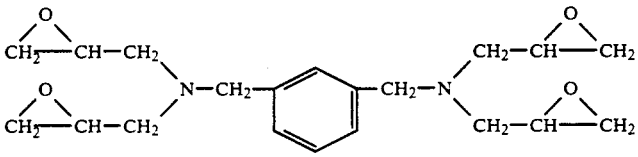

4-17

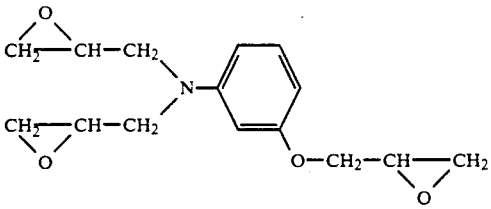

4-18

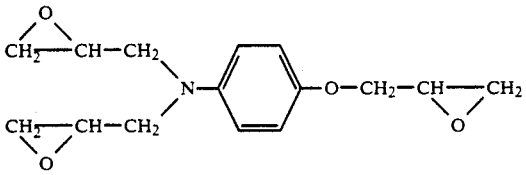

Virtually all of these compounds are commercially available. They are added in the form of a solution obtained by dissolving them in water or an organic solvent such as alcohol and acetone, or added in the form of a dispersion obtained by dispersing them in the presence of a surfactant such as dodecylbenzene sulfonate and nonylphenoxyalkylene oxide. The preferred amount is 1 to 1000 mg/m$^2$.

The effects can be made more satisfactory when triphenyl phosphine represented by the following formula is used in combination with the preceding cross-linking agent.

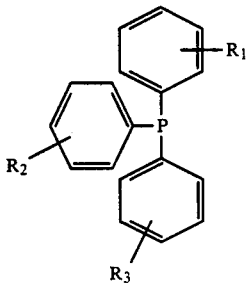

wherein $R_1$ to $R_3$ each represent a substituted or unsubstituted alkyl group, a hydrogen atom, a halogen atom, a nitro group, a cyano group, a hydroxy group or an alkoxy group.

The kind of triphenyl phosphine is not limitative, but the preferred examples are as follows:

4a-1

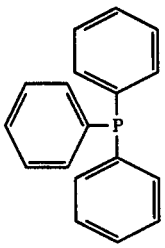

-continued 4a-2

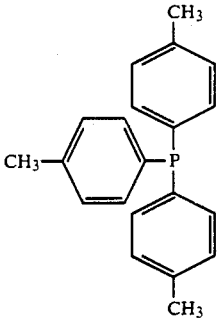

4a-3

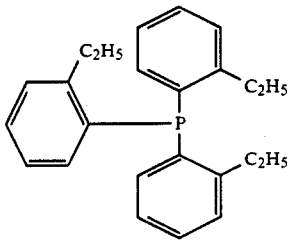

-continued 4a-5

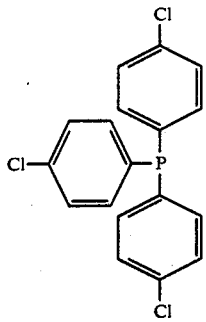

(5) The bifunctional ethylene oxide type compound is represented by the following formula:

$$CH_2{=}CH{-}L{-}CH{=}CH_2.$$

wherein L represents a substituted or unsubstituted alkylene oxide chain group.

The preferred examples are given below, though not limitative.

4a-4

EXAMPLE COMPOUNDS 5-1

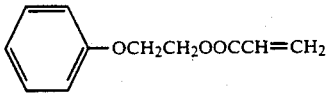

5-2

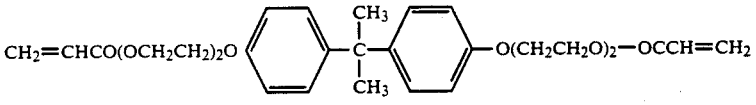

5-3 $CH_2{=}CHCO(OCH_2CH_2)_4OOCCH{=}CH_2$ 5-4 $CH_2{=}CHCO(OCH_2CH_2)_9OOCCH{=}CH_2$ 5-5 $CH_3CH_2C{-}(CH_2OOCCH{=}CH_2)_3$ 5-6 $CH_3CH_2C{-}(CH_2OCH_2CH_2OOCCH{=}CH_2)_3$ 5-7 $CH_2{=}C(CH_3)CO(OCH_2CH_2)_{23}OOC(CH_3)C{=}CH_2$ 5-8

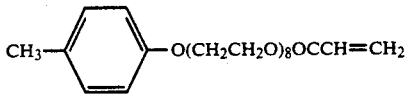

5-9 $CH_2{=}CHCOO(CH_2CH_2O)_3(CH_2CH(CH_3)O)_2{-}(CH_2CH_2O)_4OCCH{=}CH_2$ 5-10 $CH_3CH_2{-}(CH_2OOCC(CH_3){=}CH_2)_3$

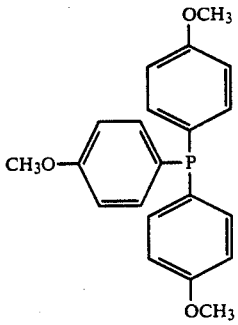

Bifunctional ethylene oxide type compounds are conventionally hardened by cross-linking with heating. This method is defective since reaction rate is too low and it cannot attain a sufficient cross linkage. In the invention, these compounds are hardened by irradiating them with an electron beam or an X-ray.

The intensities of an electron beam and an X-ray are as follows:

Intensity of an Electron Beam $10^{-2}$–$10^{6}$ KW/m$^2$ (50 KW/m$^2$ is especially preferred)

Intensity of an X-ray $10^{-2}$–$10^{6}$ KW/m$^2$ (300 KW/m$^2$ is especially preferred)

(6) The examples of the N-methylol type compound are given below, though not limitative.

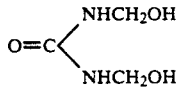
6-1

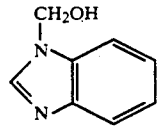
6-2

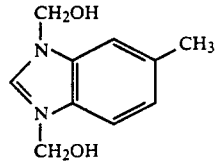
6-3

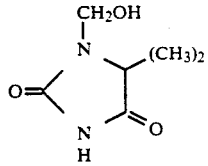
6-4

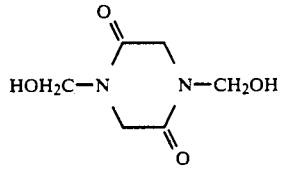
6-5

(7) The examples of the metal complex containing zinc and zirconium are given below, though not limitative.

$Zn(NH_3)_4(CH_3COO)_2$ 7-1

$Zn(NH_3)_4CO_3$ 7-2

$(NH_4)_3ZnOH(CO_3)_3$ 7-3

It is preferable to employ the preceding metal complex in an amount of $10^{-3}$ to $10^{3}$ mol per mol electroconductive polymer.

Conventionally, organic cross linking agents were widely employed, but the use of the metal complex of the present invention has enabled cross linkage to be attained more sufficiently.

(8) The following silane coupling agents are also usable in the invention as the hardener.

$H_2NCH_2CH_2NHCH_2CH_2CH_2Si(OCH_3)_3$ 8-1

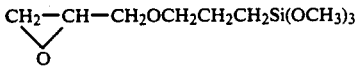
8-1

-continued $CH_2{=}CH{-}Si(OCH_3)_3$ 8-3

(9) In the invention, a carboxy group-activated hardener is also usable. The examples include the following carboxyimido type hardeners:

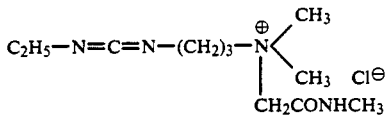
9-1

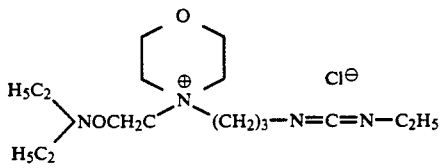
9-2

In a preferred embodiment of the invention, an antistatic layer is provided on a subbed polyethylene terephthalate support.

This antistatic layer may contain an antistatic agent such as a known surfactant (e.g., surfactants described in Japanese Patent O.P.I. Publication Nos. 21922/1978, 208743/1983, 74554/1984, 80839/1985 and 94126/1985) or an inorganic compound (e.g., NaCl, LiCl, $KNO_3$) and a metal oxide (e.g., a metal oxide described in Japanese Patent O.P.I. Publication Nos. 23848/1985, 62649/1983 and 118242/1982).

On the antistatic layer, a hydrophilic colloid layer such as a silver halide emulsion layer, an anti-halation layer, an intermediate layer and a backing layer is provided as the 1st layer. The 1st layer is preferably a silver halide light-sensitive emulsion layer or a backing layer.

On the 1st layer, the electroconductive layer consisting of Components (1), (2) and (3) may be provided as the 2nd layer. Further, a protective layer, an intermediate layer, a silver halide emulsion layer, a filter layer, a development controlling layer, an antistatic layer or a UV absorbing layer may be provided thereon as the 3rd layer.

It is preferred that the 3rd layer be a protective layer or a silver halide emulsion layer which substantially does not have light sensitivity.

Generally, a light-sensitive material consists of the preceding three layers. However, in the present invention, the antistatic property of a light-sensitive material is significantly improved by the provision of the 4th layer at the outermost surface. Like the 2nd layer, the 4th layer is the electroconductive layer which consists of the preceding Components (1), (2) and (3) as the antistatic layer.

The hydrophilic colloid layer as referred to herein means a layer being hydrophilic and containing a binder such as gelatin, which is ordinary provided in a silver halide light-sensitive material, and the examples of which include a silver halide emulsion layer, a protective layer, an intermediate layer, an anti-halation layer, a filter layer, a development controlling layer, a UV absorbing layer, a subbing layer and a backing layer.

In the present invention, it is preferred that the kind and mixing ratio of the water soluble electroconductive polymer (1) and the hydrophobic polymer particles (2), the kind and amount of the hardener which is used as a cross-linking agent, and drying conditions be optimized.

The degree of cross-linking in the antistatic layer or the electroconductive layer provided by the hardener can be known from the degree of swelling. The degree of swelling can be obtained by immersing the sample prepared in accordance with the present invention in pure water at 25° C. for 60 minutes and then rating the film thickness in comparison with the dry film thickness using an electron microscope equipped with an adapter permitting underwater measurement of the thickness of the swollen film. This calculation is achieved using the following equation:

Degree of swelling = thickness of film swollen due to immersion/dry film thickness.

It is possible to determine the degree of swelling indirectly by calculating the amount of absorbed water from the weight of a given area of sample and the weight of the swollen sample, calculating the volume increased by this water and calculating the film thickness from the specific gravity. The degree of swelling is preferably 0.2 to 100%, more preferably 2 to 50%.

The thickness of the antistatic or electroconductive layer is closely related to its electroconductivity, and the electroconductive property improves as the unit volume increases. It is therefore better to increase the film thickness, but film flexibility is degraded at the same time. Good results are obtained with a film thickness of the layer between 0.1 and 100μ, preferably between 0.1 and 10μ.

The silver halide photographic light-sensitive emulsion of the present invention may comprise any silver halide such as silver iodobromide, silver iodochloride or silver iodochlorobromide, but silver iodobromide is preferred, since it offers high sensitivity.

The silver halide grains present in the photographic emulsion may be completely isotropically grown grains such as cubic, octahedral or tetradecahedal grains, multiplane crystalline grains such as spherical grains, grains comprising twins involving a plane defect, their mixtures or their complexes. These silver halide grains may range from fine grains having a diameter of not more than 0.1 μm to large grains having a diameter of up to 20 μm.

A preferred mode of embodiment of the present invention is a monodispersible emulsion wherein silver iodobromide is localized inside the grains. Here, a monodispersible emulsion is defined as an emulsion comprising silver halide grains wherein at least 95% by grain number or weight of the grains fall in the range of ±40%, preferably ±30%, of the average grain size, as measured by a standard method. The grain size distribution of the silver halide may be monodispersible with a narrow distribution or polydispersible with a wide distribution.

The crystalline structure of the silver halide may be such that the inside and outside silver halide compositions differ from each other. A preferred mode of the emulsion of the present invention is a core/shell type monodispersible emulsion having a distinct double layer structure comprising a core with a higher iodide content and a shell layer having a lower iodide content.

The silver iodide content of the high iodide content portion of the invention is 20 to 40 mol %, preferably 20 to 30 mol %.

Such a monodispersible emulsion can be produced by known methods, including those described in J. Phot. Sci. 12, 242-251 (1963), Japanese Patent Publication Open to Public Inspection Nos. 36890/1973, 16364/1977, 142329/1980 and 49938/1983, British Patent No. 1,413,748, and U.S. Pat. Nos. 3,574,628 and 3,655,394.

The monodispersible emulsion described above is preferably an emulsion prepared by growing grains by supplying silver ion and halide ion to a seed crystal as the growth nucleus. Methods of obtaining a core/shell emulsion are described in detail in British Patent No. 1,027,146, U.S. Pat. Nos. 3,505,068 and 4,444,877 and Japanese Patent Publication Open to Public Inspection No. 14331/1985, for instance.

The silver halide emulsion used for the present invention may comprise tabular grains having an aspect ratio of not less than 5.

Such tabular grains are advantageous in that they offer increase in spectral sensitization efficiency, improvement in image graininess and sharpness and other favorable aspects, and can be prepared by the methods described in British Patent No. 2,112,157 and U.S. Pat. Nos. 4,439,520, 4,433,048, 4,414,310 and 4,434,226, for instance.

Examples of light-sensitive silver halide grains for the silver halide photographic light-sensitive material of the present invention include monodispersible light-sensitive silver halide grains having an inside silver halide content of not less than 8 mol %, preferably 8 to 40 mol %, an overall silver iodide content of not more than 3.5 mol %, preferably 0.8 to 3.0 mol %, and a silver bromide content of not less than 90%, preferably 90 to 97%.

Examples of the light-sensitive silver halide emulsion for the silver halide photographic light-sensitive material of the present invention include light-sensitive silver halide emulsions having a silver iodide content of not more than 4.0 mol %, preferably 0.1 to 3.5 mol % and a silver bromide content of not less than 90%, preferably 90 to 99% and containing tabular grains having a grain diameter to thickness ratio between 4.0 and 30, preferably 5.0 to 20, in a ratio of not less than 50%, preferably 40 to 90%.

The polyhydric alcohol having a molecular weight of not more than 150 used in a silver halide emulsion layer has at least two hydroxyl groups in its molecular structure and a melting point above 40° C.

The polyhydric alcohol may be present in any layer, but it is preferable to be contained in a silver halide emulsion layer or an adjacent hydrophilic colloidal layer, more preferably to a light-sensitive silver halide emulsion layer. Although the polyhydric alcohol content is not subject to limitation, it is preferably in the range of from 0.1 to 2.0 g, more preferably 0.2 to 1.0 g, per $m^2$ of one support face.

Any timing of addition is acceptable, but it is preferable to add the polyhydric alcohol at a time point between completion of chemical sensitization and initiation of the coating process. Concerning the method of addition, the polyhydric alcohol may be dispersed directly in the hydrophilic colloid, or may be added after being dissolved in an organic solvent such as methanol or acetone.

The polyhydric alcohol for the present invention may be such that 2 to 6 hydroxyl groups and 2 to 8 carbon atoms are present in its molecular structure and the hydroxyl groups are not conjugated via a conjugation chain, i.e., no oxidized form is present, with preference given to an alcohol compound having a total molecular weight of not more than 150, more preferably not less than 100 and not more than 150, and a melting point between 40° C. and 300° C.

Examples of polyhydric alcohols which serve well in the embodiment of the present invention are given below, but these are not to be construed as limitative.

1-1 Diethylene glycol
1-2 Glycerol
1-3 Triethylene glycol
1-4 2,3,3,4-tetramethyl-2,4-pentanediol
1-5 2,2-dimethyl-1,3-propanediol
1-6 2,2-dimethyl-1,3-pentanediol
1-7 2,2,4-trimethyl-1,3-pentanediol
1-8 2,5-hexanediol
1-9 2,5-dimethyl-2,5-hexanediol
1-10 1,6-hexanediol
1-11 1,10-decanediol
1-12 1,12-octadecanediol
1-13 1,18-octadecanediol
1-14 cis-2,5-dimethyl-3-hexane-2,5-diol
1-15 1,13-tridecanediol
1-16 Pentamethyl glycerol
1-17 2-butene-1,4-diol
1-18 2,5-dimethyl-3-hexyne-2,5-diol
1-19 2,4-hexadiyne-1,6-diol
1-20 2,6-ocatadiyne-1,8-diol
1-21 2-methyl-2,3,4-butanetriol
1-22 2,3,4-hexanetriol
1-23 2,2-dihydroxymethyl-1-butanol
1-24 Erythritol
1-25 2,5-dimethyl-2,3,4,5-hexanetetrol
1-26 1,2,5,6-hexanetetrol
1-27 1,3,4,5-hexanetetrol
1-28 1,6-(erythro-3,4)-hexanetetrol
1-29 2,2-dihydroxymethyl-1-butanol The antistatic layer or an adjacent hydrophilic colloidal layer for the silver halide photographic light-sensitive material of the present invention may incorporate a plasticizer for the purpose of providing plasticity.

Any plasticizer can be used, as long as it exhibits plasticizing action, but it is preferable to use a polyalkylene oxide compound.

The polyalkylene oxide compound used for the present invention means a compound having at least two and at most 500 polyalkylene oxide chains in its molecular structure. It can be synthesized by condensation of polyalkylene oxide with a compound having an active hydrogen atom such as an aliphatic alcohol, a phenol, a fatty acid, an aliphatic mercaptane or an organic amine, or condensation of a polyol such as polypropylene glycol or a polyoxytetramethylene polymer with an aliphatic mercaptane, an organic amine, ethylene oxide or propylene oxide.

The polyalkylene oxide compound described above may be a block copolymer having in its molecular structure not a single polyalkylene oxide chain but two or more divided chains. In this case, it is preferable that the total degree of polymerization of the polyalkylene oxide be not less than 3 and not more than 100.

Examples of the polyalkylene oxide compound described above which can be arbitrarily used for the present invention are given below.

EXAMPLES COMPOUNDS

[AO-1] $HO(CH_2CH_2O)_nH$ [n=4]
[AO-2] $HO(CH_2CH_2O)_nH$ [n=35]
[AO-3] $HO(CH_2CH_2O)_nH$ [n=135]
[AO-4] $HO(CH_2CH_2O)_nH$ [n=225]
[AO-5] $HO(CH_2CH_2O)_nH$ [n=450]
[AO-6] $n\text{-}C_4H_9O(CH_2CH_2O)_nH$ [n=20]
[AO-7] $n\text{-}C_8H_{17}O(CH_2CH_2O)_nH$ [n=30]
[AO-8] $n\text{-}C_{12}H_{25}O(CH_2CH_2O)_nH$ [n=30]
[AO-9] $n\text{-}C_9H_{19}$

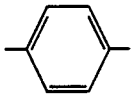

$O(CH_2CH_2O)_nH$ [n=30]
[AO-10] $n\text{-}C_{12}H_{25}S(CH_2CH_2O)_nH$ [n=30]
[AO-11] $C_4H_9S(CH_2CH_2O)_nCOCH_2CH_2COOH$ [n=50]

When using these compounds for the present invention, they may be added to a liquid for preparation of layer, comprising a reaction product of (1) a water-soluble electroconductive polymer, (2) hydrophobic polymer grains and (3) a hardener, after being dissolved in a hydrophilic solvent such as methanol, ethanol or Methyl Cellosolve. They may also be added to such a layer coated adjacent to this antistatic layer, such as a gelatin layer or a silver halide emulsion layer.

Although the amount of addition varies depending on the type of the compound, it is preferable to add the compound in a ratio of 0.01 to 0.5 g, more preferably 0.03 to 0.3 g, per unit $m^2$ as solid content.

To make the effects of the invention more satisfactorily, a metal oxide may be added to the component layers of the light-sensitive material. The examples of the metal oxide used in the electroconductive layer include indium oxide, tin oxide, a metal oxide doped with an antimony or phosphor atom, and a combination thereof.

The examples of indium oxide include $In_2O$ and $In_2O_3$. In the invention, $In_2O_3$ is preferable.

The examples of tin oxide include stannous oxide (SnO) and stannic oxide ($SnO_2$).

The examples of a metal oxide doped with an antimony atom or a phosphor atom include tin oxide and indium oxide. These metal oxides can be doped with antimony or phosphor by mixing a halide, an alkoxy compound or a nitrate compound of tin or indium with a halide, an alkoxy compound or a nitrate compound of antimony or phosphor, followed by oxidation and calcination. These metal oxides can be procured readily. The amount of antimony or photophore is preferably 0.5 to 10 wt % relative to the weight of tin or indium. It is preferred that these inorganic compounds be added in the form of a dispersion obtained by dispersing them in a hydrophilic colloid such as gelatin or a polymeric compound such as acrylic acid or maleic acid, and in an amount of 1 to 100 wt % relative to the weight of a binder.

The dyes used for the present invention are a combination of a dye having an absorption maximum wavelength between 400 and 510 nm, preferably between 430 and 480 nm, another dye having an absorption maximum wavelength between 520 and 560 nm, preferably between 530 and 555 nm, and still another dye having an absorption maximum wavelength between 570 and 700 nm, preferably between 580 and 650 nm.

Here, the absorption maximum wavelength of a dye of the present invention is obtained while the dye is present in the light-sensitive material.

For the present invention, dyes having a given absorption maximum wavelength are selected out of the group comprising anthraquinone dyes, azo dyes, azomethine dyes, indoaniline dyes, oxonol dyes, carbocyanine dyes, styryl dyes, triphenylmethane dyes, pyrazolidone dyes, pyrazoloazoleazomethie dyes and other dyes. It is preferable to select fast dyes not subject to discoloration, leakage or tone change due to development, fixation or washing, or fading due to light exposure. Particularly, in the case of a film for X-ray radiography, it is desirable to use highly light-fast dyes, since the film is sometimes exposed to high luminance viewer for a long time.

In view of the stability to developing process, light fastness and the effects on photographic properties such as desensitization, fogging and staining, appropriate dyes are selected out of the group comprising anthraquinone dyes, azo dyes, azomethine dyes and indoaniline dyes.

The hydrophobic dyes having an absorption maximum wavelength of 400 to 700 nm used for the present invention are described below.

The yellow dye having an absorption maximum wavelength of 400 to 510 nm used for the present invention is a compound represented by the following formula [C-I], [C-II] or [C-III].

Formula [C-I]

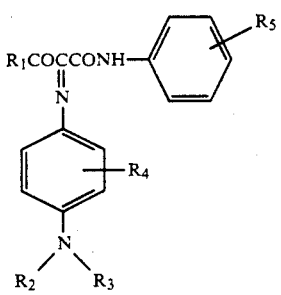

wherein $R_1$ represents an alkyl group or an aryl group; $R_2$ and $R_3$ independently represent an alkyl group; $R_4$ represents an alkyl group or an alkoxy group; $R_5$ represents a halogen atom, an alkyl group, an alkoxy group, an acylamino group or a sulfonamido group.

Formula [C-II]

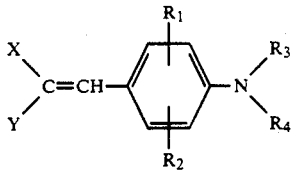

wherein $R_1$ and $R_2$, whether identical or not, independently represent a hydrogen atom, a halogen atom, an alkyl group, an alkoxy group, a hydroxy group, a carboxy group, a substituted amino group, a carbamoyl group, a sulfamoyl group, a nitro group or an alkoxycarbonyl group.

$R_3$ and $R_4$, whether identical or not, independently represent a hydrogen atom, a substituted or unsubstituted alkyl group, a substituted or unsubstituted alkenyl group, a substituted or unsubstituted aryl group, an acyl group or a sulfonyl group, and $R_3$ and $R_4$ may bind to each other to form a 5- or 6-membered ring.

X and Y independently represent an electron-attracting group, whether identical or not.

Formula [C-III]

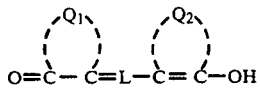

wherein $Q_1$ and $Q_2$ independently represent a group necessary for the formation of a heterocyclic ring; L represents a methine group.

It is preferable that the heterocyclic ring formed by the group of nonmetallic atoms represented by $Q_1$ and $Q_2$ be a 5- or 6-membered ring, whether a single ring or condensed ring. Examples of such heterocyclic rings include a 5-pyrazolone ring, barbituric acid, isooxazolone, thiobarbituric acid, rhodanine, imidazopyridine, pyrazolopyrimidine and pyrrolidone.

Examples of compounds represented by formulas [C-I], C-II] and C-III] are given below, but the invention is not by any means limited thereby.

C-1

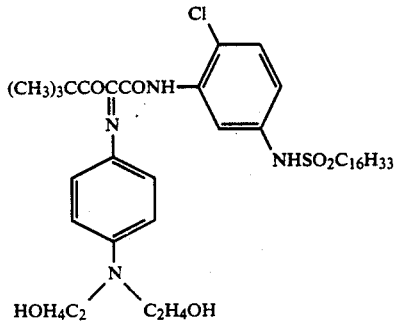

-continued
C-2
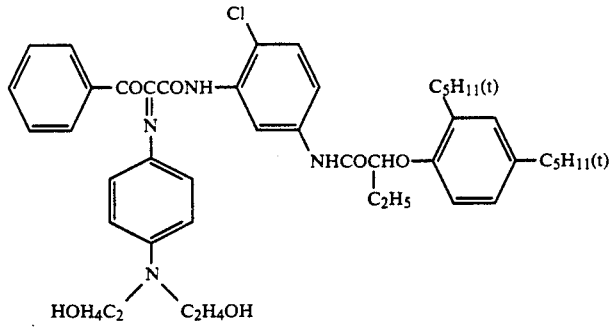
C-3
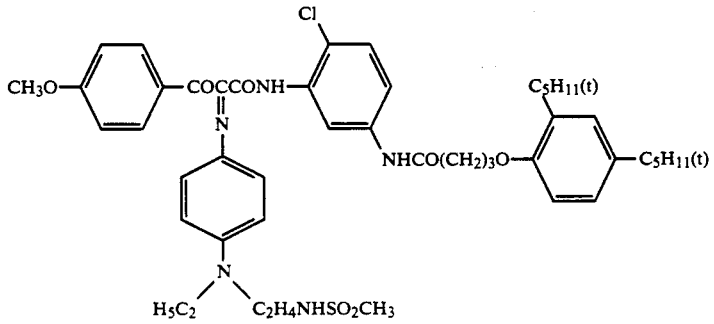
C-4
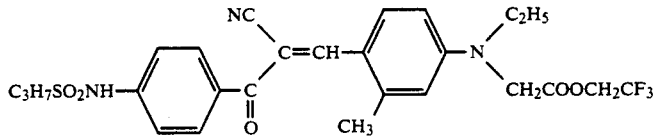
C-5
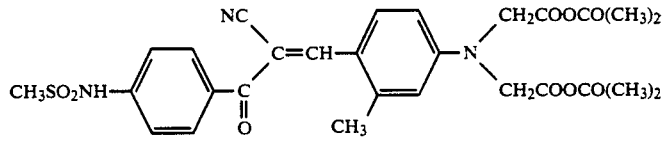
C-6
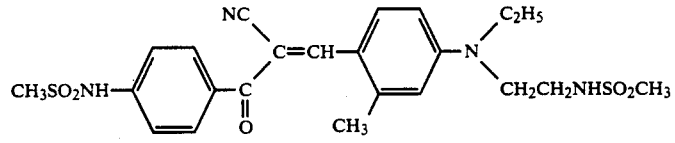
C-7
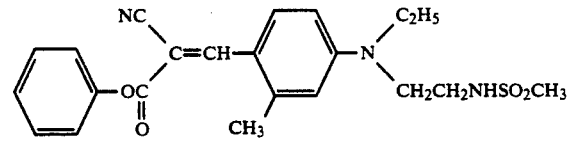
C-8
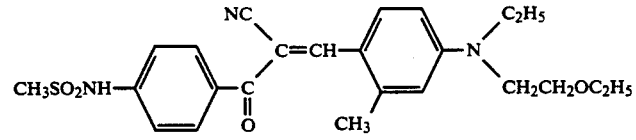
C-9
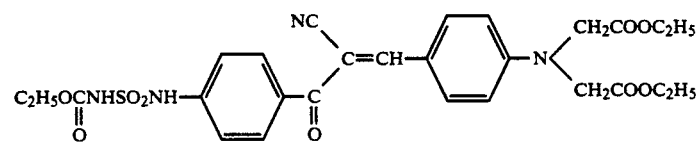

-continued

C-10

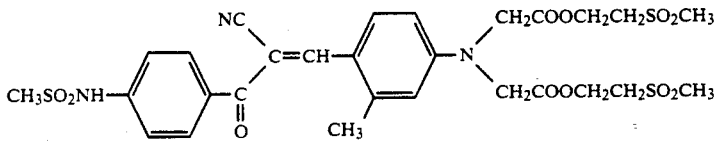

C-11

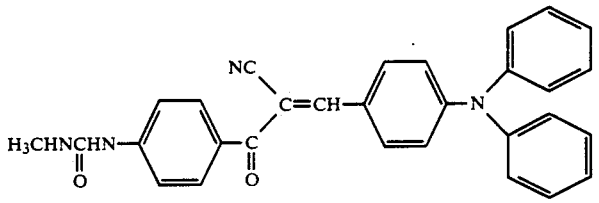

C-12

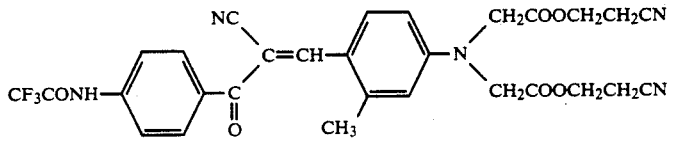

C-13

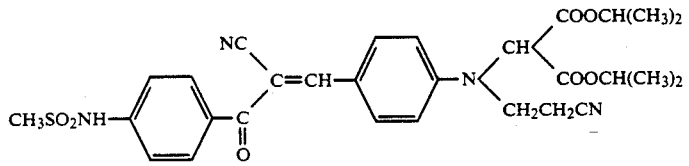

C-14

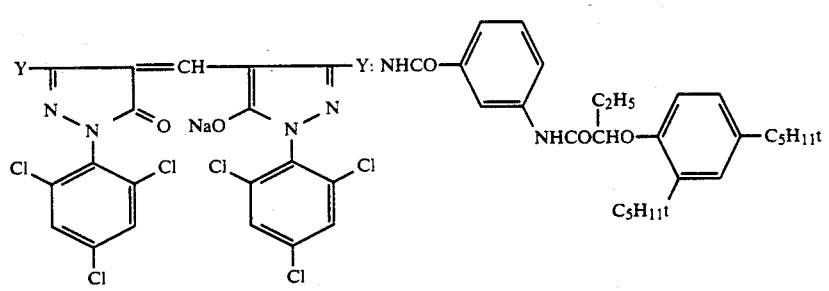

C-15

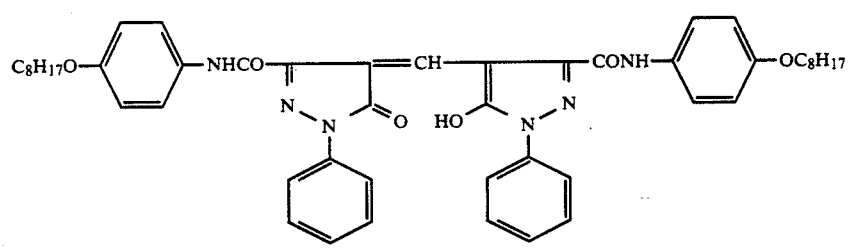

The magenta dye having an absorption maximum wavelength of 520 to 560 nm used for the present invention is a compound represented by the following formula [A-I], [A-II] or [A-III].

Formula [A-I]

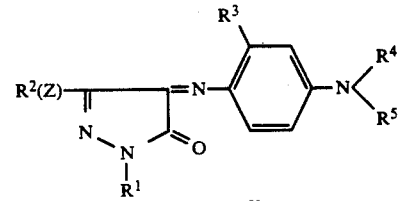

wherein $R^1$ and $R^2$, whether identical or not, independently represent a substituted or unsubstituted aryl group, a substituted or unsubstituted alkyl group or a substituted or unsubstituted heterocyclic group; $R^3$ represents a hydrogen atom, a halogen atom, an alkyl group or an alkoxy group; $R^4$ and $R^5$, whether identical or not, independently represent a substituted or unsubstituted alkyl group, and $R^4$ and $R^5$ may bind to each other to form a ring.

Z represents —NHCO—, —NH—, —NHCONH—, —COO—, —O— or —CONH—. n represents 0 or 1.

The alkyl group represented by $R^1$ or $R^2$ is a linear or branched alkyl group having a carbon number of 1 to 20, which may have a substituent such as a halogen atom, an alkoxy group, an aryloxy group, an alkoxycarbonyl group, an aryloxycarbonyl group, a hydroxyl group, an acylamino group, a carbamoyl group, a sulfamoyl group or a cyano group.

The aryl group represented by $R^1$ or $R^2$ (e.g., a phenyl group, an α- or β-naphthyl group) may have 1 or more substituents (e.g., an alkyl group, an alkoxy group, an aryloxy group, a halogen atom, an alkoxycarbonyl group, an acylamino group, a carbamoyl group, an alkylcarbamoyl group, an arylcarbamoyl group, an alkylsulfonamido group, an arylsulfonamido group, a sulfamoyl group, an alkylsulfamoyl group, a cyano group and a nitro group).

The heterocyclic group represented by $R^1$ or $R_2$ (e.g., a pyridyl group, a quinolyl group, a furyl group, a benzothiazolyl group, an oxazolyl group and an imidazolyl group) may have a substituent listed above for the aryl group.

The group for $R^1$ is preferably a phenyl group wherein at least one ortho position is substituted by an alkyl group, a halogen atom, an alkoxy group or the like.

The alkyl group represented by $R^3$ has the same definition as the alkyl group represented by $R^1$ or $R^2$ having a carbon number of 1 to 20 described above.

The alkyl group represented by $R^4$ or $R^5$ is preferably an alkyl group having a carbon number of 1 to 6 (e.g., a methyl group, an ethyl group, an n-butyl group, an isopropyl group, an n-hexyl group) or a substituted alkyl group having a total carbon number of 2 to 10 carbon atoms (examples of the substituent include a hydroxyl group, a sulfonamido group, a sulfamoyl group, an alkoxy group, a halogen atom, an acylamino group, a carbamoyl group, an ester group and a cyano group).

Examples of the ring formed by $R^4$ and $R^5$ in cooperation include a piperidine ring, a pyrrolidine ring and a morpholine ring.

Formula [A-II]

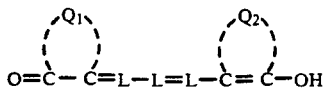

wherein $Q_1$ and $Q_2$ independently represent a group necessary for the formation of a heterocyclic ring; L represents a methine group. The heterocyclic ring represented by $Q_1$ and $Q_2$ has the same definition as of formula [C-III] above.

Formula [A-III]

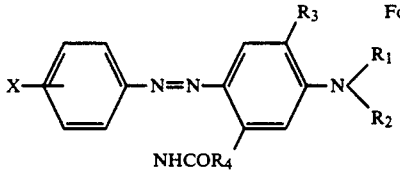

wherein $R_1$ and $R_2$ independently represent an alkyl group which may have a substituent; $R_3$ represents a hydrogen atom, an alkyl group which may have a substituent, or an alkoxy group. $R_4$ represents an alkyl group which may have a substituent or an aryl group; X represents a hydrogen atom, a halogen atom, a cyano group, a nitro group or $SO_2R_5$; $R_5$ represents an alkyl group.

Examples of compounds represented by formulas [A-I], [A-II] and [A-III] are given below, but the invention is not by any means limited thereby.

A-1

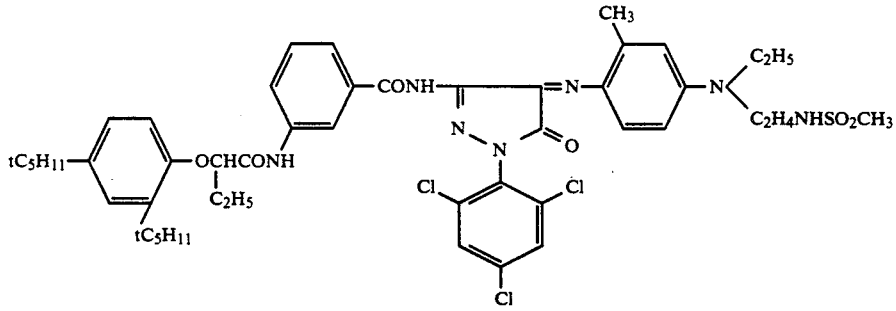

A-2

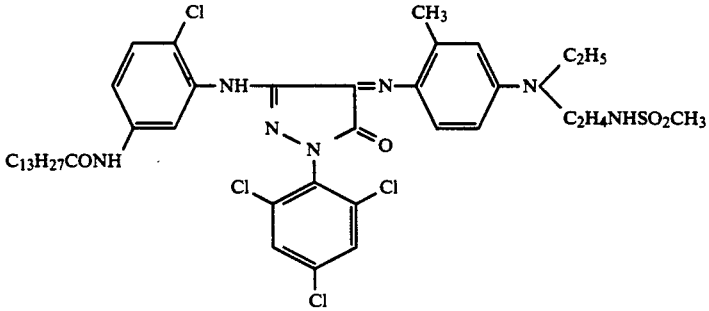

-continued
A-3
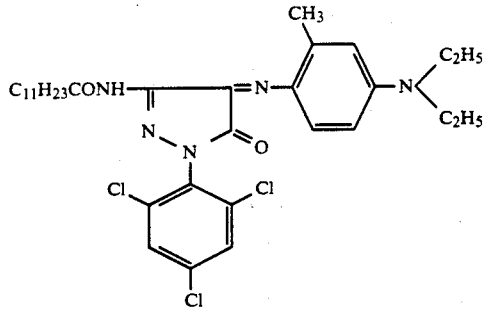
A-4
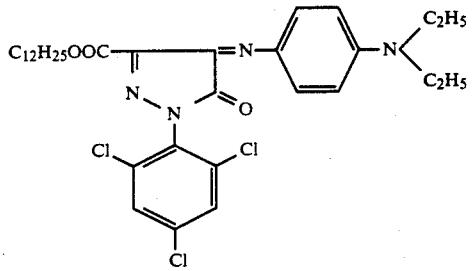
A-5
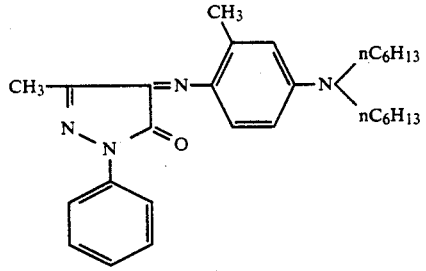
A-6
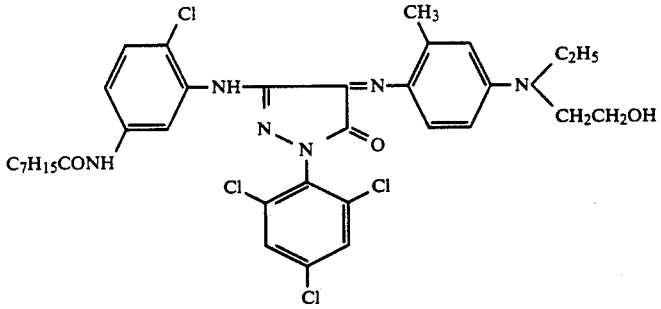
A-7
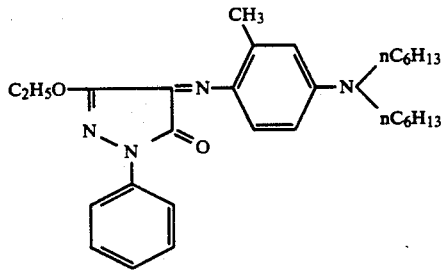

-continued
A-8
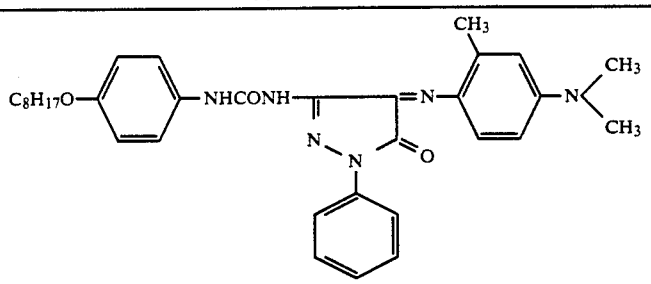
A-9
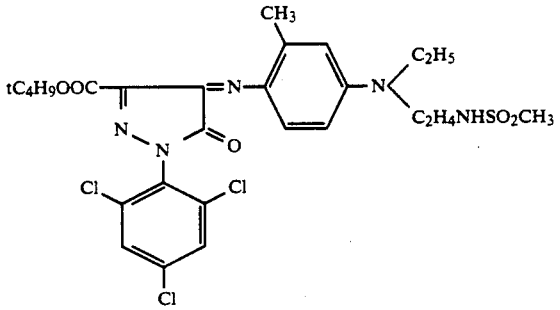
A-10
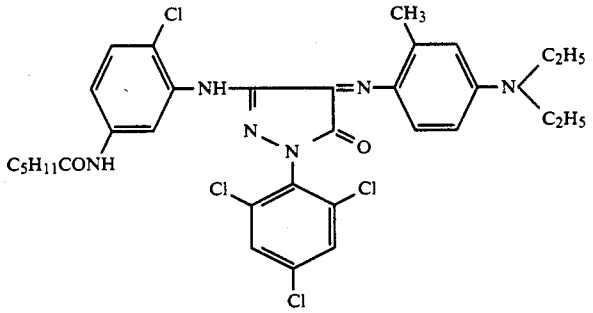
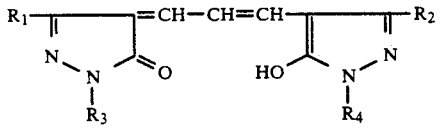
| | $R_1$ | $R_3$ | $R_4$ | $R_2$ |
|---|---|---|---|---|
| A-11 | $C_5H_{11}$ | $C_6H_{13}$ | $C_6H_{13}$ | $C_5H_{11}$ |
| A-12 | 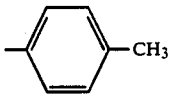 | $C_8H_{17}$ | $C_8H_{17}$ | 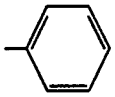 |
| A-13 | t-$C_4H_9$ | $C_7H_{15}$ | $C_7H_{15}$ | $C_3H_7$ |
A-14
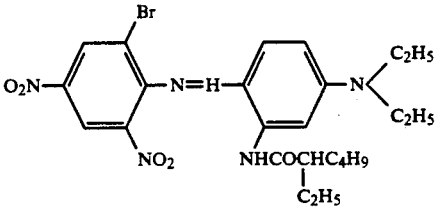
A-15
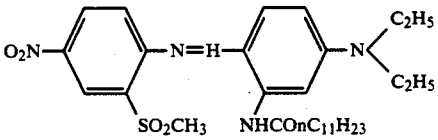

-continued

A-16

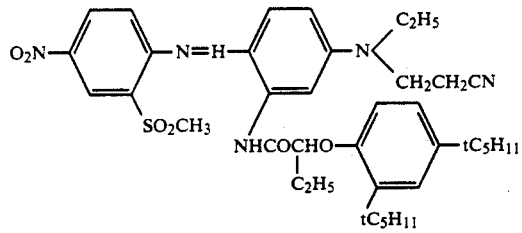

A-17

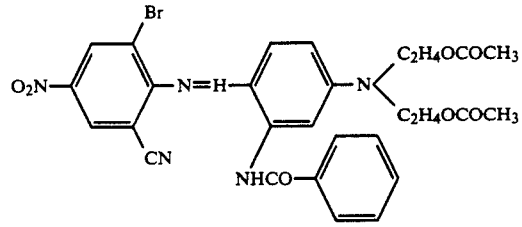

A-18

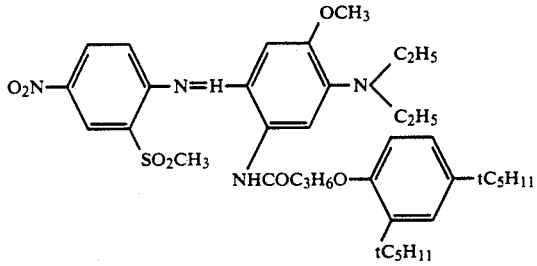

A-19

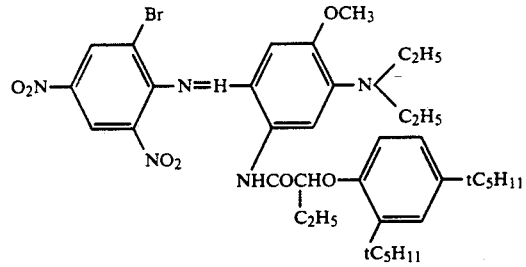

Examples of the cyan dye having an absorption maximum wavelength between 570 and 700 nm used for the present invention include compounds represented by the following formulas [I] through [V].

Formula [I]

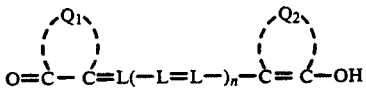

wherein $Q_1$ and $Q_2$ independently represent a group necessary for the formation of a carbon ring or a heterocyclic ring; L represents a methine group. n represents the integer 1 or 2. The heterocyclic ring represented by $Q_1$ and $Q_2$ has the same definition as of formula [C-III] above.

Formula [II]

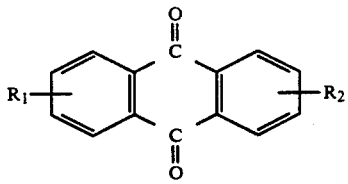

wherein $R_1$ and $R_2$, whether identical or not, independently represent an alkyl group, an alkoxy group, an amino group, a hydroxyl group, a sulfo group, a carboxyl group or a halogen atom, each of which may have a number of substituents.

Formula [III]

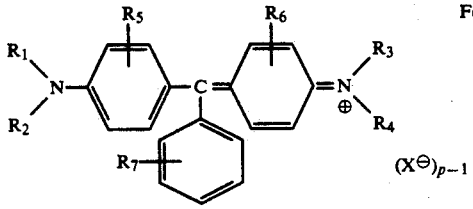

wherein $R_1$, $R_2$, $R_3$ and $R_4$ independently represent a hydrogen atom, an alkyl group, an aryl group, or the like; $R_5$, $R_6$ and $R_7$ independently represent an alkyl group, an alkoxy group, an amino group, a hydroxyl group, a sulfo group, a carboxyl group, a halogen atom or another group; $R_5$, $R_6$ and $R_7$ may have a number of substituents. $X^{\ominus}$ represents an acid anion; P represents the integer 1 or 2.

Formula [IV]

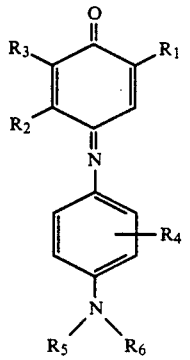

wherein $R_1$ represents a hydrogen atom, a sulfo group, a carboxyl group, a carbamoyl group, a carboxylate group, an amino group or an acyl group; $R_2$ and $R_3$ independently represent a substituent such as a hydrogen atom, an alkyl group, an alkoxy group, an amino group or a halogen atom; $R_2$ and $R_3$ may bind to each other to form a ring. $R_4$ represents a substituent such as an alkyl group, an alkoxy group, an amino group, a sulfo group, a carboxyl group or a halogen atom, which may have a number of substituents. $R_5$ and $R_6$ independently represent an alkyl group or an aryl group.

Formula [V]

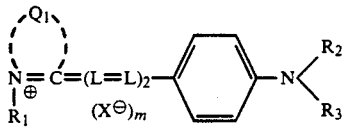

wherein $Q_1$ represents a group necessary for the formation of a heterocyclic ring; L represents a methine group. $R_1$, $R_2$ and $R_3$ independently represent an alkyl group which may have a substituent or an aryl group which may have a substituent. $X^{\ominus}$ represents an anion; m represents 0 or 1. The heterocyclic ring represented by $Q_1$ is preferably a 5- or 6-membered ring, such as an indole ring.

Formula [VI]

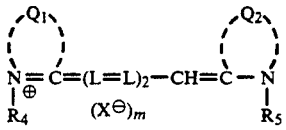

wherein $Q_1$ and $Q_2$ independently represent a group necessary for the formation of a carbon ring or a heterocyclic ring; L represents a methine group. $R_4$ and $R_5$ independently represent an alkyl group which may have a substituent; $X^{\ominus}$ represents an anion; m represents 1 or 2. The heterocyclic ring represented by $Q_1$ and $Q_2$ is preferably a 5- or 6-membered ring, such as an indole ring.

Examples of dyes preferred for the present invention include cyan dyes of the oxonol, anthraquinone, azo and other types.

In the case of an oxonole type dye, it is preferable that the dye have a 5-pyrazolone nucleus. It is preferable to use a cyan dye having an electron-donating or weakly electron-attractive substituent at the 3-position in its 5-pyrazolone nucleus.

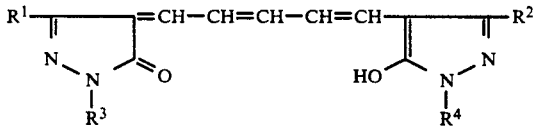

| No. | $R^1$ | $R^3$ | $R^4$ | $R^2$ |
|---|---|---|---|---|
| B-1 | $CH_3$ | 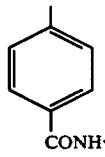 $CONH-C_4H_9$ | 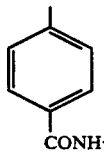 $CONH-C_4H_9$ | $C_3H_7$ |
| B-2 | $C_3H_7$ | 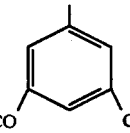 $H_{11}C_5HNCO$ COOH | 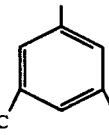 HOOC $CONH-C_5H_{11}$ | $OC_3H_7$ |
| B-3 | $C_4H_9-NHOC$ | 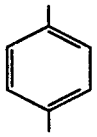 | 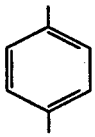 | $CONH-C_6H_{13}$ |

-continued
B-4
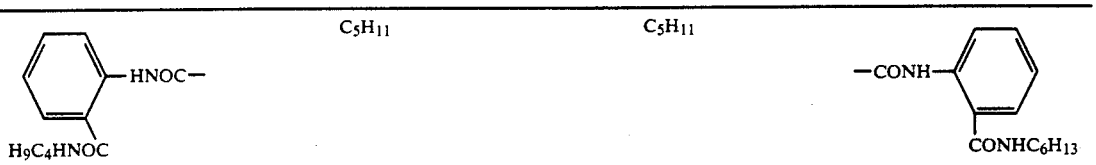
B-5
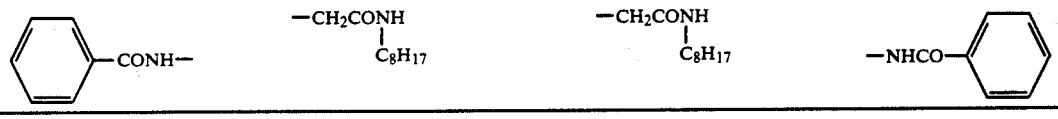
B-6
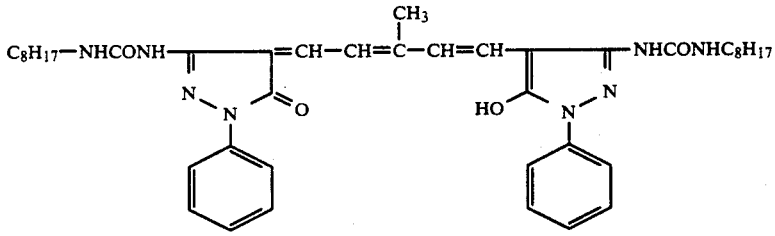
B-7
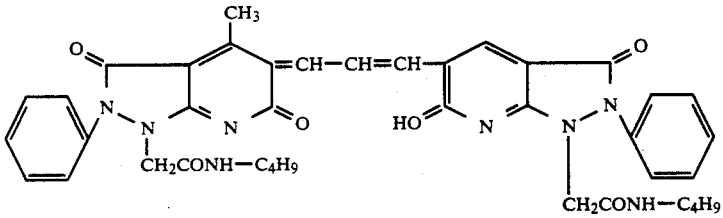
B-8
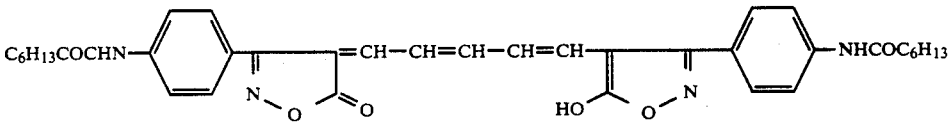
B-9
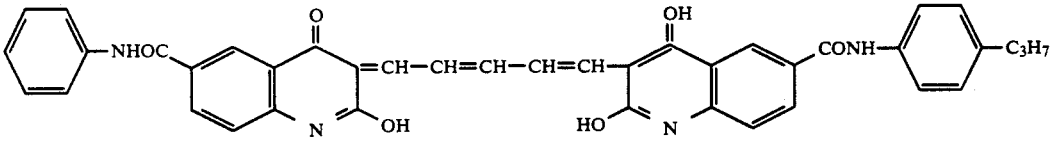
B-10
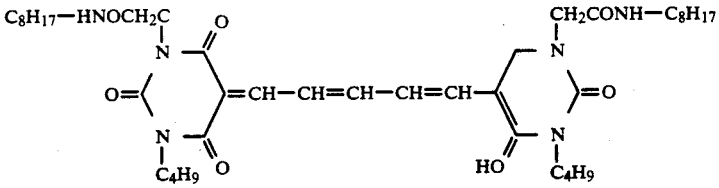
B-11
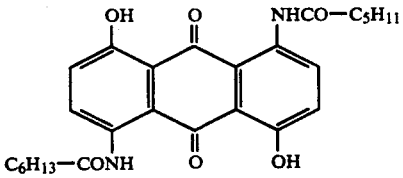
B-12
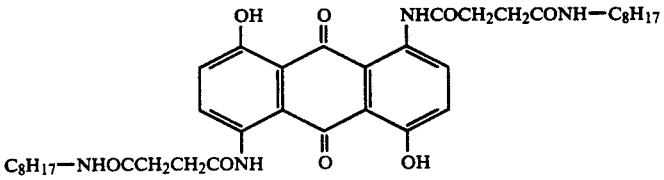

-continued
B-13
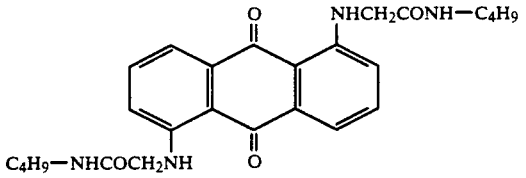
B-14
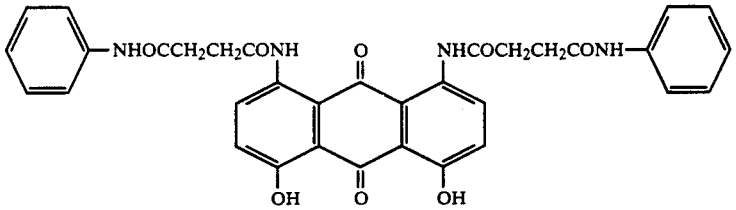
B-15
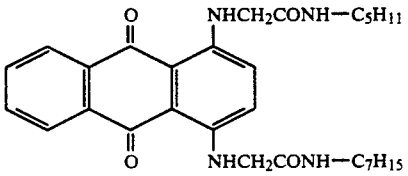
B-16
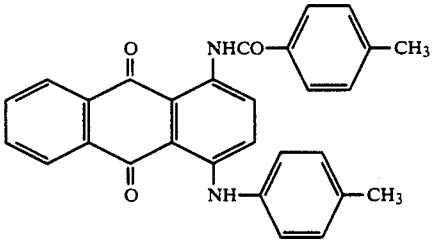
B-17
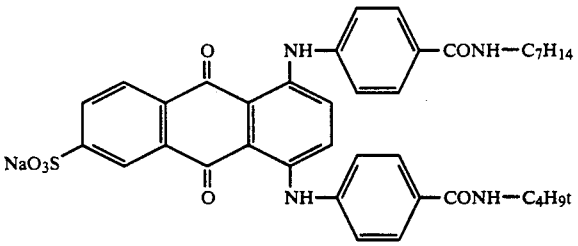
B-18
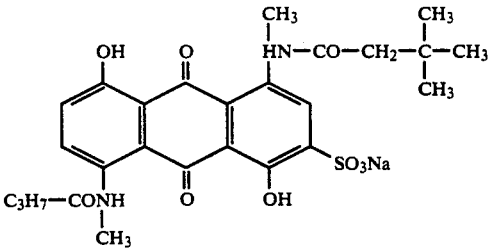
B-19
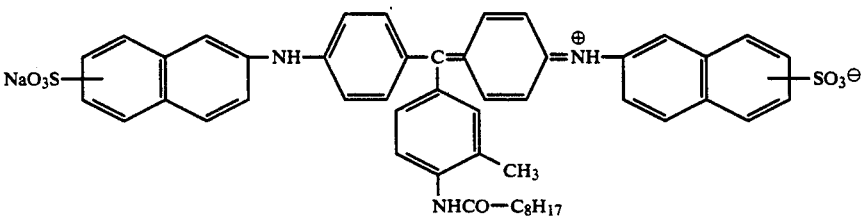
B-20

-continued
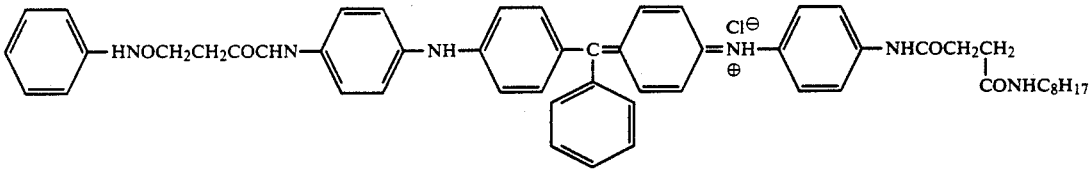
B-21
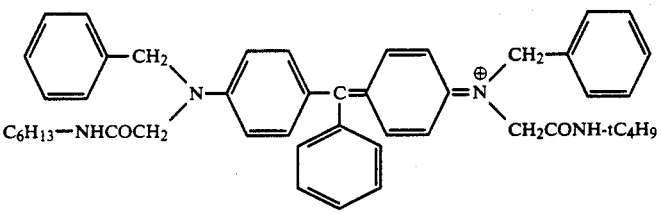
B-22
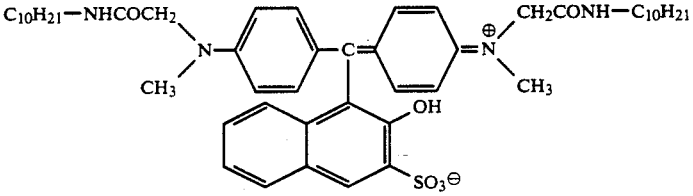
B-23
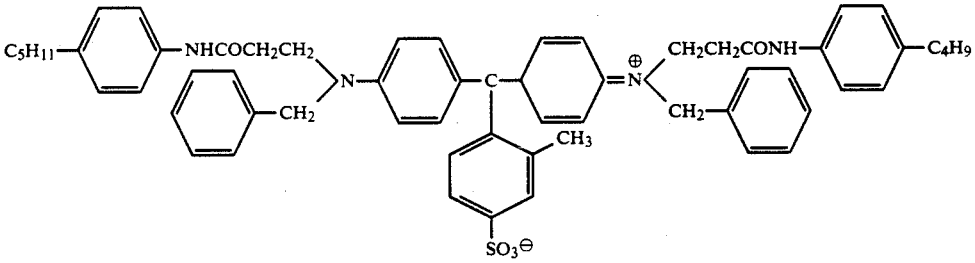
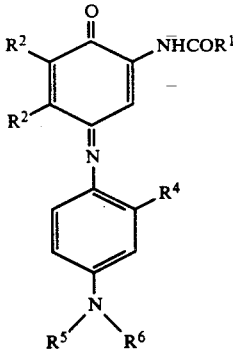
| No. | $R^1$ | $R^2$ | $R^3$ | $R^4$ | $R^5$ | $R^6$ |
|---|---|---|---|---|---|---|
| B-24 | 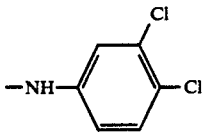 | H | 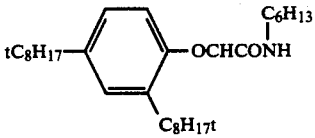 | $CH_3$ | $C_2H_6$ | $H_3CO_2S$ — $C_2H_4NH$ |
| B-25 | 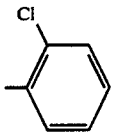 | H | 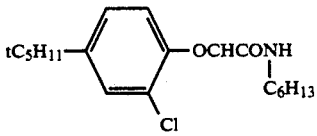 | H | $C_2H_5$ | $C_2H_5$ |

-continued
| | | | | | | |
|---|---|---|---|---|---|---|
| B-26 | $-C_3F_7$ | H | 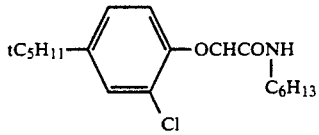 | $CH_3$ | $C_2H_5$ | $H_3CO_2S$ \| $-C_2H_4NH$ |
| B-27 | 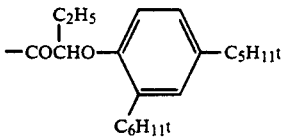 | Cl | $CH_3$ | $CH_3$ | $C_2H_5$ | $H_3CO_2S$ \| $-C_2H_4NH$ |
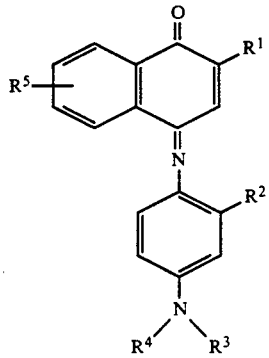
| No. | $R^1$ | $R^2$ | $R^3$ | $R^4$ | $R^5$ |
|---|---|---|---|---|---|
| B-28 | 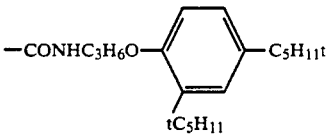 | $CH_3$ | $C_2H_5$ | $C_2H_5$ | H |
| B-29 | $-CONHC_6H_{33}$ | $CH_3$ | $C_2H_5$ | $-C_2H_4NHSO_2CH_3$ | H |
| B-30 | $-CONHC_5H_{11}$ | $CH_3$ | $-C_2H_4OH$ | $-C_2H_4OH$ | H |
| B-31 | $-CONHC_5H_{11}$ | H | $-(CH_2)_2CH_3$ | $-(CH_2)_2CH_3$ | H |
| B-32 | $-CONH(CH_2)_2CH_3$ | $CH_3$ | $-(CH_2)_2CH_3$ | $-CH_2CONHC_4H_9$ | H |
| B-33 | $-CONH(CH_2)_2CONHC_3H_7$ | H | $-(CH_2)_2CH_3$ | $-(CH_2)_2C_3H_7$ | H |
| B-34 | $-CONHC_4H_9$ | $CH_3$ | $-C_2H_5$ | $-(CH_2)_2NHSO_2CH_3$ | $C_2H_5$ |
B-35
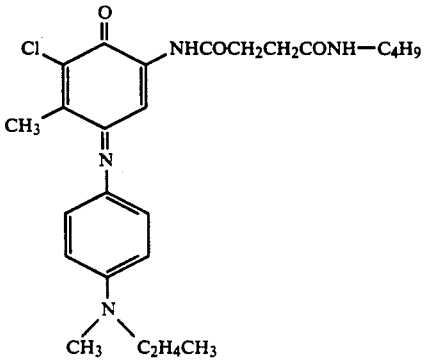

-continued

B-36

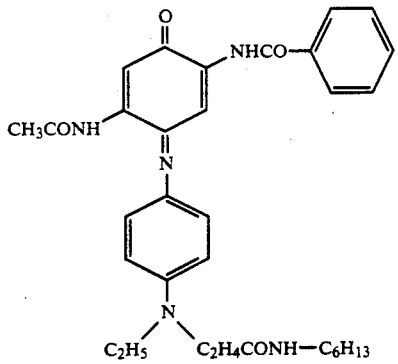

B-38

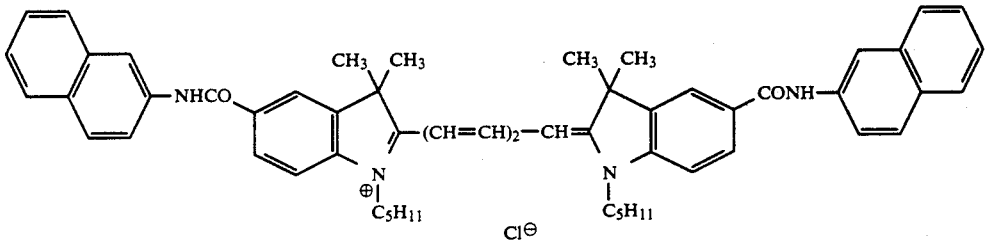

B-39

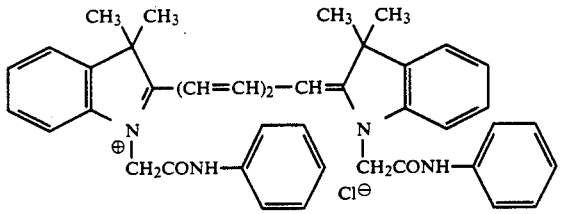

B-40

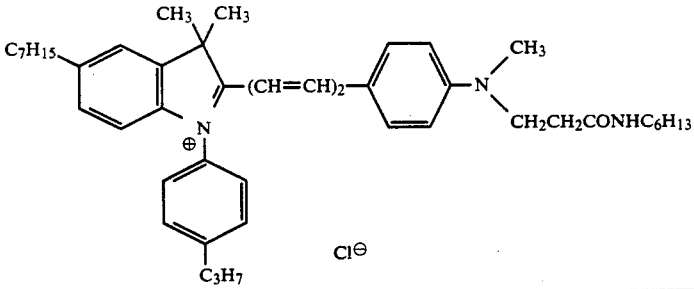

The example compounds given above can be produced by the methods described in U.S. Pat. No. 4,420,553, Japanese Patent Publication Open to Public Inspection Nos. 48854/1986, 276539/1987, 7838/1986, 243654/1985, 32851/1980 and 26849/1982 and "Senryo Kagaku (Dye Chemistry)", edited by Yutaka Hosoda, published by Gihodo (1957).

In a mode of embodiment of the present invention, the hydrophobic dye with a ballast group, along with a hydrophobic polymer used for the present invention, is dispersed as follows:

Accordingly, the dye and the hydrophobic polymer are mixed in the presence of an auxiliary solvent in which both are soluble. The resulting mixture is dispersed incontinuously in the zol of an aqueous colloidal binder to form a finely granular dispersion like gelatin.

The resulting mixture is then desirably kept standing cool, shredded and washed with water (preferably distilled water) and dried. All portion of the solvent used is removed in this process.

Next, the hydrophobic colloid containing a substantially uniform dispersion of fine grains of the dye-hydrophobic polymer mixture is thoroughly mixed with an aqueous polymer of the invention and a hardener of the present invention and used to prepare an electroconductive layer.

The fine grains of the dye-hydrophobic polymer mixture are normally smaller than 3 microns. It is desirable that the grains have a size of not more than 1 micron on average.

In the present invention, any conventional auxiliary solvent can be used to dissolve the dye and the hydrophobic polymer.

Examples of auxiliary solvents include alcohols, ketones, esters and halogenated hydrocarbons, specifically ethyl acetate, chloroform, benzyl alcohol, methyl acetate, propyl acetate, butyl acetate, isobutyl ketone, isopropyl acetate, ethyl propionate and secondary butyl alcohol.

A dye content for the present invention is selected so that the tone at the unexposed portion after development becomes neutral black. Optimum amount of dye addition depends on support concentration, dye extinction coefficient, dye absorption maximum wavelength and developed silver tone. This applies to the content ratios of the dye having an absorption maximum wavelength between 400 and 520 nm, the dye having an absorption maximum wavelength between 520 and 560 nm, and the dye having an absorption maximum wavelength between 570 and 700 nm. It is preferable to add each dye in a ratio of $1\times10^{-7}$ to $1\times10^{-4}$ mol/m$^2$, more preferably $2\times10^{-7}$ to $2\times10^{-5}$ mol/m$^2$, and ideally $5\times10^{-7}$ to $1.5\times10^{-5}$ mol/m$^2$.

Appropriate supports include plastic films, which may be coated with a subbing layer or subjected to corona discharge, ultraviolet irradiation or other treatment for the purpose of obtaining better coating layer adhesion. One or both of the support faces thus treated may be coated with an emulsion of the present invention.

In applying the present invention to X-ray radiography for medical use, a fluorescent intensifying screen mainly comprising a phosphor which generates near ultraviolet light or visible light upon exposure to transmitting radiation is used. It is desirable that exposure be carried out by keeping this fluorescent intensifying screen in close contact with both faces of the light-sensitive material formed with an emulsion of the present invention on both faces.

Here, transmitting radiation means a high energy electromagnetic wave, i.e., X-ray or gamma ray.

The fluorescent intensifying screen includes an intensifying screen containing calcium tungstate as the main fluorescent component and a fluorescent intensifying screen containing a terbium-activated rare earth compound as the main component.

EXAMPLES

The present invention will be hereunder described in detail with examples.

EXAMPLE 1

Silver iodobromide grains containing 30 mol % of silver iodide were grown at pH 9.3 and pAg 7.5 on monodispersed silver iodobromide seed grains having an average grain size of 0.2 μm and a silver iodide content of 2.0 mol %, and then molar equivalents of potassium bromide and silver nitrate were added thereto at pH 7.8 and pAg 8.9 so as to prepare monodispersed emulsions having an average silver iodide content of 2.3 mols and three different average grain sizes of 1.25 μm (A), 0.98 μm (B), and 0.60 μm (C) were prepared. The emulsions were desalinated by a conventional flocculation method; that is, a formalin condensate of sodium naphthalene sulfonate and an aqueous solution of magnesium sulfate were added for flocculation while keeping the temperature at 40° C. After decantaton, demineralized water of 40° C. or below was added and the aqueous solution of magnesium sulfate was added again for reflocculation followed by decantation.

To each of the desalinated grains (A), (B) and (C) were added $1.9\times10^{-3}$ mol/mol AgX of ammonium thiocyanate, proper amounts of chloroauric acid and hypo, and the following spectral sensitizing dyes A and B in a total amount of 800 mg/mol AgX at an A-to-B weight ration of 200:1 to perform chemical ripening. Fifteen minutes before the completion of chemical ripening, 200 mg/mol AgX of potassium iodide was added, then each emulsion was stabilized with the addition of $3\times10^{-2}$ mol of 4-hydroxy-6-methyl-1,3,3a,7-tetrazaindene. Next, the three types of emulsion grains were mixed at a ratio of (A)25%, (B)40% and (C)35%, and additions of the following additives and lime-treated gelatin were followed to prepare the coating emulsion (1).

Next, grains (B), (C) and (D) were treated in the same manner and mixed at a ratio of (B)15%, (C)45% and (D)40% to prepare the coating emulsion (2).

The spectral sensitizing dyes used in the coating emulsions are as follows:

Spectral sensitizing dye A

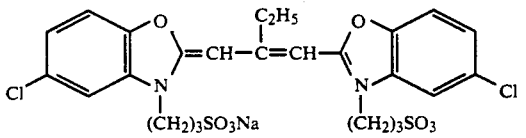

Spectral sensitizing dye B

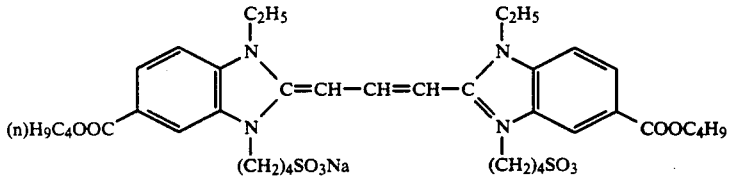

The additives used in each of the coating emulsions (light-sensitive silver halide coating solutions) are as follows. Amounts of addition are per mol of silver halide.

| | |
|---|---|
| 1,1-dimethylol-1-bromo-1-nitromethane | 65 mg |
| 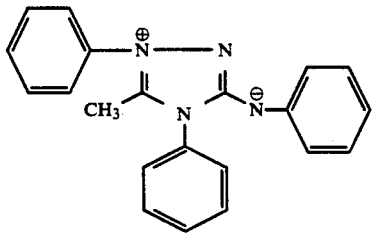 | 150 mg |
| t-butyl catechol | 400 mg |

-continued

| | |
|---|---|
| Polyvinylpyrrolidone (molecular weight: 10,000) | 1.0 g |
| Styrene-maleic anhydride copolymer | 2.5 g |
| Trimethylol propane | 10 g |
| Diethylene glycol | 5 g |
| Nitrophenyl-triphenyl phosphonium chloride | 50 mg |
| Ammonium 1,3-hydroxybenzene-4-sulfonate | 4 g |
| Sodium 2-mercaptobenzimidazole-5-sulfonate | 1.5 mg |
| 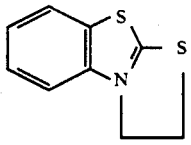 | 70 mg |
| $n\text{-}C_4H_9OCH_2CH(OH)CH_2N(CH_2COOH)_2$ | 1 g |
| 1-phenyl-5-mercaptotetrazole | 50 mg |

Further, the following materials were added to the coating solution for the protective layer. Amounts of addition are shown per liter of the coating solution.

| | |
|---|---|
| Lime-treated inert gelatin | 68 g |
| Acid-treated gelatin | 2 g |
| $NaO_3S-CH(CH_2COOC_{10}H_{21})-COOC_5H_{11}$ (coating aid) | 1 g |
| Polymethylmethacrylate (matting agent having an area mean particle size of 3.5 μm) | 1.1 g |
| Silicon dioxide particles (matting agent having an area mean particle size of 1.2 μm) | 0.5 g |
| LUDOX AM (colloidal silica made by Du pont) | 30 g |
| 2% aqueous solution of sodium 2,4-dichloro-6-hydroxy-1,3,5-triazine (hardener) | 10 ml |
| 40% aqueous solution of glyoxal (hardener) | 1.5 ml |
| 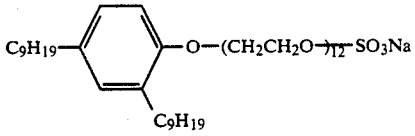 | 1.0 g |
| 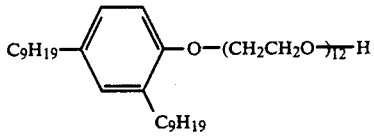 | 0.5 g |
| $C_4F_9SO_3K$ | 2 mg |
| $C_{12}H_{25}CONH(CH_2CH_2O)_5H$ | 0.5 g |

Preparation of the Antistatic Layer

After subjecting both sides of a 175 μm thick subbed polyethylene terephthalate film base to corona discharge with an energy of 9 m/m$^2$.min, a component solution containing a water-soluble electroconductive polymer (a), hydrophobic polymer particles (b) and a hardener (c) in a weight ratio of 5.5:3.6:0.9 was coated thereon to a dry film thickness of 0.7 μm at a speed of 45 m/min with a roll fit coating pan and an air knife. Then, the film was dried for 2 minutes at 90° C. and heat-treated for 90 seconds at 140° C.

On both sides of each film base so-prepared were simultaneously coated an emulsion layer, a protective layer and electroconductive layers at a speed of 80 m/min with two slide hopper type coaters to give a layer configuration shown in Table 1, followed by drying for 2 minutes and 40 seconds. Thus, Samples (1) through (42) were prepared.

The samples have a 4-layered configuration with the 1st layer nearest to the support.

The electroconductive layers used in this example were as follows:

Conductive layer I: having the same composition as the antistatic layer of Sample (1) in Table 1, and adjusted to have a dry film thickness of 0.15 μm.

Conductive layer II: the same as the above except that the composition was the same as the antistatic layer of Sample 3 in Table 1.

Conductive layer III: the same as the above except that the composition was the same as the antistatic layer of Sample 5 in Table 1.

Conductive layer IV: consisting of gelatin and 0.09 μm particle size $SnO_2$ at a volume ratio of 55:45, and adjusted to have a dry film thickness of 0.17 μm.

Conductive layer V: the same as the above except that $ZnO_2$ having a particle size of 0.11 μm was used.

Conductive layer VI: consisting of polyvinyl alcohol and $In_2O_3$ having a particle size of 0.10 μm.

The hardeners used in the antistatic layer of this example are as follows:

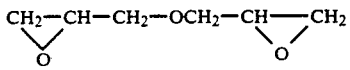

A-1

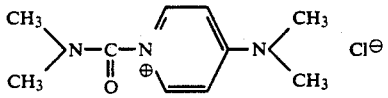

A-6

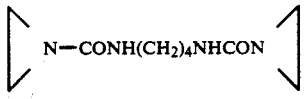

A-8

$H_2NCH_2CH_2NHCH_2CH_2CH_2Si(OCH_3)_3$ C-1

Evaluation of Antistatic Property

The antistatic properties of the samples were evaluated by preparing the preserved samples (1) and (2) and measuring the surface specific resistances of such preserved samples. The measurement was carried out for 1 minute on a sample placed between a pair of brazen electrodes (interval: 0.14 cm, length: 10 cm) with a resistance meter model TR 8651 made by Takeda Riken Kogyo. Before measurement, each sample was conditioned for 3 hours at 23° C. and 20% RH.

Preservation (1): samples humidified in advance for 3 hours at 23° C. and 48% RH were lapped over one another and put into a moisture-proof bag, then preserved for 4 days at 23° C.

Preservation (2): humidified samples were preserved for 4 days at 40° C. in the same manner as in the above (forced deterioration).

The surface specific resistances were also measured on a portion of the preserved samples (1) which were developed with an automatic developer model SRX-501 made by Konica Corp. in the following processing solutions at a developing temperature of 35° C., a fixing temperature of 32° C., a washing water flow rate of 3 l/min, and a drying temperature of 45° C.

Evaluation of Abrasion Resistance

A sample humidified at 23° C., 48% RH for 4 hours was scratched with a 0.3-mm radius sapphire needle at a speed of 1 cm/min while continuously changing the load, then the sample was developed in the same manner as mentioned above. A load at which blacking begins is shown in Table 1. A larger value means a higher abrasion resistance.

As apparent from the results in Table 1, any sample of the invention was excellent in abrasion resistance and had a low surface specific resistance even after the forced deterioration, exhibiting a satisfactory antistatic property. Particularly, surface specific resistance was low in a processed sample.

TABLE 1

| Sample No. | Antistatic layer (a) | (b) | (c) | 1st layer Emulsion layer | 2nd layer Conductive layer | 3rd layer Protective layer | 4th layer Conductive layer | Surface specific resistance ($\Omega/cm^{-1}$) Preservation (1) | After processing | Preservation (2) | Abrasion resistance (g) | Remarks |
|---|---|---|---|---|---|---|---|---|---|---|---|---|
| 1 | P-1 | L-1 | A-1 | Coating emulsion 1 | — | " | — | $4.2 \times 10^{11}$ | $1.0 \times 10^{12}$ | $7.0 \times 10^{12}$ | 30 | Comparison |
| 2 | P-1 | L-4 | A-6 | Coating emulsion 1 | — | " | — | $5.0 \times 10^{11}$ | $1.2 \times 10^{12}$ | $7.4 \times 10^{12}$ | 32 | Comparison |
| 3 | P-3 | L-4 | A-8 | Coating emulsion 1 | — | " | — | $5.0 \times 10^{11}$ | $1.1 \times 10^{12}$ | $7.2 \times 10^{12}$ | 31 | Comparison |
| 4 | P-3 | L-6 | C-1 | Coating emulsion 1 | — | " | — | $4.7 \times 10^{11}$ | $1.1 \times 10^{12}$ | $7.1 \times 10^{12}$ | 32 | Comparison |
| 5 | P-9 | L-6 | A-8 | Coating emulsion 1 | — | " | — | $4.3 \times 10^{11}$ | $1.0 \times 10^{12}$ | $7.0 \times 10^{12}$ | 34 | Comparison |
| 6 | P-1 | L-1 | A-8 | Coating emulsion 1 | I | " | — | $1.0 \times 10^{11}$ | $6.0 \times 10^{11}$ | $9.3 \times 10^{12}$ | 60 | Invention |
| 7 | P-1 | L-1 | A-8 | Coating emulsion 1 | — | " | I | $1.2 \times 10^{11}$ | $5.9 \times 10^{11}$ | $9.1 \times 10^{12}$ | 72 | Invention |
| 8 | P-1 | L-1 | A-8 | Coating emulsion 1 | I | " | I | $0.9 \times 10^{11}$ | $4.5 \times 10^{11}$ | $8.0 \times 10^{12}$ | 85 | Invention |
| 9 | P-3 | L-6 | C-1 | Coating emulsion 1 | I | " | — | $1.1 \times 10^{11}$ | $6.1 \times 10^{11}$ | $9.5 \times 10^{12}$ | 61 | Invention |
| 10 | P-3 | L-6 | C-1 | Coating emulsion 1 | I | " | I | $0.9 \times 10^{11}$ | $4.6 \times 10^{11}$ | $8.2 \times 10^{12}$ | 84 | Invention |
| 11 | P-3 | L-6 | C-1 | Coating emulsion 1 | II | " | — | $1.0 \times 10^{11}$ | $6.0 \times 10^{11}$ | $9.1 \times 10^{12}$ | 60 | Invention |
| 12 | P-3 | L-6 | C-1 | Coating emulsion 1 | — | " | II | $1.0 \times 10^{11}$ | $5.8 \times 10^{11}$ | $9.1 \times 10^{12}$ | 70 | Invention |
| 13 | P-3 | L-6 | C-1 | Coating emulsion 1 | II | " | II | $0.9 \times 10^{11}$ | $4.5 \times 10^{11}$ | $8.2 \times 10^{12}$ | 83 | Invention |
| 14 | P-3 | L-6 | C-1 | Coating emulsion 1 | III | " | — | $1.2 \times 10^{11}$ | $6.1 \times 10^{11}$ | $9.3 \times 10^{12}$ | 60 | Invention |
| 15 | P-3 | L-6 | C-1 | Coating emulsion 1 | — | — | III | $1.0 \times 10^{11}$ | $5.0 \times 10^{11}$ | $9.0 \times 10^{12}$ | 74 | Invention |
| 16 | P-3 | L-6 | C-1 | Coating emulsion 1 | III | " | III | $0.9 \times 10^{11}$ | $4.7 \times 10^{11}$ | $8.1 \times 10^{12}$ | 81 | Invention |
| 17 | P-3 | L-4 | A-8 | Coating emulsion 1 | IV | " | — | $1.0 \times 10^{11}$ | $6.0 \times 10^{11}$ | $9.0 \times 10^{12}$ | 60 | Invention |
| 18 | P-3 | L-4 | A-8 | Coating emulsion 1 | — | " | IV | $1.0 \times 10^{11}$ | $6.0 \times 10^{11}$ | $9.0 \times 10^{12}$ | 71 | Invention |
| 19 | P-3 | L-4 | A-8 | Coating emulsion 1 | IV | " | IV | $0.8 \times 10^{11}$ | $4.3 \times 10^{11}$ | $8.0 \times 10^{12}$ | 82 | Invention |
| 20 | P-3 | L-4 | A-8 | Coating emulsion 1 | V | " | — | $1.0 \times 10^{11}$ | $5.8 \times 10^{11}$ | $9.0 \times 10^{12}$ | 65 | Invention |
| 21 | P-3 | L-4 | A-8 | Coating emulsion 1 | — | " | V | $1.0 \times 10^{11}$ | $5.7 \times 10^{11}$ | $8.9 \times 10^{12}$ | 70 | Invention |
| 22 | P-3 | L-4 | A-8 | Coating emulsion 1 | V | " | V | $0.8 \times 10^{11}$ | $4.2 \times 10^{11}$ | $7.8 \times 10^{12}$ | 82 | Invention |
| 23 | P-3 | L-4 | A-8 | Coating emulsion 1 | VI | " | — | $1.0 \times 10^{11}$ | $5.9 \times 10^{11}$ | $8.9 \times 10^{12}$ | 62 | Invention |
| 24 | P-3 | L-4 | A-8 | Coating emulsion 1 | II | " | IV | $0.9 \times 10^{11}$ | $4.3 \times 10^{11}$ | $7.8 \times 10^{12}$ | 80 | Invention |
| 25 | P-3 | L-4 | A-8 | Coating emulsion 1 | V | " | II | $0.8 \times 10^{11}$ | $4.6 \times 10^{11}$ | $7.9 \times 10^{12}$ | 82 | Invention |
| 26 | P-3 | L-4 | A-8 | Coating emulsion 1 | III | " | IV | $0.8 \times 10^{11}$ | $4.5 \times 10^{11}$ | $8.1 \times 10^{12}$ | 83 | Invention |
| 27 | P-3 | L-4 | A-8 | Coating emulsion 1 | I | " | IV | $0.9 \times 10^{11}$ | $4.6 \times 10^{11}$ | $8.0 \times 10^{12}$ | 82 | Invention |
| 28 | P-9 | L-6 | A-8 | Coating emulsion 2 | II | " | — | $1.2 \times 10^{11}$ | $6.0 \times 10^{11}$ | $9.3 \times 10^{12}$ | 64 | Invention |
| 29 | P-9 | L-6 | A-8 | Coating emulsion 2 | — | " | II | $1.0 \times 10^{11}$ | $5.9 \times 10^{11}$ | $9.0 \times 10^{12}$ | 71 | Invention |
| 30 | P-9 | L-6 | A-8 | Coating emulsion 2 | II | " | II | $0.8 \times 10^{11}$ | $4.5 \times 10^{11}$ | $8.2 \times 10^{12}$ | 80 | Invention |
| 31 | P-9 | L-6 | A-8 | Coating emulsion 2 | II | " | IV | $0.8 \times 10^{11}$ | $4.5 \times 10^{11}$ | $8.0 \times 10^{12}$ | 81 | Invention |
| 32 | P-9 | L-6 | A-8 | Coating emulsion 2 | IV | " | IV | $0.9 \times 10^{11}$ | $4.6 \times 10^{11}$ | $8.1 \times 10^{12}$ | 84 | Invention |
| 33 | P-9 | L-6 | A-8 | Coating emulsion 2 | III | " | V | $0.7 \times 10^{11}$ | $4.5 \times 10^{11}$ | $8.1 \times 10^{12}$ | 82 | Invention |
| 34 | P-1 | L-4 | C-1 | Coating emulsion 2 | III | " | III | $0.8 \times 10^{11}$ | $5.0 \times 10^{11}$ | $8.0 \times 10^{11}$ | 82 | Invention |
| 35 | P-1 | L-4 | C-1 | Coating emulsion 2 | III | " | IV | $0.8 \times 10^{11}$ | $4.7 \times 10^{11}$ | $8.0 \times 10^{11}$ | 81 | Invention |
| 36 | P-1 | L-4 | C-1 | Coating emulsion 2 | IV | " | III | $0.9 \times 10^{11}$ | $4.9 \times 10^{11}$ | $8.3 \times 10^{11}$ | 82 | Invention |
| 37 | P-1 | L-4 | C-1 | Coating emulsion 2 | I | " | — | $1.1 \times 10^{11}$ | $6.0 \times 10^{11}$ | $9.5 \times 10^{11}$ | 62 | Invention |
| 38 | P-1 | L-4 | C-1 | Coating emulsion 2 | II | " | — | $1.1 \times 10^{11}$ | $6.0 \times 10^{11}$ | $9.4 \times 10^{11}$ | 63 | Invention |
| 39 | P-1 | L-4 | C-1 | Coating emulsion 2 | III | " | — | $1.2 \times 10^{11}$ | $5.9 \times 10^{11}$ | $9.5 \times 10^{11}$ | 60 | Invention |
| 40 | P-1 | L-4 | C-1 | Coating emulsion 2 | IV | — | — | $1.0 \times 10^{11}$ | $6.1 \times 10^{11}$ | $9.2 \times 10^{11}$ | 62 | Invention |
| 41 | P-1 | L-4 | C-1 | Coating emulsion 2 | V | " | — | $1.0 \times 10^{11}$ | $5.9 \times 10^{11}$ | $9.1 \times 10^{11}$ | 61 | Invention |
| 42 | P-1 | L-4 | C-1 | Coating emulsion 2 | VI | " | — | $1.1 \times 10^{11}$ | $6.1 \times 10^{11}$ | $9.3 \times 10^{11}$ | 62 | Invention |
| a | — | — | — | Coating emulsion 2 | — | " | — | $7.0 \times 10^{11}$ | $3.2 \times 10^{13}$ | $3.0 \times 10^{13}$ | 50 | Comparison |
| b | — | — | — | Coating emulsion 2 | III | " | — | $6.0 \times 10^{11}$ | $5.0 \times 10^{12}$ | $4.0 \times 10^{12}$ | 60 | Comparison |
| c | — | — | — | Coating emulsion 2 | — | " | IV | $6.0 \times 10^{11}$ | $5.1 \times 10^{12}$ | $3.7 \times 10^{12}$ | 62 | Comparison |
| d | — | — | — | Coating emulsion 2 | II | " | V | $5.8 \times 10^{11}$ | $5.0 \times 10^{12}$ | $3.5 \times 10^{12}$ | 65 | Comparison |

Notes:
I, II, and III: The same as the antistatic layer
IV: Consisting of $SnO_2$ and gelatin
V: Consisting of $ZnO_2$ and gelatin
VI: Consisting of $In_2O_3$ and gelatin

EXAMPLE 2

An emulsion consisting of tabular silver iodobromide grains having an average grain diameter of 1.10 μm and an aspect ratio of 8:1 was prepared by the method described with respect to Emulsion 3 (example) of Japanese Patent O.P.I. Publication No. 113927/1983.

In this emulsion, silver iodobromide grains account for more than 80% of the total projection area. Prior to desalination, the preceding spectral sensitizing dyes A and B were added to these grains at an A-to-B weight ratio of 200:1 and in a total amount of 1,000 mg/mol AgX.

In adding these spectral sensitizing dyes, pH was maintained at 7.60. 15 minutes after the addition, a phenylcarbamylized gelatin was added thereto, then pH was lowered with acetic acid for flocculation followed by decantation.

To the grains so-prepared was added demineralized water so as to make the volume 500 ml per mol of silver halide grain. After raising the temperature to 52° C., the preceding spectral sensitizing dyes (1) and (2) were added thereto at a combination ratio of 200:1 by weight and in a total amount of 100 mg/mol AgX. 10 minutes after the addition, $2.8\times10^{-3}$ mol/mol AgX of ammonium thiocyanate and proper amounts of chloroauric acid and hypo were added to carry out chemical ripening. After performing chemical ripening for 80 minutes, a proper amount of 4-hydroxy-6-methyl-1,3,3a,7-tetrazaindene was added to terminate the chemical ripening.

To the resultant emulsion, the same additives as in Example 1 were added to prepare the coating emulsion 3. As the protective layer, the same layer as in Example 1 was used.

Coating solutions for the backing layer respectively having the following compositions were prepared.

| Backing layer | |
|---|---|
| Coating solution for the lower backing layer | |
| Materials used per liter of the coating solution | |
| Lime-treated gelatin | 70 g |
| Acid-treated gelatin | 5 g |
| Trimethylol propane | 1.5 g |
| Backing dye A (described below) | 1.0 g |
| Backing dye B (described below) | 1.0 g |
| Coating solution for the upper backing layer | |
| Materials used per liter of the coating solution | |
| Lime-treated gelatin | 70 g |
| Acid-treated gelatin | 5 g |
| Trimethylol propane | 1.5 g |
| Backing dye A (described below) | 1.0 g |
| Backing dye B (described below) | 1.0 g |
| $KNO_3$ | 0.5 g |
| $C_{10}H_{21}CONH(CH_2CH_2O)_6H$ | 1.5 g |

-continued

| Backing layer | |
|---|---|
| 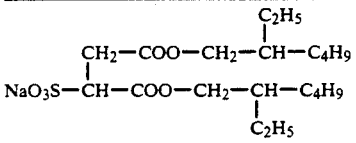 | 0.4 g |
| $F_{19}C_9O(CH_2CH_2O)_{10}CH_2CH_2OH$ | 0.1 g |
| $NaO_3S-CH(CH_2COOCH_2(C_2F_4)_3H)-COOCH_2(C_2F_4)_3H$ | 0.3 g |
| 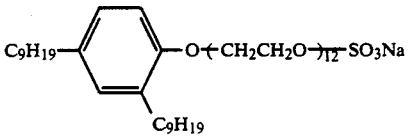 | 1.0 g |
| 2% aqueous solution of sodium 1,3,5-triazine | 15 ml |
| Polymethylmethacrylate particles having an area mean particle size of 3.5 μm | 1.1 g |

Backing dye A

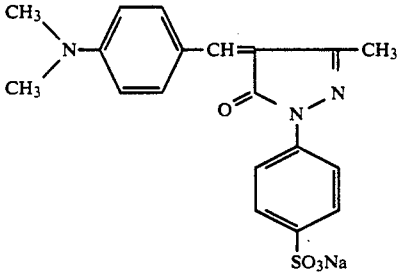

Backing dye B

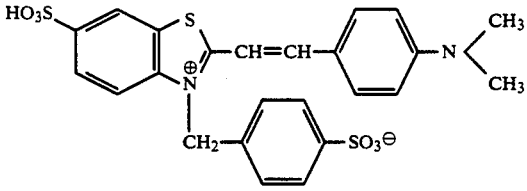

The above backing layers were simultaneously formed by a double-layer coating method on a film base provided with an antistatic layer like Example 1. Then, an emulsion layer, a protective layer and electroconductive layers were coated thereon and dried in the same manner as in Example 1 to prepare Samples 43 through 56.

Antistatic property and abrasion resistance were evaluated on these samples in the same way as in Example 1. The results are shown in Table 2.

TABLE 2-1

| Sample No. | Antistatic layer (a) | (b) | (c) | 1st layer Emulsion layer | 2nd layer Conductive layer | 3rd layer Protective layer | 4th layer Conductive layer |
|---|---|---|---|---|---|---|---|
| 43 | P-5 | L-7 | C-1 | Coating emulsion 3 | — | " | — |
| 44 | P-13 | L-9 | A-8 | Coating emulsion 3 | — | " | — |
| 45 | P-13 | L-5 | A-6 | Coating emulsion 3 | — | " | — |
| 46 | P-13 | L-6 | C-1 | Coating emulsion 3 | I | " | — |
| 47 | P-13 | L-6 | C-1 | Coating emulsion 3 | IV | " | — |
| 48 | P-13 | L-6 | C-1 | Coating emulsion 3 | I | " | IV |
| 49 | P-13 | L-6 | C-1 | Coating emulsion 3 | V | " | II |
| 50 | P-13 | L-6 | C-1 | Coating emulsion 3 | I | " | VI |

TABLE 2-1-continued

| | | | | | | | |
|---|---|---|---|---|---|---|---|
| 51 | P-13 | L-6 | C-1 | Coating emulsion 3 | VI | " | III |
| 52 | P-2 | L-8 | A-8 | Coating emulsion 3 | II | " | — |
| 53 | P-2 | L-8 | A-8 | Coating emulsion 3 | — | " | III |
| 54 | P-2 | L-8 | A-8 | Coating emulsion 3 | V | " | IV |
| 55 | P-2 | L-8 | A-8 | Coating emulsion 3 | I | " | II |
| 56 | P-2 | L-8 | A-8 | Coating emulsion 3 | II | " | III |
| e | — | — | — | Coating emulsion 3 | — | " | — |
| f | — | — | — | Coating emulsion 3 | V | " | III |

| Sample No. | Surface specific resistance ($\Omega/cm^{-1}$) Preservation (1) | After processing | Preservation (2) | Abrasion resistance (g) | Remarks |
|---|---|---|---|---|---|
| 43 | $4.2 \times 10^{11}$ | $1.0 \times 10^{12}$ | $7.0 \times 10^{12}$ | 33 | Comparison |
| 44 | $5.0 \times 10^{11}$ | $1.1 \times 10^{12}$ | $6.5 \times 10^{12}$ | 32 | Comparison |
| 45 | $4.0 \times 10^{11}$ | $1.2 \times 10^{12}$ | $8.5 \times 10^{12}$ | 34 | Comparison |
| 46 | $1.0 \times 10^{11}$ | $6.2 \times 10^{11}$ | $9.0 \times 10^{11}$ | 62 | Comparison |
| 47 | $1.1 \times 10^{11}$ | $5.9 \times 10^{11}$ | $9.0 \times 10^{11}$ | 61 | Comparison |
| 48 | $0.7 \times 10^{11}$ | $4.0 \times 10^{11}$ | $7.3 \times 10^{11}$ | 83 | Invention |
| 49 | $0.9 \times 10^{11}$ | $3.8 \times 10^{11}$ | $8.0 \times 10^{11}$ | 82 | Invention |
| 50 | $0.9 \times 10^{11}$ | $4.1 \times 10^{11}$ | $8.0 \times 10^{11}$ | 80 | Invention |
| 51 | $0.7 \times 10^{11}$ | $4.1 \times 10^{11}$ | $7.5 \times 10^{11}$ | 80 | Invention |
| 52 | $1.0 \times 10^{11}$ | $6.0 \times 10^{11}$ | $9.2 \times 10^{11}$ | 62 | Invention |
| 53 | $1.0 \times 10^{11}$ | $6.1 \times 10^{11}$ | $9.0 \times 10^{11}$ | 71 | Invention |
| 54 | $0.8 \times 10^{11}$ | $4.0 \times 10^{11}$ | $7.5 \times 10^{11}$ | 80 | Invention |
| 55 | $0.7 \times 10^{11}$ | $4.0 \times 10^{11}$ | $7.0 \times 10^{11}$ | 81 | Invention |
| 56 | $0.8 \times 10^{11}$ | $4.1 \times 10^{11}$ | $7.2 \times 10^{11}$ | 80 | Invention |
| e | $7.0 \times 10^{11}$ | $4.0 \times 10^{13}$ | $5.0 \times 10^{13}$ | 50 | Comparison |
| f | $6.0 \times 10^{11}$ | $5.0 \times 10^{12}$ | $3.7 \times 10^{12}$ | 62 | Comparison |

Notes:
I, II, and III: The same as the antistatic layer
IV: Consisting of $SnO_2$ and gelatin
V: Consisting of $ZnO_2$ and gelatin
VI: Consisting of $In_2O_3$ and gelatin

EXAMPLE 3

An emulsion containing tabular silver iodobromide grains having an average grain diameter of 0.7 μm and an aspect ratio of 6:1 was prepared in the same manner as in Example 2.

These grains accounted for more than 80% of the total projection area.

After removing excessive salts by a normal process, the resultant emulsion was chemically ripened by adding $2.0 \times 10^{-3}$ mol/mol AgX of ammonium thiocyanate and proper amounts of chloroauric acid and hypo.

Further, 1.0 g of 4-hydroxy-6-methyl-1,3,3a,7-tetrazaindene was added thereto. 5 minutes later, the following sensitizing dye C was added in an amount of 30 mg per mol of silver halide.

Sensitizing dye C

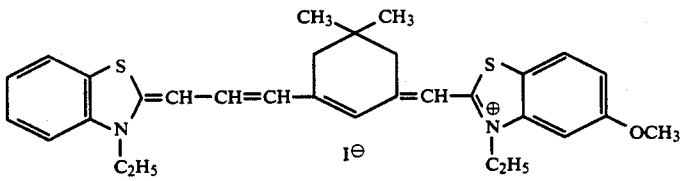

To the emulsion, there were added per mol of silver halide 9 g of trimethylol propane, 30 mg of nitrophenyltriphenylphosphonium chloride, 1 g of ammonium 1,3-dihydroxybenzene-4-sulfonate, 10 mg of sodium 2-mercaptobenzimidazole-5-sulfonate, 10 mg of 2-mercaptobenzothiazole, 10 mg of phenyl-5-mercaptotetrazole, 35 mg of,

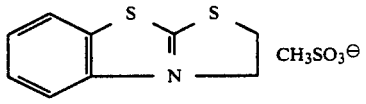

1 g of 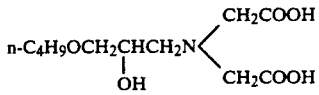

10 mg of 1,1-dimethylol-1-bromo-1-nitromethane, and 60 mg of

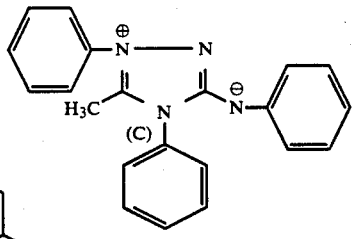

Thus, the coating emulsion 4 was prepared.

Composition of the protective was the same as that of Example 1.

As a backing layer, there was prepared a backing layer solution consisting of 400 g of gelatin, 2 g of polymethylmethacrylate, 6 g of sodium dodecylbenzene sulfonate, 20 g of the following antihalation dye, and glyoxal.

Antihalation dye

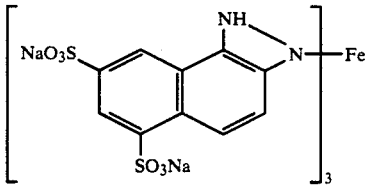

Further, as a coating solution for the backing layer, a solution of the following composition was prepared.

| | |
|---|---|
| 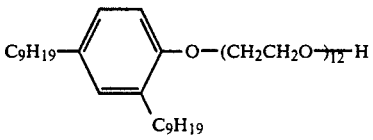 | 2 mg |
| $CH_2COO(CH_2)_9CH_3$ \| $CHCOO(CH_2)_2CH(CH_3)_2$ \| $SO_3Na$ | 7 mg |

-continued

| | |
|---|---|
| $C_9F_{19}—O(CH_2CH_2O)_{10}—CH_2CH_2OH$ | 2 mg |
| $C_8F_{17}SO_3K$ | 3 mg |
| 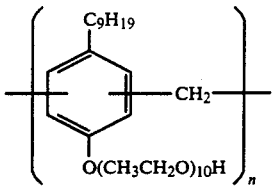 | 15 mg |
| n = 2~5 | |
| Sodium chloride | 50 mg |
| Polymethylmethacrylate (matting agent having an average particle size of 5 μm) | 7 mg |
| Colloidal silica (average particle size: 0.013 μm) | 70 mg |
| 2% aqueous solution of sodium 1,3,5-triazine (hardener) | 13 ml |
| 40% aqueous solution of glyoxal (hardener) | 1.5 ml |

The above backing layers ware simultaneously formed by a multi-layer coating method on a film base provided with an antistatic layer like Example 2. Then, an emulsion layer, a protective layer and electroconductive layers were coated thereon and dried in the same manner as in Example 1 to give the layer configuration shown by Table 3. Samples 57 through 70 were thus obtained.

These samples were evaluated for the antistatic property and abrasion resistance in the same way as in Examples 1 and 2. The results are summarized in Table 3.

TABLE 3

| Sample No. | Antistatic layer (a) | (b) | (c) | 1st layer Emulsion layer | 2nd layer Conductive layer | 3rd layer Protective layer | 4th layer Conductive layer |
|---|---|---|---|---|---|---|---|
| 57 | P-1 | L-6 | C-1 | Coating emulsion 4 | — | " | — |
| 58 | P-1 | L-7 | A-6 | Coating emulsion 4 | — | " | — |
| 59 | P-3 | L-5 | A-8 | Coating emulsion 4 | — | " | — |
| 60 | P-3 | L-5 | A-8 | Coating emulsion 4 | I | " | — |
| 61 | P-3 | L-5 | A-8 | Coating emulsion 4 | — | " | II |
| 62 | P-3 | L-5 | A-8 | Coating emulsion 4 | III | " | — |
| 63 | P-3 | L-5 | A-8 | Coating emulsion 4 | IV | " | — |
| 64 | P-3 | L-5 | A-8 | Coating emulsion 4 | V | " | I |
| 65 | P-3 | L-5 | A-8 | Coating emulsion 4 | II | " | VI |
| 66 | P-9 | L-9 | A-1 | Coating emulsion 4 | V | " | — |
| 67 | P-9 | L-9 | A-1 | Coating emulsion 4 | — | " | IV |
| 68 | P-9 | L-9 | A-1 | Coating emulsion 4 | II | " | III |
| 69 | P-9 | L-9 | A-1 | Coating emulsion 4 | IV | " | II |
| 70 | P-9 | L-9 | A-1 | Coating emulsion 4 | II | " | V |
| g | — | — | — | Coating emulsion 4 | — | " | — |
| h | — | — | — | Coating emulsion 4 | V | " | III |
| i | — | — | — | Coating emulsion 4 | | | |

| Sample No. | Surface specific resistance ($\Omega/cm^{-1}$) Preservation (1) | After processing | Preservation (2) | Abrasion resistance (g) | Remarks |
|---|---|---|---|---|---|
| 57 | $4.0 \times 10^{11}$ | $1.0 \times 10^{12}$ | $6.3 \times 10^{12}$ | 32 | Comparison |
| 58 | $3.0 \times 10^{11}$ | $1.2 \times 10^{12}$ | $6.2 \times 10^{12}$ | 32 | Comparison |
| 59 | $4.0 \times 10^{11}$ | $1.1 \times 10^{12}$ | $7.0 \times 10^{12}$ | 32 | Comparison |
| 60 | $1.0 \times 10^{11}$ | $6.0 \times 10^{11}$ | $9.0 \times 10^{11}$ | 60 | Invention |
| 61 | $1.2 \times 10^{11}$ | $6.0 \times 10^{11}$ | $8.7 \times 10^{11}$ | 72 | Invention |
| 62 | $1.0 \times 10^{11}$ | $6.1 \times 10^{11}$ | $9.2 \times 10^{11}$ | 62 | Invention |
| 63 | $1.0 \times 10^{11}$ | $6.1 \times 10^{11}$ | $9.2 \times 10^{11}$ | 61 | Invention |
| 64 | $0.8 \times 10^{11}$ | $4.3 \times 10^{11}$ | $7.3 \times 10^{11}$ | 80 | Invention |
| 65 | $0.7 \times 10^{11}$ | $3.9 \times 10^{11}$ | $7.0 \times 10^{11}$ | 81 | Invention |
| 66 | $1.0 \times 10^{11}$ | $6.2 \times 10^{11}$ | $9.0 \times 10^{11}$ | 61 | Invention |
| 67 | $1.3 \times 10^{11}$ | $6.0 \times 10^{11}$ | $8.8 \times 10^{11}$ | 70 | Invention |
| 68 | $0.9 \times 10^{11}$ | $4.2 \times 10^{11}$ | $7.2 \times 10^{11}$ | 82 | Invention |
| 69 | $0.8 \times 10^{11}$ | $4.0 \times 10^{11}$ | $7.0 \times 10^{11}$ | 82 | Invention |
| 70 | $0.8 \times 10^{11}$ | $4.0 \times 10^{11}$ | $7.0 \times 10^{11}$ | 80 | Invention |
| g | $7.0 \times 10^{11}$ | $4.0 \times 10^{13}$ | $5.0 \times 10^{13}$ | 50 | Comparison |

TABLE 3-continued

| | | | | | |
|---|---|---|---|---|---|
| h | $6.0 \times 10^{11}$ | $5.0 \times 10^{12}$ | $3.7 \times 10^{12}$ | 62 | Comparison |

Notes:
I, II, and III: The same as the antistatic layer
IV: Consisting of $SnO_2$ and gelatin
V: Consisting of $ZnO_2$ and gelatin
VI: Consisting of $In_2O_3$ and gelatin As seen in Tables 2 and 3, when the electroconductive layer of the invention is used in a light-sensitive material consisting of a tabular silver halide emulsion layer or in a backing layer containing an antihalation dye, excellent antistatic property and abrasion resistance can be achieved. No adverse effect was observed on the photographic properties of these samples.

EXAMPLE 4

(1) Preparation of Monodispersed Grains

Using monodispersed silver iodobromide grains having an average grain size of 0.2 μm and a silver iodide content of 2.0 mol % as seed grain, silver iodobromide containing 30 mol % of silver iodide was grown at pH 9.8 and pAg 7.8. Then, molar equivalents of potassium bromide and silver nitrate were added thereto at pH 8.2 and pAg 9.1 so as to prepare silver iodobromide grains having an average silver iodide content of 2.2 mol %, and thereby monodispersed emulsion grains having average grain sizes of 0.375 μm ((1)-1), 0.64 μm ((1)-2) and 1.42 μm (1)-3) were obtained. The emulsions were subjected to desalination; that is, a formalin condensate of sodium naphthalene sulfonate and an aqueous solution of magnesium sulfate were added at 40° C. for flocculation, which was followed by decantation. Each of the resultant grains of three different sizes had a satisfactory dispersibilities of $S/\bar{r}<0.16$.

Further, an X-ray diffraction analysis proved that a localized portion containing more than 20 mol % of silver iodide was present inside each of these grains.

(2) Preparation of Tabular Grains

To 5.5 l of 1.5% gelatin solution containing 0.17 mol of potassium bromide were added a 2.1 mols solution of potassium bromide and a 2.0 mols solution of silver nitrate by the double-jet method over a period of 2 minutes while stirring at 80° C. and pH 5.9. pBr was maintained at 0.8 (0.53% of the total added amount of silver nitrate was consumed).

The addition of potassium bromide solution was stopped, while the addition of silver nitrate solution was continued for further 4.6 minutes (8.6% of the total added amount of silver nitrate was consumed). Then, both the potassium bromide solution and silver nitrate solution were simultaneously added over a period of 13 minutes. During the addition, pBr was maintained at 1.2, and the speed of addition was accelerated so as to finish the addition at a speed of 2.5 times as large as that at the start (43.6% of the total added amount of silver nitrate was consumed).

The addition of the potassium bromide solution was stopped, and the silver nitrate solution was continued to add for another 1 minute (4.7% of the total added amount of silver nitrate was consumed).

A mixed solution containing 0.55 mol of potassium iodide and 2.0 mols of potassium bromide was added to the emulsion together with the silver nitrate solution over a period of 13.3 minutes, while maintaining pBr at 1.7 and accelerating the addition speed so as to finish the addition at a speed of 1.5 times as large as that at the start (35.9% of the total added amount of silver nitrate was consumed). To the emulsion, 1.5 g/mol Ag of sodium thiocyanate was added, then the emulsion was allowed to stand for 25 minutes. A 0.60 mol solution of potassium bromide and molar equivalent of a silver nitrate solution were added by the double-jet method in 5 minutes till the pBr reached 3.0 (6.6% of the total added amount of silver nitrate was consumed). The amount of silver nitrate consumed from start to finish was about 11 mols. An emulsion containing tabular silver iodobromide grains having an average grain diameter of 1.62 μm and an aspect ratio of 16:1 was thus prepared. These tabular grains accounted for more than 80% of the total projection area of silver iodobromide grains. The resultant emulsion was referred to as tabular grains (2).

(3) Preparation of Multi-Dispersed Grains

| | | |
|---|---|---|
| Solution No. 1 | Water | 17 l |
| | KI | 126 g |
| | Gelatin | 210 g |
| Solution No. 2 | Water | 14 l |
| | KBr | 3.5 kg |
| | Glacial acetic acid | 0.35 l |
| Solution No. 3 | Water | 9.45 l |
| | $AgNO_3$ | 4.2 kg |
| | $NH_4OH$ (conc. aqueous ammonia) | 3.1 l |
| Solution No. 4 | $NaIrCl_6$ | 1.0 ml |
| | Water | 100 ml |

While stirring Solution 1 at 800 rpm at 46° C., 3% by volume of Solution 3 was added thereto at a constant speed over a period of 1 minute. After allowing the solution to stand for 1 minute, addition of the remnant of Solution 3 and Solution 2 was simultaneously started and continued at a constant speed. The addition of Solution 2 was completed over a period of 8 minutes, and that of Solution 3 in 14 minutes. 1 minute after completing the addition of Solution 3, Solution 4 was rapidly added and the emulsion was ripened for 2 minutes. Then, pH was adjusted to 6.0 with acetic acid. While Solutions 2 and 3 were added, pAg was varied from 11 to 10.5.

Next, the emulsion was subjected to desalination in the same manner as in the foregoing monodispersed emulsion, followed by addition of gelatin. Thus, 14.5 kg of an emulsion having a pH of 5.90 and a pAg of 8.71 was obtained. The average grain size ($\bar{r}$) was 0.51 μm, the dispersed of grain size ($S/\bar{r}$) was 0.24, and an electron-microscopic photography proved that the emulsion was a twinned crystal emulsion of which (111) faces accounted for more than 99%. The emulsion so prepared was referred to as multi-dispersed grains (3).

Preparation, Processing and Evaluation of Sample

To each of the resultant silver halide grains (1), (2) and (3) was added demineralized water to make the volume 500 ml per mol of silver and the temperature was raised to 55° C. Then, the following spectral sensitizing dyes A and B were added at a combination ratio of 200:1 by weight and in total amounts of 820 mg/mol AgX to (1)-1, 600 mg/mol AgX to (1)-2, 360 mg/mol AgX to (1)-3, 600 mg/mol AgX to (2), and 700 mg/mol AgX to (3).

10 minutes later, ammonium thiocyanate was added in amounts of $4\times10^{-3}$ mol/mol AgX to (1)-1, $2\times10^{-3}$ mol/mol AgX to (1)-2, $1\times10^{-3}$ mol/mol AgX to (1)-3, $2\times10^{-3}$ mol/mol AgX to (2), and $3\times10^{-3}$ mol/mol AgX to (3), further, proper amounts of chloroauric acid and hypo were added to each of the above to start chemical ripening, while keeping the pH at 6.15 and the silver potential at 50 mv.

15 minutes before the completion of chemical ripening (70 minutes later from the start of chemical ripening), 200 mg/mol AgX of potassium iodide was added. 5 minutes later, pH was lowered to 5.6 with the addition of 10% (wt/vol) acetic acid and this pH was maintained for 5 minutes. Next, pH was raised to 6.15 with 0.5% (wt/vol) potassium hydroxide solution, and then 4-hydroxy-6-methyl-1,3,3a,7-tetrazaindene was added thereto to terminate the chemical ripening.

The resultant grains (1)-1, (1)-2 and (1)-3 were mixed at a ratio of 15%: 50%: 35%, and the following additives were added thereto to obtain a monodispersed emulsion preparation (Emulsion 1). Likewise, these additives were respectively added to the tabular grains (2) and the multi-dispersed grains (3) to obtain a tabular emulsion preparation (Emulsion 2) and a multi-dispersed emulsion preparation (Emulsion 3).

In preparing coating emulsions, there were added, in addition to the following additives, dispersion (a) consisting of 0.12 μm diameter oily droplets containing the following compounds (1), (2) and (3) and dispersion (b) consisting of 0.09 μm diameter oily droplets containing the compounds (2), (3) and (4) in the following amounts per mol of silver halide.

Dispersion (a)

(1) 300 mg

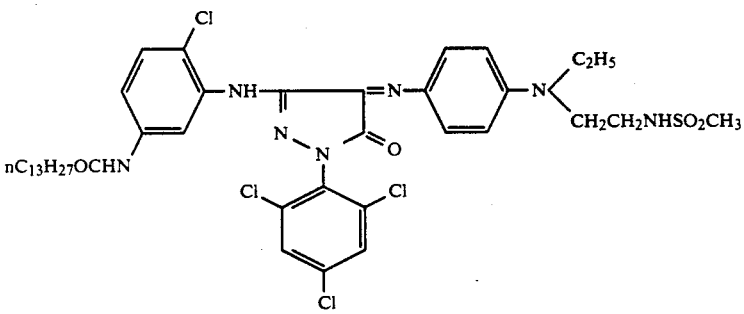

(2) Tricresol phosphate 0.6 g (3) 180 mg

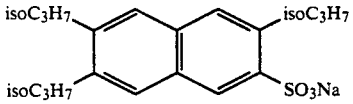

Dispersion (b)

(4) 400 mg

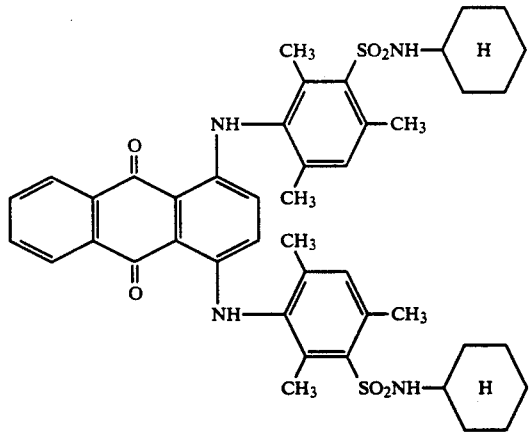

(2) 1.5 g (3) 210 mg

Dispersion (a) was prepared by the method described in item (3) of Example 1 in Japanese Patent O.P.I. Publication No. 285445/1986, and Dispersion (b) by the method described on page 35 from the 15 line downward of Japanese Patent O.P.I. Publication No. 243654/1985.

Spectral sensitizing dye A

-continued

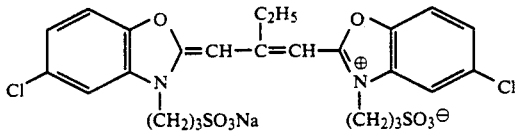

Spectral sensitizing dye B

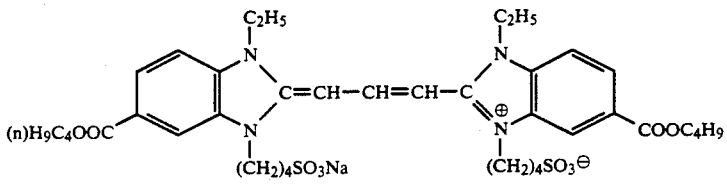

The additives used in the coating emulsions (light-sensitive silver halide coating solutions) were as follows. Amounts of addition are per mol of silver halide.

| | |
|---|---|
| 1,1-dimethylol-1-bromo-1-nitromethane | 65 mg |
| 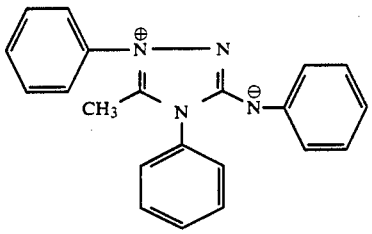 | 150 mg |
| t-butyl catechol | 400 mg |
| Polyvinylpyrrolidone (molecular weight: 10,000) | 1.0 g |
| Styrene-maleic anhydride copolymer | 2.5 g |
| Nitrophenyl-triphenyl phosphonium chloride | 50 mg |
| Ammonium 1,3-hydroxybenzene-4-fulfonate | 4 g |
| Sodium 2-mercaptobenzimidazole-5-sulfonate | 1.5 mg |
| 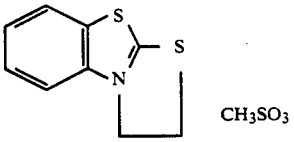 | 70 mg |
| 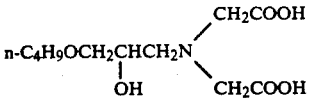 | 1 g |
| Polyhydric alcohol of the invention an amount shown in Table 2-2 | |
| 1-Ephenyl-5-mercaptotetrazole | 50 mg |

The additives used in the coating solution for protective layer were as follows. Amounts of addition are per liter of the solution.

| | |
|---|---|
| Lime-treated gelatin | 68 g |
| Acid-treated gelatin | 2 g |
| 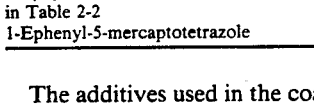 | 1 g |
| Polymethylmethacrylate (matting agent having an areal average grain size of 3.5 μm) | 1.1 g |

-continued

| | |
|---|---|
| Silicon dioxide particles (matting agent having an areal average grain size of 1.2 μm) | 0.5 g |
| LUDOX AM (colloidal silica made by Du pont) | 30 g |
| 2% aqueous solution of sodium 2,4-dichloro-6-hydroxy-1,3,5-triazine (hardener) | 10 ml |
| 40% aqueous solution of glyoxal (hardener) | 1.5 ml |
| 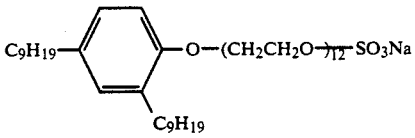 | 1.0 g |
| 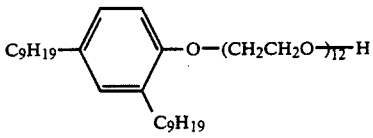 | 2 mg |
| $C_4F_9SO_3K$ | 0.5 g |
| $C_{12}H_{25}CONH(CH_2CH_2O)_5H$ | |

Coating was performed so as to provide an emulsion layer having an coating weight of 1.48 g/m$^2$ in terms of silver and that of 1.98 g/m$^2$ in terms of hydrophilic colloid and a protective layer having a gelatin coating weight of 0.99 g/m$^2$, at a speed of 60 m/min with two slide hopper type coaters, on one side of a 175 μm thick polyethylene terephthalate film base subbed with a 10% aqueous dispersion of a copolymer made from 50 wt % of glycidyl methacrylate, 10 wt % of methyl acrylate and 40 wt % of butyl methacrylate.

A film base coated with the electroconductive layer of the invention was prepared in the following manner.

A 175 μm thick polyethylene terephthalate base subbed with the foregoing copolymer dispersion was subjected to corona discharge; then, an antistatic coating solution of the following composition was coated thereon to 10 ml/m$^2$ at a speed of 33 m/min with a roll fit coating pan and an air knife.

| | |
|---|---|
| (1) Water-soluble electroconductive polymer (shown in Table 2-1) | 0.6 g/m$^2$ |
| (2) Hydrophobic polymer particles (shown in Table 2-1) | 0.4 g/m$^2$ |
| (3) Hardener (shown in Table 2-1) | 0.15 g/m$^2$ |
| Plasticizer | 0.10 g/m$^2$ |

-continued (shown in Table 2-1)

After coating, the film base was dried at 90° C. for 2 minutes and heat-treated at 140° C. for 90 seconds.

TABLE 2-1

| Base No. | Water-soluble electroconductive polymer (1) | Hydrophobic polymer particles (2) | Hardener (3) | Plasticizer | Remarks |
|---|---|---|---|---|---|
| 0 | — | — | — | — | Comparison |
| 1 | Exemplified P-6 | Exemplified L-1 | Exemplified A-7 | — | Invention |
| 2 | Exemplified P-6 | Exemplified L-7 | Exemplified A-7 | — | Invention |
| 3 | Exemplified P-4 | Exemplified L-1 | Exemplified A-7 | — | Invention |
| 4 | Exemplified P-4 | Exemplified L-4 | Exemplified A-7 | — | Invention |
| 5 | Exemplified P-9 | Exemplified L-9 | Exemplified A-7 | — | Invention |
| 6 | Exemplified P-6 | Exemplified L-6 | Exemplified A-7 | Exemplified 2 | Invention |
| 7 | Exemplified P-6 | Exemplified L-6 | Exemplified A-7 | Exemplified 3 | Invention |
| 8 | Exemplified P-6 | Exemplified L-6 | Exemplified A-7 | Exemplified 6 | Invention |
| 9 | Exemplified P-6 | Exemplified L-6 | Exemplified A-7 | Exemplified 9 | Invention |
| 10 | Exemplified P-6 | Exemplified L-6 | Exemplified A-7 | Exemplified 10 | Invention |

Measurement of Relative Sensitivity

A resultant sample was sandwiched between fluorescent intensifying screens (KO-250, sold by Konica Corp.) and subjected to X-ray irradiation for 0.05 second at a lamp voltage of 90 KVP, 20 mA. Then, a sensitometry characteristic curve was made by the distance method. Development was performed in a developer XD-90 for 90 seconds with an automatic developer model KK-500 made by Konica Corp. The fogging value and sensitivity were evaluated on each sample.

The sensitivity was defined by a reciprocal of an exposure necessary for increasing a black density by 1.0 and shown by a value relative to the sensitivity of Sample 1 in Table 2—2 which was set at 100.

Pressure Resistance Test

Two sheets each of the restant samples were kept in a thermohygrostat at 25° C. and 35% RH for 12 hours, and then bent under this condition to about 280° with a radius of curvature of 0.5 cm. 3 minutes later the bending, one of the two sheets was developed without exposure. The difference between a density of a black portion caused by bending and a fog density, $\Delta D_1$, is used as the criterion for judging pressure blacking; that is, a smaller value means a better pressure blacking resistance.

The other one of the two sheets was exposed through an optical wedge 3 minutes later the bending and developed. Black densities of respective wedges were measured on this sample, and the difference in density between a desensitized portion caused by the bending on the portion of density 1.0 ±0.1 and a portion where no bending was performed was defined as $\Delta D_2$. Then, $\Delta D_2$ was divided by each density $D_2$, and a mean value of $\Delta D_2/D_2$ was used as the criterion for judging pressure desensitization. A smaller value means a better resistance to pressure desensitization.

Static Mark Generation Test

A sample was conditioned at 23° C. and 20% RH for 2 hours in a dark room, and then rubbed with a neoprene roller. After developing the sample with the automatic developing machine in the foregoing manner, generation of static marks was visually observed.

Measurement of Surface Specific Resistance

A developed sample was placed between a pair of brazen electrodes (electrode interval: 0.14 cm, length: 10 cm), and subjected to measurement for 1 minute with a resistance meter model TR-8651 made by Takeda Riken Kogyo. Prior to measurement, the sample was conditioned at 23° C. and 20% RH for 3 hours.

The evaluation results are summarized in Table 2—2.

TABLE 2-2

| Sample No. | No. of emulsion used | No. of base used | Polyhydric alcohol Exemplified No. | Polyhydric alcohol (g/mol AgX) | Photographic properties Fogging | Photographic properties Sensitivity | Pressure resistance $\Delta D_1$ | Pressure resistance $\Delta D_1/D_2$ | Antistatic property Static marks | Antistatic property Surface specific resistance after processing (Ω) | Remarks |
|---|---|---|---|---|---|---|---|---|---|---|---|
| 1 | 3 | 0 | — | 0 | 0.10 | 100 | 0.21 | 0.13 | Observed | $8 \times 10^{12}$ | Comparison |
| 2 | 1 | 0 | — | 0 | 0.07 | 124 | 0.12 | 0.18 | Observed | $8 \times 10^{12}$ | Comparison |
| 3 | 2 | 0 | — | 0 | 0.08 | 120 | 0.38 | 0.06 | Observed | $8 \times 10^{12}$ | Comparison |
| 4 | 3 | 1 | — | 0 | 0.15 | 100 | 0.27 | 0.17 | Not observed | $7 \times 10^{11}$ | Comparison |
| 5 | 1 | 1 | — | 0 | 0.14 | 124 | 0.15 | 0.22 | Not observed | $7 \times 10^{11}$ | Comparison |
| 6 | 2 | 1 | — | 0 | 0.15 | 120 | 0.44 | 0.08 | Not observed | $7 \times 10^{11}$ | Comparison |
| 7 | 3 | 0 | 1-1 | 14 | 0.07 | 98 | 0.17 | 0.11 | Observed | $1.8 \times 10^{12}$ | Comparison |
| 8 | 1 | 0 | 1-1 | 14 | 0.05 | 123 | 0.08 | 0.13 | Observed | $1.7 \times 10^{12}$ | Comparison |
| 9 | 2 | 0 | 1-1 | 14 | 0.06 | 118 | 0.25 | 0.04 | Observed | $1.9 \times 10^{12}$ | Comparison |

TABLE 2-2-continued

| Sample No. | No. of emulsion used | No. of base used | Polyhydric alcohol Exemplified No. | Polyhydric alcohol (g/mol AgX) | Photographic properties Fogging | Photographic properties Sensitivity | Pressure resistance $\Delta D_1$ | Pressure resistance $\Delta D_1/D_2$ | Antistatic property Static marks | Antistatic property Surface specific resistance after processing (Ω) | Remarks |
|---|---|---|---|---|---|---|---|---|---|---|---|
| 10 | 3 | 1 | 1-1 | 14 | 0.06 | 98 | 0.14 | 0.10 | Not observed | $1.5 \times 10^{11}$ | Invention |
| 11 | 1 | 1 | 1-1 | 14 | 0.04 | 123 | 0.07 | 0.10 | Not observed | $1.6 \times 10^{11}$ | Invention |
| 12 | 2 | 1 | 1-1 | 14 | 0.05 | 119 | 0.23 | 0.03 | Not observed | $1.6 \times 10^{11}$ | Invention |
| 13 | 3 | 4 | 1-2 | 16 | 0.06 | 100 | 0.15 | 0.10 | Not observed | $2.0 \times 10^{11}$ | Invention |
| 14 | 1 | 4 | 1-2 | 16 | 0.04 | 125 | 0.07 | 0.10 | Not observed | $2.0 \times 10^{11}$ | Invention |
| 15 | 2 | 4 | 1-2 | 16 | 0.05 | 120 | 0.24 | 0.04 | Not observed | $1.9 \times 10^{11}$ | Invention |
| 16 | 1 | 2 | 1-5 | 17 | 0.04 | 123 | 0.07 | 0.11 | Not observed | $1.4 \times 10^{11}$ | Invention |
| 17 | 1 | 3 | 1-5 | 17 | 0.04 | 124 | 0.06 | 0.10 | Not observed | $2.3 \times 10^{11}$ | Invention |
| 18 | 1 | 5 | 1-5 | 17 | 0.04 | 124 | 0.07 | 0.11 | Not observed | $2.5 \times 10^{11}$ | Invention |
| 19 | 1 | 6 | 1-5 | 17 | 0.04 | 123 | 0.07 | 0.11 | Not observed | $2.1 \times 10^{11}$ | Invention |
| 20 | 1 | 7 | 1-5 | 17 | 0.04 | 124 | 0.06 | 0.11 | Not observed | $2.4 \times 10^{11}$ | Invention |
| 21 | 1 | 8 | 1-5 | 17 | 0.04 | 123 | 0.06 | 0.11 | Not observed | $2.2 \times 10^{11}$ | Invention |
| 22 | 1 | 9 | 1-5 | 17 | 0.04 | 124 | 0.07 | 0.10 | Not observed | $2.0 \times 10^{11}$ | Invention |
| 23 | 1 | 10 | 1-5 | 17 | 0.04 | 124 | 0.07 | 0.11 | Not observed | $2.6 \times 10^{11}$ | Invention |
| 24 | 2 | 5 | 1-3 | 18 | 0.06 | 120 | 0.06 | 0.03 | Not observed | $2.4 \times 10^{11}$ | Invention |
| 25 | 2 | 5 | 1-8 | 20 | 0.06 | 119 | 0.07 | 0.03 | Not observed | $2.6 \times 10^{11}$ | Invention |
| 26 | 2 | 5 | 1-8 | 20 | 0.08 | 98 | 0.15 | 0.09 | Not observed | $2.3 \times 10^{11}$ | Invention |
| 27 | 3 | 9 | 1-8 | 20 | 0.08 | 99 | 0.15 | 0.09 | Not observed | $2.2 \times 10^{11}$ | Invention |
| 28 | 1 | 3 | 1-22 | 15 | 0.04 | 124 | 0.04 | 0.08 | Not observed | $2.2 \times 10^{11}$ | Invention |
| 29 | 1 | 4 | — | — | 0.15 | 123 | 0.15 | 0.23 | Not observed | $8.5 \times 10^{11}$ | Comparison |
| 30 | 2 | 5 | — | — | 0.15 | 119 | 0.45 | 0.07 | Not observed | $9.5 \times 10^{11}$ | Comparison |
| 31 | 3 | 8 | — | — | 0.16 | 99 | 0.28 | 0.17 | Not observed | $9.0 \times 10^{11}$ | Comparison |
| 32 | 1 | 1 | 1-1 | 14 | 0.03 | 128 | 0.06 | 0.09 | Not observed | $1.8 \times 10^{11}$ | Invention |

As shown in Table 2—2, the samples of the invention were less liable to cause sensitivity deterioration and fog, in addition to excellent pressure resistance. Such effects of the present invention are much more heightened when a monodispersed emulsion (1) having an internal high iodine portion or a tabular grain emulsion (2) is used rather the use of a multi-dispersed emulsion (3).

Further, no static marks were observed on the samples of the invention; antistatic property after processing was also excellent.

Sample 32, which was prepared in the same manner as in Sample 11 except that the following VS-1 was used as a hardener in the protective layer, had good photographic properties, pressure resistance and antistatic property.

VS-1

$$H_2C{=}CHSO_2CH_2OCH_2SO_2CH{=}CH_2$$

EXAMPLE 5

(4) Preparation of Monodispersed Grains

A silver iodobromide layer having an iodine-to-bromine molar ratio of 4:6 was grown to a grain size of 0.45 μm outside of a monodispersed silver chloroiodide inner nucleus having an average grain size of 0.18 μm and an iodine-to-bromine molar ratio of 10:1. Then, a silver iodobromide layer having an iodine-to-bromine molar ratio of 1:99 to 0.69 μm. The resultant silver halide grains were slightly rounded tetradecahedrons.

The grains were then desalinated in the same way as in the monodispersed emulsion in Example 1.

The dispersed was $s/\bar{r}<0.16$, showing a good monodispersed. An X-ray diffraction proved that the grains possessed internally a localized portion containing more than 20 mol % of silver iodide.

(5) Preparation of Tabular Grains

To 1 l of water was added 12 ml of an aqueous solution containing 32 g of gelatin, 11.0 g of potassium bromide and 0.5% of thioether $(HO(CH_2)_2S(CH_2)_2S(CH_2)_2OH)$. While maintaining the solution at 65° C., pAg 9.2 and pH 6.6, the total amounts of Solutions I and II shown in Table 2-3 were simultaneously added under stirring over a period of 40 seconds. Next, the total amount of Solution III shown in Table 2-3 was added thereto over a period of 8 minutes; then, the total amounts of Solutions IV and V shown in Table 2-3 were simultaneously added by the double-jet method over a period of 80 minutes to prepare silver halide grains.

TABLE 2-3

| Additive | Solution I | Solution II | Solution III | Solution IV | Solution V |
|---|---|---|---|---|---|
| $AgNO_3$ (g) | 7.0 | — | — | 92 | — |
| $H_2O$ (g) | 18 | 18 | 60 | 540 | 500 |
| KBr (g) | — | 3.3 | — | — | 66 |
| KI (g) | — | — | 1.5 | — | 0.4 |
| 3% aq. sol. of the above thioether (g) | — | 0.6 | — | — | 1.0 |

The resultant silver halide grains had an average diameter of 1.27 μm and an average diameter/thickness ratio of 5.1.

(6) Preparation of Multi-Dispersed Grains

A multi-dispersed emulsion for comparison was prepared by the normal mixing method.

| | | |
|---|---|---|
| Solution A: | nitric acid | 100 g |
| | aqueous ammonia (28%) | 78 ml |
| | water to make | 240 ml |
| Solution B: | ossein gelatin | 8 g |
| | potassium bromide | 80 g |
| | potassium iodide | 2.2 g |
| | water to make | 550 ml |
| Solution C: | aqueous ammonia | 6 ml |
| | glacial acetic acid | 10 ml |
| | water to make | 34 ml |
| Solution D: | glacial acetic acid | 226 ml |
| | water to make | 400 ml |

The above four solutions A through D were first prepared.

The samples were evaluated in the same manner as in Example 4, the results are shown in Table 2-4.

TABLE 2-4

| Sample No. | No. of emulsion used | No. of base used | Polyhydric alcohol Exemplified No. | Polyhydric alcohol (g/mol AgX) | Photographic properties Fogging | Photographic properties Sensitivity | Pressure resistance $\Delta D_1$ | Pressure resistance $\Delta D_1/D_2$ | Antistatic property Static marks | Antistatic property Surface specific resistance after processing (Ω) | Remarks |
|---|---|---|---|---|---|---|---|---|---|---|---|
| 33 | 6 | 0 | — | 0 | 0.12 | 110 | 0.24 | 0.15 | Observed | $7 \times 10^{12}$ | Comparison |
| 34 | 4 | 0 | — | 0 | 0.08 | 125 | 0.13 | 0.20 | Observed | $7 \times 10^{12}$ | Comparison |
| 35 | 5 | 0 | — | 0 | 0.08 | 126 | 0.32 | 0.09 | Observed | $7 \times 10^{12}$ | Comparison |
| 36 | 6 | 1 | — | 0 | 0.16 | 110 | 0.29 | 0.18 | Not observed | $6.5 \times 10^{11}$ | Comparison |
| 37 | 4 | 1 | — | 0 | 0.11 | 124 | 0.17 | 0.24 | Not observed | $6.5 \times 10^{11}$ | Comparison |
| 38 | 5 | 1 | — | 0 | 0.19 | 125 | 0.36 | 0.11 | Not observed | $6.5 \times 10^{11}$ | Comparison |
| 39 | 6 | 0 | 1-1 | 14 | 0.08 | 109 | 0.19 | 0.13 | Observed | $1.9 \times 10^{12}$ | Comparison |
| 40 | 4 | 0 | 1-1 | 14 | 0.06 | 124 | 0.10 | 0.15 | Observed | $1.7 \times 10^{12}$ | Comparison |
| 41 | 5 | 0 | 1-1 | 14 | 0.07 | 125 | 0.22 | 0.06 | Observed | $1.8 \times 10^{12}$ | Comparison |
| 42 | 6 | 1 | 1-1 | 14 | 0.08 | 108 | 0.17 | 0.09 | Not observed | $1.4 \times 10^{11}$ | Invention |
| 43 | 4 | 1 | 1-1 | 14 | 0.04 | 124 | 0.08 | 0.13 | Not observed | $1.4 \times 10^{11}$ | Invention |
| 44 | 5 | 1 | 1-1 | 14 | 0.05 | 125 | 0.18 | 0.04 | Not observed | $1.4 \times 10^{11}$ | Invention |
| 45 | 6 | 4 | 1-2 | 16 | 0.07 | 110 | 0.18 | 0.10 | Not observed | $1.7 \times 10^{11}$ | Invention |
| 46 | 4 | 4 | 1-2 | 16 | 0.04 | 126 | 0.08 | 0.12 | Not observed | $1.7 \times 10^{11}$ | Invention |
| 47 | 5 | 4 | 1-2 | 16 | 0.05 | 125 | 0.19 | 0.05 | Not observed | $1.8 \times 10^{11}$ | Invention |

Next, Solutions B and C were poured into a reaction vessel for emulsion preparation and stirred at 300 rpm with a propeller stirrer at 45° C. Then, 100 ml of Solution A was added thereto over a period of 2 minutes. After stirring for 8 minutes, the remaining 200 ml of Solution A was added in 2 minutes and stirring was continued for 15 minutes. Then, Solution D was poured into the mixture of Solutions A, B and C, and the pH was adjusted to 6 to terminate the reaction. Thus, a multi-dispersed emulsion for comparison having an average grain size of 0.71 μm was prepared.

Preparation, Processing and Evaluation of Sample

To each of the above silver halide grains (4), (5) and (6) was added demineralized water so as to make the volume 500 ml per mol of silver, and then temperature was raised to 55° C. Next, the foregoing spectral sensitizing dyes A and B were added at an A-to-B weight ratio of 200:1 in amounts of 500 mg/mol AgX to (4), 500 mg/mol AgX to the tabular grains (5) and 500 mg/mol AgX to the multi-dispersed grains (6).

Ten minutes later, ammonium thiocyanate was added in amounts of $1.8 \times 10^{-3}$ mol/mol Ag to (4), $1.8 \times 10^{-3}$ mol/mol Ag to (5) and $2.5 \times 10^{-3}$ mol/mol Ag to (4); further, proper amounts of chloroauric acid and hypo were added to each of them to initiate chemical ripening. The pH and silver potential during the ripening were 5.95 and 60 mv, respectively. Then, the same additives as in Example 4 were added to them to obtain coating emulsions.

A coating solution for the protective layer was also the same as that in Example 4.

Coating was carried out so as to provide an emulsion layer having an coating weight of 1.51 g/m$^2$ as converted amount into silver and that of 2.02 g/m$^2$ in terms of hydrophilic colloid and a protective layer having a gelatin coating weight of 1.02 g/m$^2$, at a speed of 60 m/min with two slide hopper type coaters, on one side of a 175 μm thick polyethylene terephthalate film base subbed with a 10% aqueous dispersion of a copolymer made from 50 wt % of glycidyl methacrylate, 10 wt % of methyl acrylate and 40 wt % of butyl methacrylate.

As film bases coated with the electroconductive layer of the invention, those which are shown in Table 2-4 were used.

As seen in Table 2-4, the use of a silver halide monodispersed grain emulsion containing an internal silver iodide rich portion (Sample 4) or a tabular grain emulsion having a diameter-thickness ratio (Sample 5) is more effective in achieving the objects of the invention than the use of a multi-dispersed grain emulsion for comparison (Sample 6).

EXAMPLE 6

Preparation of Tabular Grain Emulsion A

While maintaining a solution consisting of 1 l of water, 5 g of potassium bromide, 0.05 g of potassium iodide, 30 g of gelatin, 2.5 ml of 5% aqueous solution of thioether $HO(CH_2)_2S(CH_2)_2S(CH_2)_2$ at 70° C., an aqueous solution containing 8.33 g of silver nitrate and an aqueous solution containing 5.94 g of potassium bromide and 0.726 g of potassium iodide were added thereto by the double-jet method under stirring in 60 seconds. After adding 2.5 g of potassium bromide, an aqueous solution containing 8.33 g of silver nitrate was added over a period of 7.5 minutes so as to double the flow rate from start to finish. Then, an aqueous solution of silver nitrate and that of potassium bromide were added by the controlled double-jet method while maintaining the potential at pAg 8.1. In the course of the addition, the flow rate was accelerated so as to be 8 times that of the start at the end of addition. After the addition, 15 ml of 2N potassium thiocyanate solution was added, and then 50 ml of 1% potassium iodide aqueous solution was added in 30 seconds. Next, the temperature was lowered to 35° C., and soluble salts were removed by the flocculation method. After raising the temperature to 45° C., 68 g of gelatin and 2 g of phenol were added; then, the pH and pAg were adjusted to 6.40 and 8.45 respectively with the addition of sodium hydroxide and potassium bromide.

The emulsion so prepared consisted of grains having an average projection area diameter of 0.43 μm, average thickness of 0.096 μm and aspect ratio of 4.48.

Preparation of Tabular Grain Emulsion B

According to the method of emulsion A, a tabular grain emulsion B was prepared. The emulsion consisted of grains having an average projection area diameter of 0.83 μm, average thickness of 0.161 μm and aspect ratio of 5.16.

Then, each of the emulsions A and B were subjected to chemical sensitization, or gold-sulfur sensitization by adding $1.8\times10^{-3}$ mol/mol AgX of ammonium thiocyanate and proper amounts of chloroauric acid and hypo. After that, 4-hydroxy-6-methyl-1,3,3a,7-tetrazaindene was added thereto, and then spectral sensitization was performed by adding $8\times10^{-4}$ mol/mol AgX of potassium iodide and the following spectral sensitizing dyes (1) and (2) in amounts of 300 mg/mol AgX and 5 mg/mol AgX respectively.

Sensitizing dye (1)

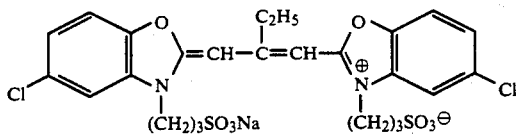

Sensitizing dye (2)

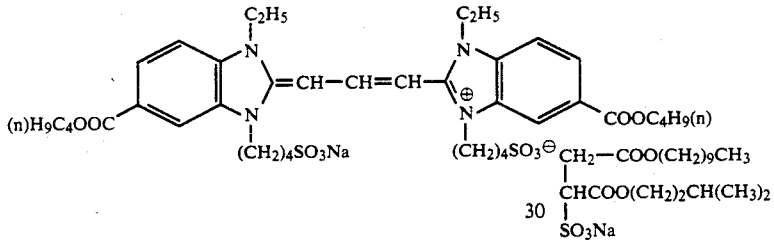

Next, the two emulsions A and B were mixed at a ratio of 30% : 70%; then the following additives and lime-treated gelatin were added thereto to obtain a coating emulsion.

The additives used in the coating emulsion are as follows. Amounts as per mol of silver halide.

| | |
|---|---|
| t-butyl catechol | 400 mg |
| Polyvinylpyrrolidone (molecular weight: 10,000) | 1.0 g |
| Trimethylol propane | 10 g |
| Diethylene glycol | 5 g |
| Nitrophenyl-triphenyl phophonium chloride | 50 mg |
| Ammonium 1,3-dihydroxybenzene-4-sulfonate | 4 mg |
| Sodium 2-mercaptobenzimidazole-5-sulfonate | 15 mg |
| 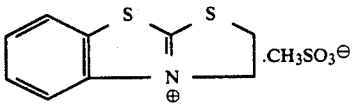 | 70 mg |
| 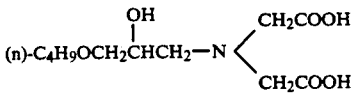 | 1 g |
| 1,1-dimethylol-1-bromo-1-nitromethane | 10 mg |
| Styrene-maleic anhydride copolymer | 2.5 g |
| 1-phenyl-5-mercaptotetrazole | 1 mg |

The following compounds were added to the protective layer. Amounts are per gram of gelatin.

| | |
|---|---|
| 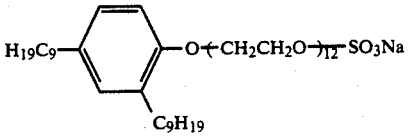 | 10 mg |

-continued

| | |
|---|---|
| 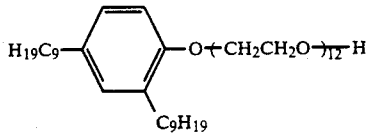 | 2 mg |
| | 7 mg |
|  | |
| $C_9F_{19}$—O—$(CH_2CH_2O)_{10}CH_2CH_2OH$ | 2 mg |
| $C_8F_{17}SO_3K$ | 3 mg |
| 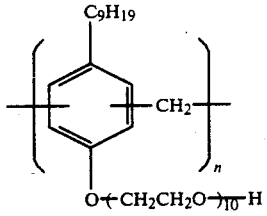 | 15 mg |
| Polymethylmethacrylate with an average particle size of 5 μm (matting agent) | 7 mg |
| Colloidal silica (average particle size: 0.013 μm) | 70 mg |
| 40% aqueous solution of glyoxal | 0.07 ml |
| 2% aqueous solution of 2,4-dichloro-6-hydroxy-1,3,5-triazine | 10 ml |

After subjecting a 180 μm thick polyethylene terephthalate support to biaxial orientation heat setting on both sides, corona treatment was performed. Then, the support was subbed with the latex of synthesis (1) described in Example 1 of Japanese Patent O.P.I. Publication No. 18945/1984, and then subjected to corona discharge again.

Next, an electroconductive layer consisting of a dye-polymer dispersion of the invention was coated on the support at a speed of 30 m/min so as to give a coating weight shown in Table 3-1 with a roll fit coating pan and an air knife; then, the film was subjected to corona treatment again.

On both sides of the resultant support were coated the above silver halide coating emulsion and coating solution for protective layer. Total coating weights on both sides were 6.0 g/m² for gelatin and 4.0 g/m² for silver.

The dispersion of dye and hydrophobic polymer used in this example was prepared in the following manner. (Preparation of dye-polymer dispersion)

One part of a dye and 2 parts of a hydrophobic polymer were added under stirring to 8.1 parts of ethyl acetate which was maintained at 60° C. This dispersion was added under stirring to a mixed solution of 12.6 parts of 10% gelatin solution and 0.3 part of 10% triisopropylnaphthalene sulfonate solution, which was kept at 55° C. The resultant dispersion was passed through a colloid mill five times, so that dye-polymer mixed particles having an average particle size below 5 μm were obtained. After cooling the dispersion, it was divided into small portions and dried. A dye-polymer dispersion with an area mean particle size ranging from 0.08 μm to 0.10 μm was obtained. At the use, the dispersion was dipped in water and mechanically stirred for reproduction.

The comparative samples shown in Table 3-1 were prepared by the following procedure.

On a 180 μm thick subbed polyethylene terephthalate film support were coated the foregoing coating emulsion and coating solution for protective layer; then, a layer containing a dye emulsion in an amount shown in Table 3-1 was formed thereon. The dye emulsion was prepared in the following manner.

10 kg each of the dyes shown in Table 3-1 was weighed out and dissolved at 55° C. in a solvent consisting of 12 l of tricresol phosphate and 85 l of ethyl acetate. This is referred to as an oil-based solution.

On the other hand, 1.35 kg of the following anionic surfactant AS was dissolved at 45° C. 270 ml of 9.3% aqueous gelatin solution was prepared. This is referred to as a water-based solution.

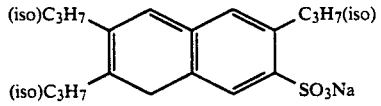

AS

The above oil-based and water-based solutions were poured into a dispersing vessel and maintained at 40° C. Next, the pressure inside the vessel was gradually reduced from 760 mmHg to 100 mmHg over a period of 60 minutes while rotating a high speed propeller for dispersion at 6,500 rpm, then dispersing was continued for another 20 minutes at this condition.

To the dispersion so prepared were added the following additives and water to make up to 240 kg. Then, it was cooled and solidified.

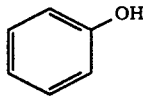

2.5% aqueous solution 16 l

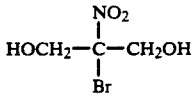

8 g

All area mean particle sizes of the resultant dispersion were within a range of 0.08 to 0.10 μm.

The light-sensitive samples so prepared were evaluated for surface specific resistance and tone of images. (Measurement of surface specific resistance)

A sample was put between a pair of brazen electrodes (electrode interval: 0.14 cm, length: 10 cm), and subjected to measurement for 1 minute with a resistance meter model TR-8651 made by Takeda Riken Kogyo. Before the measurement, the sample was conditioned at 25° C. and 20% RH for 2 hours. The results are summarized in Table 3-1.

Evaluation of Image Tone

Each sample was photographed with X-ray and developed, then, the tone of image silver was evaluated as follows:

A chest phantom was photographed on a sample using a fluorescent intensifying screen KO-250 made by Konica Corp. at a lamp voltage of 90 KVp. After photographing, the sample was processed in a developer XD-SR made by Konica Corp. for 90 seconds with an automatic developing machine model SPX-501 made by the same company.

The photograph sample was subjected to standing at 50° C., 80% RH for 7 days; then, the tone of image silver under transmitted light was visually observed on a viewer. The evaluation criterion was as follows:

1: yellowish black
2: slightly yellowish black
3: reddish black
4: slightly reddish black
5: pure black no good ↑ ↓ good The evaluation results are shown in Table 3-1.

TABLE 3-1

| | Water-soluble electroconductive polymer (1) | | Dye-polymer dispersion | | | | | |
|---|---|---|---|---|---|---|---|---|
| | | | Hydrophobic polymer (2) | | Magenta dye | | Cyan dye | |
| Sample No. | Exemplified No. | (g/m²) | Exemplified No. | (g/m²) | Exemplified No. | (mg/mol AgX) | Exemplified No. | (mg/mol AgX) |
| 1 | P-1 | 0.6 | L-1 | 0.4 | A-1 | 300 | B-1 | 350 |
| 2 | P-1 | 0.6 | L-1 | 0.4 | A-1 | 300 | B-1 | 500 |
| 3 | P-1 | 0.6 | L-1 | 0.4 | A-5 | 400 | B-1 | 300 |
| 4 | P-3 | 0.6 | L-1 | 0.5 | A-5 | 600 | B-7 | 200 |
| 5 | P-3 | 0.6 | L-4 | 0.5 | A-12 | 300 | B-7 | 350 |
| 6 | P-3 | 0.6 | L-4 | 0.5 | A-20 | 350 | B-12 | 350 |
| 7 | P-5 | 0.6 | L-4 | 0.5 | A-20 | 200 | B-12 | 600 |
| 8 | P-5 | 0.6 | L-4 | 0.4 | A-20 | 350 | B-19 | 350 |
| 9 | P-5 | 0.6 | L-6 | 0.4 | A-17 | 600 | B-26 | 350 |
| 10 | P-5 | 0.6 | L-6 | 0.3 | A-4 | 350 | B-26 | 350 |
| 11 | P-9 | 0.6 | L-6 | 0.3 | A-4 | 350 | B-36 | 350 |
| 12 | P-9 | 0.6 | L-1 | 0.3 | A-8 | 200 | B-36 | 200 |
| 13 | P-9 | 0.6 | L-1 | 0.3 | A-8 | 200 | B-36 | 200 |
| 14 | — | — | — | — | — | — | — | — |

TABLE 3-1-continued

| | | | | | | | | |
|---|---|---|---|---|---|---|---|---|
| 15 | P-9 | 0.6 | L-1 | 0.3 | — | — | — | — |

| Sample No. | Hardener (3) Exemplified No. | Hardener (3) (mol/dm²) | Dye dispersion (for comparison) Exemplified No. | Dye dispersion (for comparison) (mg/mol AgX) | Surface specific resistance (Ω) | Tone rank | Remarks |
|---|---|---|---|---|---|---|---|
| 1 | 1-1 | $2.5 \times 10^{-3}$ | — | — | $2.0 \times 10^{11}$ | 5 | Invention |
| 2 | 1-1 | $2.5 \times 10^{-3}$ | — | — | $2.2 \times 10^{11}$ | 5 | Invention |
| 3 | 3-9 | $2.5 \times 10^{-3}$ | — | — | $2.3 \times 10^{11}$ | 4 | Invention |
| 4 | 3-9 | $2.5 \times 10^{-3}$ | — | — | $2.3 \times 10^{11}$ | 3 | Invention |
| 5 | 3-9 | $4.0 \times 10^{-3}$ | — | — | $2.3 \times 10^{11}$ | 4 | Invention |
| 6 | 3-9 | $4.0 \times 10^{-3}$ | — | — | $2.3 \times 10^{11}$ | 5 | Invention |
| 7 | 6-4 | $4.0 \times 10^{-3}$ | — | — | $2.0 \times 10^{11}$ | 5 | Invention |
| 8 | 6-4 | $4.0 \times 10^{-3}$ | — | — | $2.0 \times 10^{11}$ | 5 | Invention |
| 9 | 6-4 | $3.0 \times 10^{-3}$ | — | — | $2.0 \times 10^{11}$ | 5 | Invention |
| 10 | 7-1 | $3.0 \times 10^{-3}$ | A-3 + B-1 | 350 + 300 | $2.0 \times 10^{11}$ | 5 | Invention |
| 11 | 2-5 | $3.0 \times 10^{-3}$ | — | — | $2.0 \times 10^{11}$ | 5 | Invention |
| 12 | 2-5 | $3.0 \times 10^{-3}$ | — | — | $2.2 \times 10^{11}$ | 3 | Invention |
| 13 | 2-5 | $3.0 \times 10^{-3}$ | — | — | $2.2 \times 10^{11}$ | 4 | Invention |
| 14 | — | $3.0 \times 10^{-3}$ | A-2 + B-1 | 350 + 30 | $6.0 \times 10^{11}$ | 1 | Comparison |
| 15 | 2-5 | $3.0 \times 10^{-3}$ | A-2 + B-4 | 350 + 300 | $4.0 \times 10^{11}$ | 1 | Comparison |

EXAMPLE 7

Silver iodobromide containing 30 mol % of silver iodide was grown at pH 9.3 and pAg 7.5 on silver iodobromide monodispersed seed grains having an average grain size of 0.2 μm and a silver iodide content of 2.0 mol %. Then, molar equivalents of potassium bromide and silver nitrate were added thereto at pH 7.8 and pAg 8.9 so as to prepare silver iodobromide grains having an average silver iodide content of 2.3 mol % and three different average grain sizes of 1.15 μm (C), 0.63 μm (D) and 0.38 μm (E). The emulsions were subjected to desalination of a normal flocculation method. That is, a formalin condensate of sodium naphthalene sulfonate and an aqueous solution of magnesium sulfate were added at 40° C. for flocculation. After decantation, demineralized water below 40° C. was added thereto, and the aqueous solution of magnesium sulfate was added again for reflocculation, and decantation followed.

The resultant grains (D), (E) were chemically sensitized in the same manner as in Example 6. After that, 4-hydroxy-6-methyl-1,3,3a,7-tetrazaindene was added, and then these grains were subjected to spectral sensitization by the addition of potassium iodide and the spectral sensitizing dyes (1) and (2) as in Example 6. The grains (C) were subjected to chemical sensitization in a different way; that is, after adding the spectral sensitizing dyes (1) and (2) in amounts of 350 mg/mol AgX and 10 mg/mol AgX respectively, gold-sulfur sensitization was performed by the addition of ammonium thiocyanate, chloroauric acid and hypo. Then, the grains were stabilized by adding 4-hydroxy-6-methyl-1,3,3a,7-tetrazaindene.

Next, these three types of grains (C), (D) and (E) were mixed at a ratio of 10%, 65% and 25%, and then made up to coating emulsions in the same manner as in Example 6. Coated samples shown in Table 3-2 were prepared by the same procedure as in Example 6, except that the foregoing coating emulsions were used.

The samples were divided into three groups: the 1st group included fresh samples for immediate evaluation, the samples of the 2nd group were conditioned at 23° C. and 55% RH for 3 days (preservation I). The samples of the 3rd group were conditioned at 23° C. and 55% RH for 3 hours and then subjected to forced deterioration at 55° C. for 3 days while being piled up in a moisture proof bag (preservation II).

These samples were evaluated for the surface specific resistance and image tone in the same manner as in Example 6. The results are summarized in Table 3-2.

TABLE 3-2

| Sample No. | Water-soluble electroconductive polymer (1) Exemplified No. | Water-soluble electroconductive polymer (1) (g/m²) | Dye-polymer dispersion: Hydrophobic polymer (2) Exemplified No. | Hydrophobic polymer (2) (g/m²) | Cyan dye Exemplified No. | Cyan dye (mg/mol AgX) | Hardener (3) Exemplified No. | Hardener (3) (mg/mol AgX) |
|---|---|---|---|---|---|---|---|---|
| 16 | P-15 | 0.7 | L-9 | 0.4 | B-1 | 350 | 8-2 | $3.0 \times 10^{-3}$ |
| 17 | P-15 | 0.7 | L-9 | 0.4 | B-1 | 600 | 8-2 | $3.0 \times 10^{-3}$ |
| 18 | P-15 | 0.6 | L-9 | 0.5 | B-1 | 400 | 4-2 | $3.0 \times 10^{-3}$ |
| 19 | P-15 | 0.6 | L-6 | 0.5 | B-13 | 500 | 4-2 | $3.0 \times 10^{-3}$ |
| 20 | P-19 | 0.6 | L-6 | 0.5 | B-13 | 350 | 5-3 | $3.0 \times 10^{-3}$ |
| 21 | P-19 | 0.5 | L-6 | 0.6 | B-27 | 400 | 5-3 | $2.5 \times 10^{-3}$ |
| 22 | P-19 | 0.5 | L-6 | 0.6 | B-35 | 400 | 5-3 | $2.5 \times 10^{-3}$ |
| 23 | P-10 | 0.5 | L-3 | 0.4 | B-35 | 50 | 2-6 | $2.5 \times 10^{-3}$ |
| 24 | P-10 | 0.6 | L-3 | 0.4 | B-39 | 350 | 2-6 | $2.5 \times 10^{-3}$ |
| 25 | P-8 | 0.6 | L-3 | 0.4 | B-39 | 200 | 2-6 | $2.5 \times 10^{-3}$ |
| 26 | P-8 | 0.6 | L-9 | 0.4 | — | — | 2-6 | $3.0 \times 10^{-3}$ |
| 27 | P-8 | 0.6 | L-9 | 0.4 | — | — | 9-2 | $3.0 \times 10^{-3}$ |
| 28 | — | — | — | — | — | — | — | $3.0 \times 10^{-3}$ |

| Sample No. | Dye dispersion (for comparison) Exemplified No. | Dye dispersion (for comparison) (mg/mol AgX) | Surface specific resistance (Ω): Fresh | Preservation I | Preservation II | Tone rank | Remarks |
|---|---|---|---|---|---|---|---|
| 16 | — | — | $2.0 \times 10^{11}$ | $2.1 \times 10^{11}$ | $2.2 \times 10^{11}$ | 4 | Invention |

TABLE 3-2-continued

| | | | | | | | |
|---|---|---|---|---|---|---|---|
| 17 | — | — | $1.8 \times 10^{11}$ | $1.9 \times 10^{11}$ | $2.0 \times 10^{11}$ | 5 | Invention |
| 18 | — | — | $2.1 \times 10^{11}$ | $2.1 \times 10^{11}$ | $2.2 \times 10^{11}$ | 4 | Invention |
| 19 | — | — | $2.0 \times 10^{11}$ | $2.1 \times 10^{11}$ | $2.2 \times 10^{11}$ | 5 | Invention |
| 20 | — | — | $2.0 \times 10^{11}$ | $2.2 \times 10^{11}$ | $2.3 \times 10^{11}$ | 5 | Invention |
| 21 | — | — | $1.9 \times 10^{11}$ | $2.0 \times 10^{11}$ | $2.2 \times 10^{11}$ | 4 | Invention |
| 22 | — | — | $1.9 \times 10^{11}$ | $1.9 \times 10^{11}$ | $2.1 \times 10^{11}$ | 5 | Invention |
| 23 | — | — | $2.0 \times 10^{11}$ | $2.1 \times 10^{11}$ | $2.1 \times 10^{11}$ | 3 | Invention |
| 24 | B-6 | 350 | $2.9 \times 10^{11}$ | $3.4 \times 10^{11}$ | $4.5 \times 10^{11}$ | 5 | Invention |
| 25 | — | — | $2.1 \times 10^{11}$ | $2.2 \times 10^{11}$ | $2.2 \times 10^{11}$ | 4 | Invention |
| 26 | B-1 | 350 | $3.1 \times 10^{11}$ | $3.9 \times 10^{11}$ | $4.9 \times 10^{11}$ | 2 | Comparison |
| 27 | — | — | $2.2 \times 10^{11}$ | $2.2 \times 10^{11}$ | $2.3 \times 10^{11}$ | 1 | Comparison |
| 28 | B-1 | 350 | $3.2 \times 10^{11}$ | $4.2 \times 10^{11}$ | $5.0 \times 10^{11}$ | 1 | Comparison |

As apparent from Table 3-2, the samples of the invention exhibited a stable surface specific resistance even after preservation under severe conditions and were capable of providing pure black image tone suited to the X-ray photographic diagnosis.

EXAMPLE 8

A support provided with the electroconductive layer like Example 6 was prepared.

Preparation of support provided with the electroconductive layer

Corona discharge, coating of a latex layer, coating of an electroconductive layer of the invention, and recorona discharge were performed on both sides of a 180 μm thick polyethylene terephthalate support in the same manner as in Example 6, except that the following dispersion was used in the electroconductive layer.

Preparation of Dye-polymer Dispersion

An ethyl acetate solution containing a dye and 50 wt % of a hydrophobic polymer, both of which are shown in Table 3-3, was heated at 50° C. The solution was poured into a 10% aqueous solution of gelatin containing sodium dodecylbenzene sulfonate and then passed through a colloid mill seven times. It was observed that the dye was finely dispersed together with the polymer and solvent. Incidentally, a dispersion prepared in the same manner as in Example 6 was used in comparative samples.

The resultant samples were evaluated for the surface specific resistance and image tone in the same way as in Example 6. But, processing solutions used in the foregoing automatic developing machine were of the following compositions. The evaluation results are shown in Table 3—3.

| Developer composition | |
|---|---|
| Potassium sulfite | 70 g |
| Hydroquinone | 25 g |
| 1-phenyl-3-pyrazolidone | 1.5 g |
| Boric acid | 10 g |
| Potassium hydroxide | 23 g |
| Triethylene glycol | 17.5 g |
| 5-nitroindazole | 0.1 g |
| 5-methylbenzotriazole | 0.04 g |
| 1-phenyl-5-mercaptotetrazole | 0.015 g |
| Glutaraldehyde bisulfite | 8.0 g |
| Glacial acetic acid | 16 g |
| Disodium ethylenediamine tetracetate | 20 g |
| Sodium bisulfite | 5 g |
| Sodium hydroxyethylethylenediamine triacetate | 8 g |
| Potassium bromide | 4 g |
| | 1 g |

Water was added to make up to 1 l.

| Fixer composition | |
|---|---|
| Potassium sulfite | 15 g |
| Disodium ethylenediamine tetracetate | 0.5 g |
| Ammonium thiosulfate | 140 g |
| Anhydrous sodium sulfite | 7.3 g |
| Potassium acetate | 15.5 g |
| Aluminium sulfate (10 to 18 hydrates) | 27.7 g |
| Sulfuric acid (5 wt %) | 6.0 g |
| Citric acid | 0.9 g |
| Boric acid | 7.0 g |
| Glacial acetic acid | 5.1 g |

Water was added to make up to 1 l, then pH was adjusted to 4.0 with glacial acetic acid.

As seen in Table 3—3, the samples of the invention exhibited low surface specific resistances and excellent image tones.

TABLE 3-3

| | Water-soluble electroconductive polymer (1) | | Dye-polymer dispersion | | | |
|---|---|---|---|---|---|---|
| | | | Hydrophobic polymer (2) | | Yellow dye | |
| Sample No. | Exemplified No. | ($g/m^2$) | Exemplified No. | ($g/m^2$) | Exemplified No. | (mg/mol AgX) |
| 29 | P-1 | 0.6 | L-2 | 0.4 | C-1 | 300 |
| 30 | P-1 | 0.6 | L-2 | 0.4 | C-1 | 600 |
| 31 | P-1 | 0.6 | L-2 | 0.5 | C-1 | 400 |
| 32 | P-1 | 0.6 | L-3 | 0.5 | C-3 | 200 |
| 33 | P-1 | 0.6 | L-3 | 0.5 | C-3 | 200 |
| 34 | P-3 | 0.6 | L-3 | 0.6 | C-3 | 600 |
| 35 | P-3 | 0.6 | L-12 | 0.6 | C-3 | 350 |
| 36 | P-3 | 0.6 | L-12 | 0.6 | C-8 | 350 |
| 37 | P-3 | 0.6 | L-12 | 0.3 | C-8 | — |
| 38 | P-3 | 0.6 | L-12 | 0.3 | C-8 | 400 |
| 39 | P-4 | 0.6 | L-10 | 0.4 | C-14 | 400 |
| 40 | P-4 | 0.6 | L-10 | 0.4 | C-14 | 400 |
| 41 | P-4 | 0.6 | L-10 | 0.4 | — | — |
| 42 | — | — | — | — | — | — |

Dye dispersion Surface

TABLE 3-3-continued

| Sample No. | Hardener (3) Exemplified No. | (mol/dm$^2$) | (for comparison) Exemplified No. | (mg/mol AgX) | specific resistance (Ω) | Tone rank | Remarks |
|---|---|---|---|---|---|---|---|
| 29 | 1-2 | $3.0 \times 10^{-3}$ | — | — | $2.1 \times 10^{11}$ | 4 | Invention |
| 30 | 1-2 | $3.0 \times 10^{-3}$ | — | — | $2.0 \times 10^{11}$ | 4 | Invention |
| 31 | 1-2 | $3.0 \times 10^{-3}$ | — | — | $1.9 \times 10^{11}$ | 4 | Invention |
| 32 | 1-2 | $3.0 \times 10^{-3}$ | — | — | $1.9 \times 10^{11}$ | 3 | Invention |
| 33 | 3-8 | $3.0 \times 10^{-3}$ | — | — | $1.9 \times 10^{11}$ | 4 | Invention |
| 34 | 3-8 | $3.0 \times 10^{-3}$ | — | — | $1.9 \times 10^{11}$ | 4 | Invention |
| 35 | 3-8 | $3.0 \times 10^{-3}$ | — | — | $2.0 \times 10^{11}$ | 4 | Invention |
| 36 | 7-3 | $3.0 \times 10^{-3}$ | — | — | $2.2 \times 10^{11}$ | 4 | Invention |
| 37 | 7-3 | $3.0 \times 10^{-3}$ | — | — | $2.1 \times 10^{11}$ | 1 | Comparison |
| 38 | 7-3 | $3.0 \times 10^{-3}$ | C-8 + A1 | 350 + 350 | $8.0 \times 10^{11}$ | 4 | Invention |
| 39 | 7-3 | $3.0 \times 10^{-3}$ | — | — | $2.0 \times 10^{11}$ | 4 | Invention |
| 40 | 1-2 | $3.0 \times 10^{-3}$ | — | — | $2.0 \times 10^{11}$ | 3 | Invention |
| 41 | 1-2 | $3.0 \times 10^{-3}$ | C-1 + A4 | 400 + 300 | $1.0 \times 10^{12}$ | 2 | Comparison |
| 42 | — | — | C-1 + A4 | 400 + 300 | $1.5 \times 10^{12}$ | 4 | Comparison |

What is claimed is:

1. A light-sensitive silver halide photographic element comprising a support, at least one silver halide emulsion layer, and an antistatic layer provided between said support and a lowermost silver halide emulsion layer, said antistatic layer consisting essentially of an effective amount of a water soluble electrically conductive binder polymer having an electrically conductive group selected from the class consisting of sulfonic acid, sulfuric ester, and quaternary ammonium, an effective amount of latex hydrophobic polymer particles, said hydrophobic polymer particles comprising at least one component selected from the group consisting of a styrene derivative, alkyl acrylate, and alkyl methacylate in an amount of at least 30 mol %, and a hardener;

at least one layer other than said antistatic layer being a hydrophilic colloidal layer containing 0.1 to 2.0 g of a polyhydric alcohol having 2 to 8 carbon atoms and 2 to 6 hydroxy groups, said hydrophilic colloidal layer being a silver halide emulsion layer or a layer adjacent to a silver halide emulsion layer.

2. The element of claim 1 wherein said hardener is selected from the group consisting of

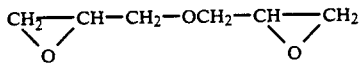
(A-1)

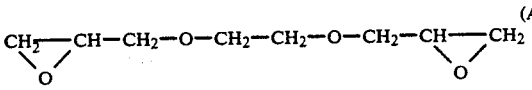
(A-2)

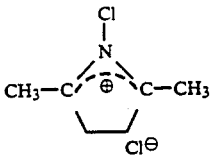
(A-3)

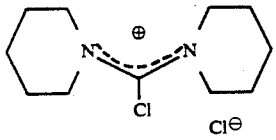
(A-4)

-continued

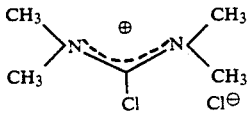
(A-5)

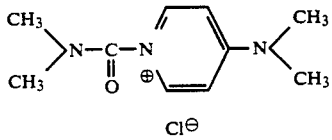
(A-6)

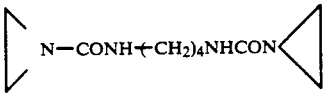
(A-8)

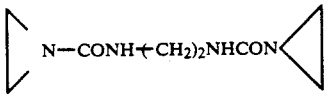
(A-9)

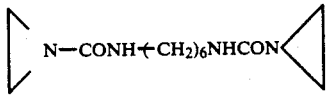
(A-7)

Formaldehyde (B-1)

Glyoxal (B-2)

Mucochloric acid (B-3)

$CH_2{=}CH{-}SO_2{-}CH_2{-}O{-}CH_2{-}SO_2{-}CH{=}CH_2$ (B-4)

$CH_2{=}CH{-}SO_2{-}CH_2CH_2CH_2SO_2{-}CH{=}CH_2$ (B-5)

$CH_2{=}CH{-}SO_2{-}CH_2CH(OH)CH_2{-}SO_2{-}CH{=}CH_2$ (B-6)

$H_2NCH_2CH_2NHCH_2CH_2CH_2Si(OCH_3)_3$ (C-1)

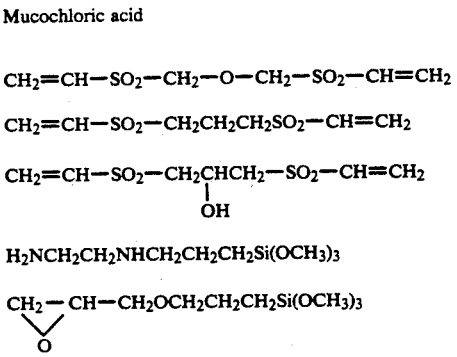
(C-2)

$CH_2{=}CH{-}Si(OCH_3)_3$ (C-3)

3. The element of claim 1 wherein said hardener is selected from the group consisting of:

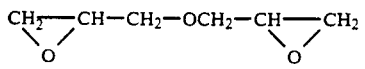
(A-1)
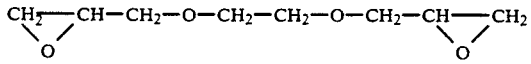
(A-2)
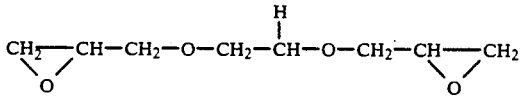
4-1
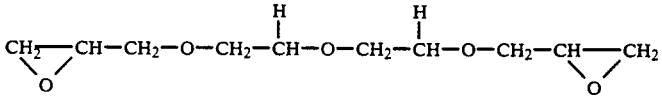
4-2
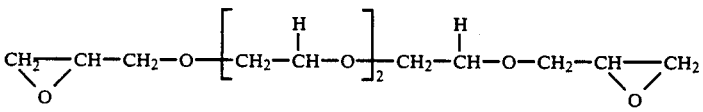
4-3
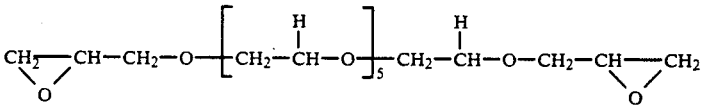
4-4
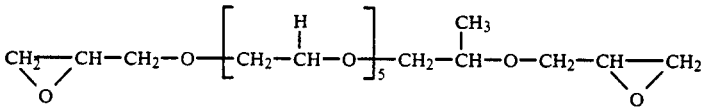
4-5
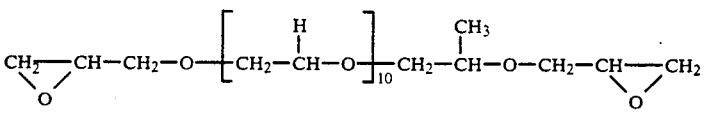
4-6
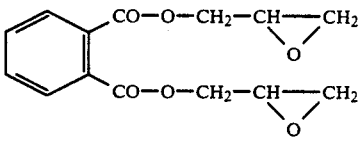
4-7
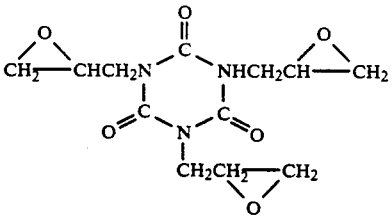
4-8
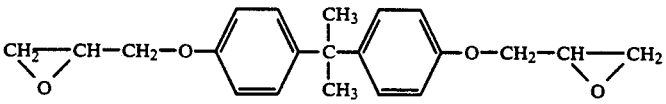
4-9
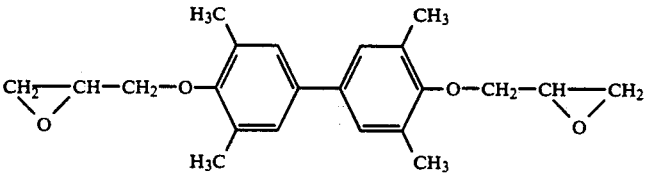
4-10

-continued
4-11
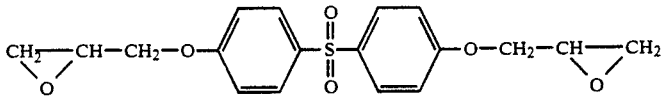
4-12
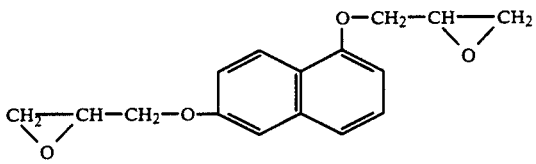
4-13
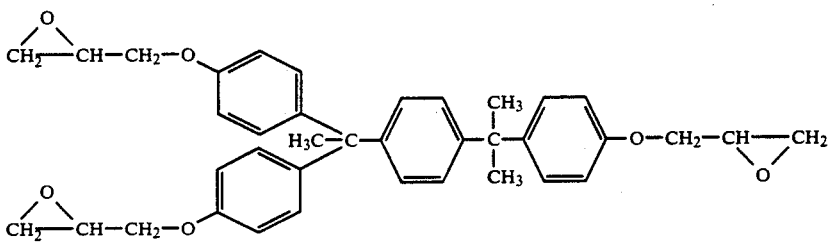
4-14
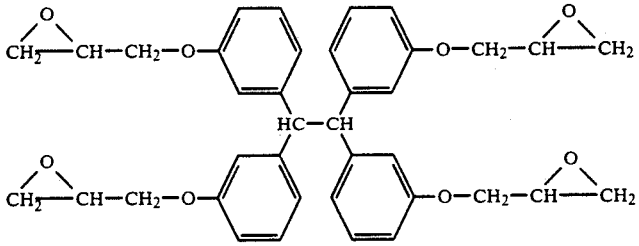
4-15
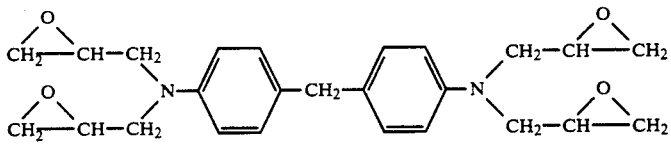
4-16
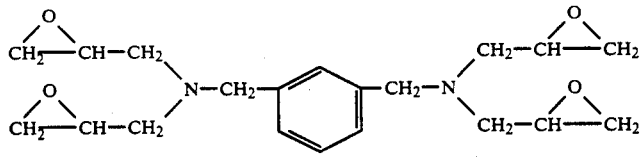
4-17
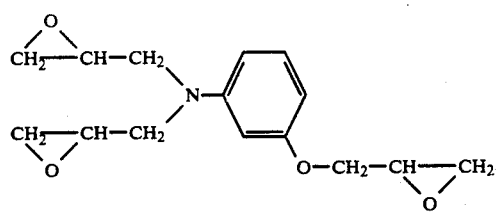
4-18
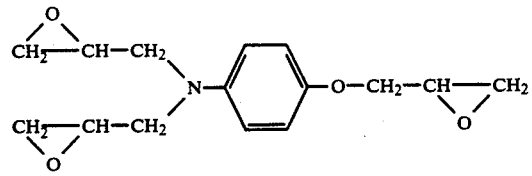
2-1
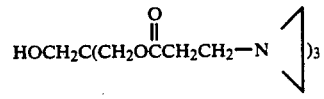

-continued 2-2

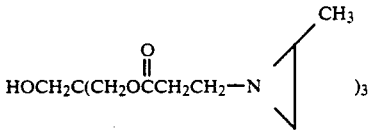

2-3

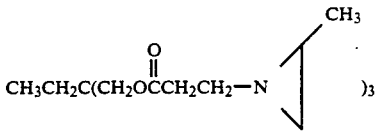

2-4

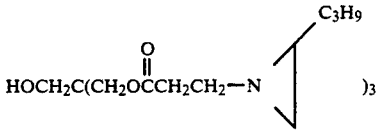

2-5

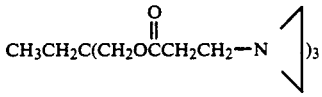

2-6

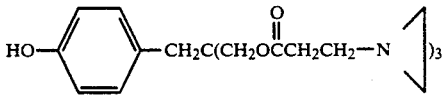

2-7

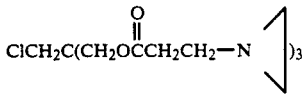

9-2

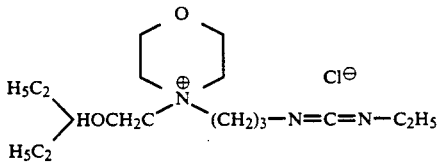

9-1

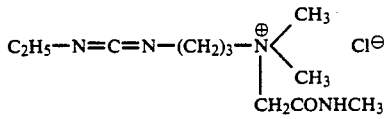

4. The photographic element of claim 1, wherein said water-soluble electric conductive polymer has a sulphonic group or salt thereof in a polymer molecule.

5. The photographic element of claim 1, wherein a molecular weight of said water-soluble electric conductive polymer is 100 to 10,000,000.

6. The photographic element of claim 5, wherein a molecular weight of said water-soluble electric conductive polymer is 10,000 to 500,000.

7. The photographic element of claim 4, wherein said hydrophobic polymer particles are water-insoluble latex having a molecular weight of not less than 3,000.

8. The photographic element of claim 1, wherein the hydrophobic polymer particles contain styrene derivative, alkylacrylate or alkylmethacrylate in an amount of not less than 30 mol % in a molecule of the hydrophobic polymer.

9. The photographic element of claim 1, wherein said hardener is an aziridine compound having 2 or 3 functional groups.

10. The photographic element of claim 9, wherein said aziridine compound has a molecular weight of not more than 600.

11. The photographic element of claim 1, wherein a molecular weight of said polyhydric alcohol is not more than 150.

12. The photographic element of claim 1, wherein said hydrophobic polymer particle contain dye having an maximum absorption wave length between 400 and 510 nm.

13. The photographic element of claim 1, further comprising an electric conductive layer comprising a water-soluble electric conductive polymer, hydrophobic polymer particles and a hardener positioned over said hydrophilic colloid layer nearest to the support.

14. The photographic element of claim 13, wherein said electric conductive layer is the outermost layer.

* * * * *